US011112748B2

(12) United States Patent
Yamada et al.

(10) Patent No.: US 11,112,748 B2
(45) Date of Patent: Sep. 7, 2021

(54) DEVELOPING MEMBER, PROCESS CARTRIDGE AND ELECTROPHOTOGRAPHIC APPARATUS

(71) Applicant: CANON KABUSHIKI KAISHA, Tokyo (JP)

(72) Inventors: Masaki Yamada, Numazu (JP); Yuichi Kikuchi, Suntou-gun (JP); Tetsuo Hino, Yamato (JP); Kazuhiro Yamauchi, Suntou-gun (JP); Takumi Furukawa, Susono (JP); Hiroaki Watanabe, Odawara (JP); Kenya Terada, Suntou-gun (JP); Yuya Tomomizu, Ichikawa (JP); Toshimitsu Nakazawa, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/070,712

(22) Filed: Oct. 14, 2020

(65) Prior Publication Data

US 2021/0026295 A1 Jan. 28, 2021

Related U.S. Application Data

(63) Continuation of application No. PCT/JP2019/016693, filed on Apr. 18, 2019.

(30) Foreign Application Priority Data

Apr. 18, 2018 (JP) ..... JP2018-079952
Feb. 26, 2019 (JP) ..... JP2019-032936
Mar. 29, 2019 (JP) ..... JP2019-069099

(51) Int. Cl.
*G03G 21/16* (2006.01)
*G03G 21/18* (2006.01)
(Continued)

(52) U.S. Cl.
CPC ..... *G03G 21/1814* (2013.01); *G03G 5/0553* (2013.01); *G03G 15/0808* (2013.01)

(58) Field of Classification Search
CPC ..... G03G 5/0553; G03G 15/0808; G03G 21/1814
See application file for complete search history.

(56) References Cited

U.S. PATENT DOCUMENTS 3,640,708 A 2/1972 Humphriss
5,198,685 A 3/1993 Kitani et al.
(Continued)

FOREIGN PATENT DOCUMENTS

EP 1385176 A1 1/2004
EP 3048489 A1 7/2016
(Continued)

OTHER PUBLICATIONS

International Search Report dated Jul. 9, 2019, in International Application PCT/JP2019/016693.

*Primary Examiner* — Hoang X Ngo
(74) *Attorney, Agent, or Firm* — Venable LLP

(57) ABSTRACT

An electrophotographic developing member includes an electro-conductive support and an electro-conductive layer provided on the support, wherein the electro-conductive layer has a matrix containing a first rubber and a plurality of domains dispersed in the matrix, and the domain contains a second rubber and an electronic conductive agent and when a frequency is log-log-plotted on a horizontal axis and an impedance is log-log-plotted on a vertical axis with respect to an impedance measured by applying an alternating current voltage having an amplitude of 1 V on the electro-conductive layer while changing a frequency between $1.0\times10^{-2}$ Hz to $1.0\times10^{7}$ Hz under a specific environment, an inclination of an impedance on a high frequency side is −0.8
(Continued)

or more and −0.3 or less and an impedance on a low frequency side is $1.0\times10^{4}\Omega$ to $1.0\times10^{11}\Omega$.

10 Claims, 7 Drawing Sheets

(51) Int. Cl.
*G03G 5/05* (2006.01)
*G03G 15/08* (2006.01)

(56) References Cited

U.S. PATENT DOCUMENTS 6,070,040 A 5/2000 Goto et al.
7,693,457 B2 4/2010 Kuruma et al.
7,744,515 B2 6/2010 Iwamura et al.
7,797,833 B2 9/2010 Nakamura et al.
7,799,398 B2 9/2010 Nakamura et al.
7,962,068 B2 6/2011 Kuroda et al.
8,275,293 B2 9/2012 Ono
8,298,670 B2 10/2012 Muranaka et al.
8,440,307 B2 5/2013 Nose et al.
8,445,113 B2 5/2013 Furukawa et al.
8,449,975 B2 5/2013 Hirakoso et al.
8,469,867 B2 6/2013 Kuroda et al.
8,481,167 B2 7/2013 Watanabe et al.
8,491,994 B2 7/2013 Harada et al.
8,501,312 B2 8/2013 Watanabe et al.
8,501,325 B2 8/2013 Tomomizu et al.
8,503,911 B2 8/2013 Suzumura et al.
8,526,857 B2 9/2013 Tomomizu et al.
8,532,535 B2 9/2013 Nose et al.
8,538,298 B2 9/2013 Harada et al.
8,600,273 B2 12/2013 Yamada et al.
8,622,881 B1 1/2014 Harada et al.
8,628,854 B2 1/2014 Yamauchi et al.
8,655,222 B2 2/2014 Nakamura et al.
8,668,987 B2 3/2014 Yamauchi et al.
8,685,601 B2 4/2014 Nose et al.
8,706,011 B2 4/2014 Anan et al.
8,715,830 B2 5/2014 Yamada et al.
8,750,762 B2 6/2014 Harada et al.
8,755,714 B2 6/2014 Nagamine et al.
8,768,226 B2 7/2014 Koyanagi et al.
8,768,227 B2 7/2014 Urushihara et al.
8,771,818 B2 7/2014 Nishioka et al.
8,774,677 B2 7/2014 Sakurai et al.
8,798,508 B2 8/2014 Yamada et al.
8,837,985 B2 9/2014 Ishida et al.
8,846,287 B2 9/2014 Yamada et al.
8,852,743 B2 10/2014 Kikuchi et al.
8,874,007 B2 10/2014 Kawamura et al.
8,874,012 B2 10/2014 Yamada et al.
8,913,930 B2 12/2014 Ishii et al.
8,923,732 B2 12/2014 Harada et al.
8,991,053 B2 3/2015 Watanabe et al.
9,023,465 B2 5/2015 Yamada et al.
9,086,643 B2 7/2015 Kikuchi et al.
9,128,403 B2 9/2015 Yamauchi et al.
9,146,482 B2 9/2015 Watanabe et al.
9,360,789 B1 6/2016 Masu et al.
9,360,833 B2 6/2016 Terada et al.
9,372,428 B2 6/2016 Kurada et al.
9,372,429 B2 6/2016 Watanabe et al.
9,442,408 B2 9/2016 Yamauchi et al.
9,442,451 B2 9/2016 Yamauchi et al.
9,541,854 B2 1/2017 Kikuchi et al.
9,547,250 B2 1/2017 Kikuchi et al.
9,551,949 B2 1/2017 Yamauchi et al.
9,581,931 B2 2/2017 Yamada et al.
9,599,913 B2 3/2017 Nishioka et al.
9,639,009 B2 5/2017 Yamaguchi et al.
9,651,888 B2 5/2017 Muranaka et al.
9,665,028 B2 5/2017 Arimura et al.
9,665,029 B2 5/2017 Hino et al.
9,740,133 B2 8/2017 Yamauchi et al.
9,811,009 B2 11/2017 Yamada et al.
9,811,021 B2 11/2017 Muranaka et al.
9,897,931 B2 2/2018 Nishioka et al.
9,904,199 B2 2/2018 Terada et al.
9,910,379 B2 3/2018 Furukawa et al.
9,958,802 B2 5/2018 Kikuchi et al.
9,964,914 B2 5/2018 Arimura et al.
9,977,353 B2 5/2018 Nishioka et al.
9,977,359 B2 5/2018 Koyanagi et al.
10,018,927 B2 7/2018 Yamada et al.
10,018,934 B2 7/2018 Yamada et al.
10,108,129 B2 10/2018 Yamaguchi et al.
10,146,149 B2 12/2018 Watanabe et al.
10,197,930 B2 2/2019 Yamada et al.
10,280,148 B2 5/2019 Nishioka et al.
10,303,079 B2 5/2019 Utsuno et al.
10,317,811 B2 6/2019 Tomomizu et al.
10,331,054 B2 6/2019 Urushihara et al.
10,379,460 B2 8/2019 Arimura et al.
10,416,588 B2 9/2019 Masu et al.
10,545,453 B2 1/2020 Iwasaki et al.
10,558,136 B2 2/2020 Furukawa et al.
10,649,350 B2 5/2020 Yamaguchi et al.
10,663,913 B2 5/2020 Yamaai et al.
10,678,154 B2 6/2020 Takashima et al.
10,678,158 B2 6/2020 Kikuchi et al.
10,678,161 B2 * 6/2020 Tsuru ..... G03G 15/1685
2012/0076535 A1 3/2012 Nagamine et al.
2012/0224887 A1 9/2012 Harada
2012/0308261 A1 12/2012 Tsuru et al.
2013/0004206 A1 1/2013 Kuroda et al.
2013/0034369 A1 2/2013 Masu et al.
2013/0064571 A1 3/2013 Kodama et al.
2013/0281276 A1 10/2013 Watanabe et al.
2015/0132032 A1 * 5/2015 Hagiwara ..... G03G 15/0818 399/286
2015/0331346 A1 * 11/2015 Yamauchi ..... B32B 27/40 492/18
2017/0102633 A1 * 4/2017 Yoshidome ..... G03G 21/18
2019/0094741 A1 3/2019 Uno et al.
2019/0302644 A1 10/2019 Yamada et al.
2020/0033742 A1 1/2020 Komatsu et al.
2020/0041920 A1 2/2020 Arimura et al.
2020/0310264 A1 10/2020 Kurachi et al.
2020/0310265 A1 10/2020 Nishioka et al.
2020/0310266 A1 10/2020 Kikuchi et al.
2021/0033996 A1 2/2021 Kikuchi et al.
2021/0041796 A1 2/2021 Nishioka et al.
2021/0048759 A1 2/2021 Hino et al.

FOREIGN PATENT DOCUMENTS

EP 3073324 A1 9/2016
EP 3306409 A1 4/2018
JP H02-206629 A 8/1990
JP 05072889 A 3/1993
JP 11231637 A 8/1999
JP 2006-30456 A 2/2006
JP 2006207807 A 8/2006
JP 2011022410 A 2/2011
JP 2011022420 A 2/2011
JP 2012163954 A 8/2012
JP 2017058639 A 3/2017

* cited by examiner

DEVELOPING MEMBER, PROCESS CARTRIDGE AND ELECTROPHOTOGRAPHIC APPARATUS

CROSS-REFERENCE TO RELATED APPLICATIONS

This application is a Continuation of International Patent Application No. PCT/JP2019/016693, filed Apr. 18, 2019, which claims the benefit of Japanese Patent Application No. 2018-079952, filed Apr. 18, 2018, Japanese Patent Application No. 2019-032936, filed Feb. 26, 2019, and Japanese Patent Application No. 2019-069099, filed Mar. 29, 2019, each of which is hereby incorporated by reference herein in its entirety.

BACKGROUND

The present disclosure relates to a developing member used in an electrophotographic apparatus, a process cartridge having the developing member, and an electrophotographic apparatus.

DESCRIPTION OF THE RELATED ART

In an electrophotographic apparatus, for example, a developing member including an electro-conductive layer having an electric resistance value (hereinafter referred to as a "resistance value") such as $1\times10^5$ to $1\times10^{12}\Omega$ has been used as a developing member such as a developing roller, a toner supplying roller, and a developing blade. Conventionally, an electronic conductive agent such as carbon black or an ionic conductive agent such as a quaternary ammonium salt has been used for imparting conductivity to the electro-conductive layer to form a stable conductive mechanism.

The developing member is required to have various functions such as toner conveyance to an electrophotographic photosensitive member (hereinafter referred to as a "photosensitive member"), electric charge impartment to a toner, and difficulty of surface contamination, and various countermeasures have been disclosed in order to achieve these functions.

Japanese Patent Application Laid-Open No. H05-72889 discloses a method of improving a toner releasing property or wear resistance by using a roll-shaped developer carrier having a continuous phase and a discontinuous phase on a surface.

In addition, Japanese Patent Application Laid-Open No. 2011-22420 discloses a method of decreasing discharge unevenness by a surface layer of an electro-conductive member having a sea-island structure including a non-conductive sea portion and an island portion containing an electronic conductive agent.

In recent years, an electrophotographic apparatus has been required to be able to maintain high image quality and high durability even in a high-speed process in a harsh environment.

For example, when an electronic conductive agent such as carbon black is dispersed in an electro-conductive layer, electric charges are transferred in an electro-conductive path connected by the electronic conductive agent from an electro-conductive support to a surface of an electro-conductive member, such that conductivity is exhibited. Therefore, this conductive path is responsible for transporting the electric charges consumed by electrification, and thus, it takes a certain period of time to supply the electric charges for the next electrification.

That is, in the high-speed process, in a case where the supply of the electric charges to a toner cannot follow a process speed, a variation in an amount of electric charges imparted to the toner occurs. As a result, it was difficult to realize uniform development, and for example, a fog image in which a toner whose charged quantity is insufficient appears in an image might occur.

In addition, in the electro-conductive member that exhibits conductivity by dispersing an ionic conductive agent in the electro-conductive layer, the conductivity is exhibited by the transfer of anions and cations such as quaternary ammonium. Therefore, in the high-speed process, in a case where a transfer speed of the anions or the cations is low, the transfer speed cannot follow a process speed, and similar to the above case, the electric charge supply to the toner for the next development was insufficient, such that a fog image might occur.

The transfer of the electric charges in the electro-conductive path and a process of imparting the electric charges to the toner are inferred as follows. First, a voltage is applied to the electro-conductive support connected to a power supply, such that the electric charges are supplied. The electric charges are transported (supplied) to a surface of a developing member through the electro-conductive layer of the electro-conductive member.

When the surface of the developing member brings into contact with the toner in this state, the electric charges on the surface of the developing member are transferred to the toner, that is, the electric charges are supplied to the toner.

The electric charges on the surface of the developing member decrease by an amount of the electric charges transferred to the toner, but new electric charges are supplied to the surface of the developing member through the electro-conductive support as long as the electro-conductive support of the developing member is connected to the power supply.

As such, the new electric charges are continuously supplied to the developing member, such that the electric charges can be continuously supplied to the toner.

Meanwhile, in a developing process using a toner carrier and a developing blade, toner particles form a toner layer having a thickness of about two or three toner particles on a surface of the toner carrier, and are developed on a photosensitive member. On the surface of the toner carrier, the toner is charged by being supplied with the electric charges from the toner carrier within a very short time in which it passes between the toner carrier and the developing blade while rolling.

Therefore, when the supply of the electric charges to the developing member is stagnant and an electric charge transfer speed in the electro-conductive layer of the developing member is slow, an amount of new electric charges supplied to the surface of the developing member is limited. In a high-speed process in which it is necessary to supply the electric charges to many toners per unit time, when the amount of new electric charges supplied to the surface of the developing member is limited, an insufficiency of electric charge supply to the toner occurs. As a result, a variation occurs in an amount of electric charges received by the toner at the time of bringing into contact with the surface of the developing member and rolling, such that a charged quantity distribution of the toner becomes large. Moreover, a toner that is difficult to develop is generated in a developing portion (position where the photosensitive member and the developing member face each other), such that so-called fog is likely to occur.

The inventors have attempted to decrease a resistance of the electro-conductive layer by mixing a large amount of conductive agent in the electro-conductive layer in order to increase the electric charge transfer speed of the electro-conductive layer of the developing member.

However, regardless of which of an ionic conductive agent or an electronic conductive agent is used, in the developing portion of the high speed process, an effect of decreasing a proportion of the toner that is not sufficiently charged was small and an expected fog decrease effect was not obtained.

As described above, it is not easy to provide the developing member capable of forming a high-quality image even in the high speed process. According to an investigation by the inventors, an electro-conductive roll according to Japanese Patent Application Laid-Open No. H05-72889 and an electro-conductive roller according to Japanese Patent Application Laid-Open No. 2011-22420 might generate a fog image considered to be an insufficiency of an electric charge supply amount in image evaluation in the high-speed process.

The present disclosure is directed to providing an electrophotographic developing member capable of maintaining high image quality and high durability even in a high-speed process. In addition, the present disclosure is directed to the provision of an electrophotographic apparatus capable of stably outputting a high-quality electrophotographic image and a process cartridge used therein.

SUMMARY

According to an aspect of the present disclosure, there is provided an electrophotographic developing member comprising a support having an electro-conductive outer surface and an electro-conductive layer provided on the outer surface of the support, the electro-conductive layer having a matrix comprising a first rubber and domains dispersed in the matrix, the domain each comprising a second rubber and an electronic conductive agent, wherein assuming that a metal film is provided on an outer surface of the developing member, and an impedance is measured by applying an alternating current voltage having an amplitude of 1 V between the electro-conductive outer surface of the support and the metal film while varying a frequency between $1.0\times10^{-2}$ Hz to $1.0\times10^{7}$ Hz under an environment of a temperature of 23° C. and a relative humidity of 50%, in a double logarithmic plot with a frequency on an abscissa and an impedance on an ordinate, a slope at a frequency of $1.0\times10^{6}$ Hz to $1.0\times10^{7}$ Hz is −0.8 or more and −0.3 or less, and an impedance at a frequency of $1.0\times10^{-2}$ Hz to $1.0\times10^{0}$ Hz is $1.0\times10^{4}\Omega$ to $1.0\times10^{11}\Omega$.

In addition, according to another aspect of the present disclosure, there is provided a process cartridge configured to be attachable to and detachable from a main body of an electrophotographic apparatus and including the developing member described above.

Further, according to another aspect of the present disclosure, there is provided an electrophotographic apparatus including the process cartridge described above.

Further features of the present disclosure will become apparent from the following description of exemplary embodiments with reference to the attached drawings.

DESCRIPTION OF THE EMBODIMENTS

Figure 1:
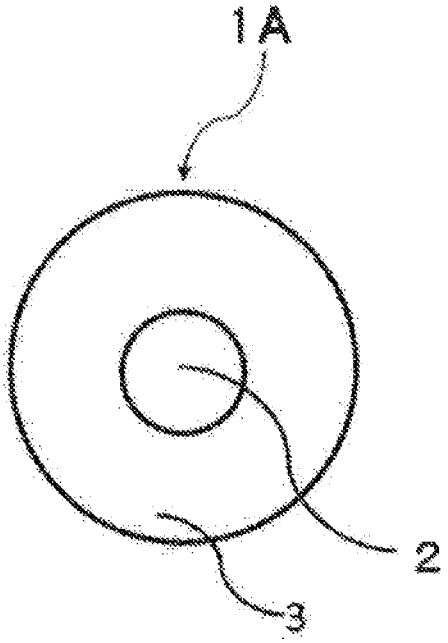
FIG. 1 is a schematic cross-sectional view of an electrophotographic developing roller according to an embodiment of the present disclosure.

The inventors have made extensive investigations to achieve the above object. In a case of a developing member used for imparting electric charges to a toner, the electric charges leading to electric charge impartment to the toner are transported from an electro-conductive support to which a voltage is applied to a surface of the developing member to form a potential on the surface of the developing member. Conventionally, an electro-conductive mechanism for transporting the electric charges is an electro-conductive path of an electronic conductive agent such as carbon black or an electro-conductive path of an ionic conductive agent.

By applying the voltage, the electric charges are transported to the surface of the developing member through the electro-conductive path, and an electric field is generated between the toner and the developing member. Further, on a contact surface between the surface of the developing member and the toner, the electric charges are transferred from the surface of the developing member to the toner by the electric field. The toner is normally carried on the surface of the developing member as a toner layer having a thickness of two to three toner particles, and is supplied with the electric charges at the time of bringing into contact with the developing member while rolling.

In addition, a contact region between the toner and the developing member has a certain area. The electric charge impartment to the toner occurs plural times within this area. For example, in a case where a developing device has a developing roller and a developing blade, the electric charge impartment to the toner occurs plural times while the toner passes through a contact region with the developing blade by rotation of the developing roller and rolling of the toner.

Once the electric charge impartment occurs, the electric charge impartment supplied from the surface of the developing member continues for a certain period of time, and the electric charges transported to the surface of the developing member are consumed. When the electric charge impartment is completed, the consumed electric charges are again supplied from an electro-conductive path inside the developing member to the surface of the developing member, and the next electric charge impartment occurs. Therefore, a final electric charge amount of the toner is considered to be integration of amounts of electric charges imparted plural times.

As described above, the electric field at a contact portion with the surface of the developing member is affected by an environment of the toner or a history of the development, and an amount of imparted electric charges also depends on the environment of the toner or the history of the development. Therefore, an electric charge amount of the toner normally has a distribution.

Particularly in a case of a high-speed process, after first electric charge impartment to the toner occurs, the supply of an electric charge amount for the next electric charge impartment may not be able to follow. Particularly, first electric charge impartment immediately after the toner enters a developing nip region formed by a photosensitive member and the developing member has a sufficient amount of electric charges, but electric charge supply for the subsequent electric charge impartment may not be able to follow.

Therefore, the inventors have made extensive investigations to obtain a developing member that can accumulate sufficient electric charges in a short time and can quickly supply the electric charges. As a result, it has been found that a developing member having the following configuration can well meet the above requirements.

The developing member has a support having an electro-conductive outer surface and an electro-conductive layer provided on the outer surface of the support, the electro-conductive layer has a matrix containing a first rubber and a plurality of domains dispersed in the matrix, and the domain contains a second rubber and an electronic conductive agent.

The developing member has a metal film provided on an outer surface thereof, and when an impedance is measured by applying an alternating current voltage having an amplitude of 1 V between the outer surface of the support and the metal film while changing a frequency between $1.0\times10^{-2}$ Hz to $1.0\times10^{7}$ Hz under an environment of a temperature of 23° C. and a relative humidity of 50%, the frequency is log-log-plotted on a horizontal axis, and the impedance is log-log-plotted on a vertical axis, both of the following first requirement and second requirement are satisfied.

<First Requirement>

An inclination of an impedance at a frequency of $1.0\times10^{6}$ Hz to $1.0\times10^{7}$ Hz is −0.8 or more and −0.3 or less.

<Second Requirement>

An impedance at a frequency of $1.0\times10^{-2}$ Hz to $1.0\times10^{0}$ Hz is $1.0\times10^{4}\Omega$ to $1.0\times10^{11}\Omega$.

That is, according to the developing member according to the present aspect, a developing process in which a variation in an electric charge amount of toner is very small becomes possible.

Hereinafter, an aspect of the developing member according to the present aspect will be described as an example. It should be noted that the developing member according to the present aspect is not limited to a developing roller, and can also be applied to, for example, a developing blade or a toner supply roller.

The developing member according to the present aspect includes a support having an electro-conductive outer surface and an electro-conductive layer provided on the outer surface of the support. The electro-conductive layer has conductivity. Here, the conductivity is defined as a volume resistivity less than $1.0\times10^{8}$ Ω·cm. Then, the electro-conductive layer has a matrix containing a first rubber and a plurality of domains dispersed in the matrix, and the domains contain a second rubber and an electronic conductive agent. In addition, the developing member satisfies the above <First requirement> and <Second requirement>.

<First Requirement>

The first requirement stipulates that stagnation of electric charges in the developing member is unlikely to occur on a high frequency side.

Figure 3:
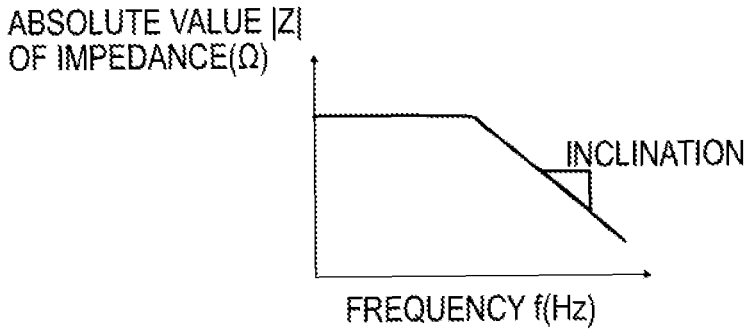
FIG. 3 is an explanatory diagram of a graph illustrating a relationship between an impedance characteristic and a frequency.

When an impedance of a conventional developing member is measured, an inclination becomes always −1 on the high frequency side. Here, the inclination refers to an inclination with respect to a horizontal axis when an impedance characteristic of the developing member is log-log-plotted with respect to a frequency as illustrated in FIG. 3.

An equivalent circuit of the developing member is represented by a parallel circuit of an electric resistance R and a capacitance C, and an absolute value |Z| of the impedance can be expressed by the following Equation (1). Here, f in the Equation (1) indicates a frequency.

$$|Z| = \sqrt{\frac{1}{R^{-2} + (2\pi f)^2 C^2}} \tag{1}$$

From the fact that the inclination of the impedance becomes a straight line of −1 on the high frequency side, it can be inferred that an electric resistance value R is significantly increased, that is, an insulation capacitance is being measured, because the transfer of electric charges cannot follow a high frequency voltage and is stagnant. It can be estimated that a state where the electric charges are stagnant is a state where R is approximated to infinity in Equation (1). At this time, in Equation (2) in which a denominator element in Equation (1) is extracted, $R^{-2}$ can be approximated to a very small value with respect to $(2\pi f)^2C^2$. Therefore, Equation (1) can be modified into Equation in which approximation is performed, such as Equation (3) in which $R^{-2}$ is removed. Finally, when Equation (3) is modified by taking a logarithm on both sides, it becomes Equation (4), and an inclination of log f becomes −1.

$$R^{-2} + (2\pi f)^2 C^2 \tag{2}$$

$$|Z| = \sqrt{\frac{1}{(2\pi f)^2 C^2}} \tag{3}$$

$$\log|Z| = -\log f - \log(2\pi C) \tag{4}$$

Figure 4:
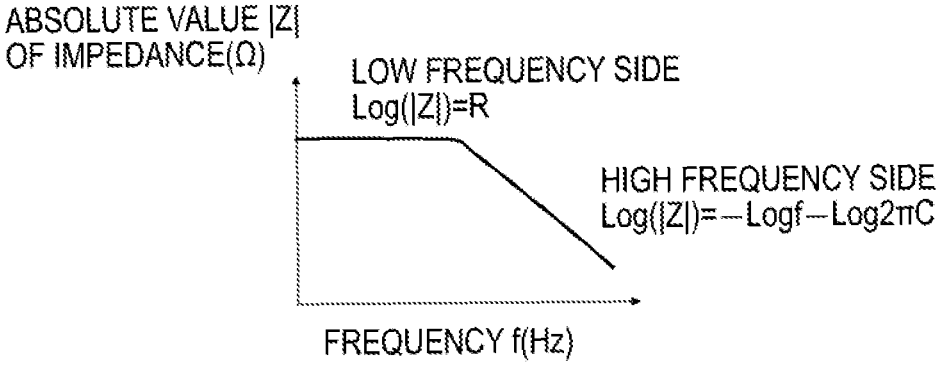
FIG. 4 is an explanatory diagram of a behavior of an impedance.

The meanings of the above Equations (1) to (4) will be described with reference to FIG. 4. In FIG. 4, a vertical axis indicates a logarithm of an absolute value of an impedance, and a horizontal axis indicates a logarithm of a frequency of a measured oscillation voltage. In FIG. 4, a behavior of the impedance expressed by Equation (1) is illustrated. First, as described above, the absolute value of the impedance satisfying Equation (1) decreases at a certain frequency as a frequency increases. A decreasing behavior becomes a straight line of an inclination of −1 without depending on an electric resistance value, a capacitance or the like of the developing member, as represented by Equation (4) in a log-log plot as illustrated in FIG. 4.

When an impedance characteristic of an insulating developing member is measured, since the impedance characteristic becomes a straight line of an inclination of −1, it is inferred that a characteristic that the transfer of the electric charges is stagnant on the high frequency side appears in a state where the inclination is −1, in measurement of the impedance of the developing member. When the transfer of the electric charges on the high frequency side is stagnant, the supply of the electric charges for electrification cannot follow a frequency of the electric charge supply to the toner. As a result, it is inferred that a timing at which the electric charges cannot be supplied occurs, such that a variation in a charged quantity of the toner occurs.

Meanwhile, in a developing member in which an inclination of the impedance is −0.8 or more and −0.3 or less in a high frequency region of $1.0\times10^6$ Hz to $1.0\times10^7$ Hz, the supply of the electric charges is unlikely to be stagnate on the high frequency side. As a result, it becomes possible to supply the electric charges at a frequency from a low frequency range where the impedance has a constant value to a high frequency range, and to supply the electric charges particularly on the high frequency side where the stagnation of the electric charges is likely to occur. Since the supply of the electric charges can be sufficiently realized, it is possible to suppress the variation in the electric charge supply to the toner to improve the total charged quantity of toner. A range of the high frequency region is considered to be a region where the variation in the electric charge supply to the toner is likely to occur because electrification is electrification in a region having the highest frequency among frequencies of the electric charge supply generated from the developing member. By representing a value in the above range in which the inclination is larger than −1 in such a frequency region, the inclination larger than −1 can be obtained even in a high frequency region lower than the frequency region, occurrence of the variation in the electric charge supply to the toner can be suppressed, and the total charged quantity of the toner can be improved.

As a process becomes faster, it is necessary to increase the frequency of the electric charge supply to increase the number of times of discharge. Therefore, it is important to supply the electric charge and control an electro-conductive mechanism particularly in the high frequency region such as $1.0\times10^6$ Hz to $1.0\times10^7$ Hz in the above range.

As described above, in order to increase the number of times of the electric charge supply to the toner, it is effective to deviate the inclination of the impedance in the high frequency region from −1. Therefore, it is possible to satisfactorily achieve a characteristic of rapidly performing electric charge supply to the toner and the supply of electric charges for the next electric charge supply. Since the deviation of the inclination of the impedance from −1 means that the supply of the electric charges in the developing member is not stagnant, such a developing member can obtain a characteristic of suppressing the variation in the electric charge supply to the toner.

<Second Requirement>

An impedance on a low frequency side according to a second requirement represents a characteristic that stagnation of electric charges is unlikely to occur. This can be seen from a region where an inclination of the impedance on the low frequency side is not −1. Then, in Equation (1), when the frequency is approximated to zero, it can be approximated to the electric resistance value R. Therefore, it can be seen that the electric resistance value R represents ability when the electric charges are transferred in a single direction.

Therefore, in measurement while applying a low-frequency voltage, it can be assumed that a transfer amount of the electric charges is simulated in a state where the transfer of the electric charges could follow an oscillation of the voltage. A transfer amount of the electric charges at a low frequency is an index of the ease of the transfer of the electric charges between the developing member and a measuring electrode, and can be used as an index of an amount of the electric charges that can be transferred from the surface of the developing member to the toner by electrification.

In addition, an amplitude of an alternating current voltage used for measurement of the impedance according to the first requirement and the second requirement is 1V. This oscillation voltage for measurement is significantly lower than several hundred V to several thousand V, which is a voltage actually applied to the developing member in an electrophotographic image forming apparatus.

Therefore, it is considered that the ease of emission of the electric charges from the surface of the developing member can be evaluated in a higher dimension by the measurement of the impedance according to the first requirement and the second requirement.

In addition, by satisfying the second requirement, it is possible to control the ease of the emission of the electric charges in an appropriate range. When the impedance is lower than $1.0\times10^4\Omega$, an amount of electric charges supplied once will become too large, such that it is impossible to follow the supply of electric charges for the next electric charge supply. Therefore, the variation in the electric charge supply easily occurs and it becomes difficult to suppress a fog. On the other hand, when the impedance exceeds $1.0\times10^{11}\Omega$, the ease of the emission of the electric charges is decreased, such that an electrification amount until the variation in the electric charge supply is filled is not reached.

It should be noted that as described with reference to FIG. 4, in the developing member, the absolute value of the impedance is constant in the low frequency region, and the impedance at $1.0\times10^{-2}$ Hz to $1.0\times10^0$ Hz can be replaced by a value of the impedance value at, for example, a frequency of 1 Hz.

The developing member satisfying both the first requirement and the second requirement can suppress the variation in the electric charge supply to the toner in a frequency range from the low frequency side to the high frequency side and decrease the fog. By satisfying the first requirement, it is possible to suppress the variation in the electric charge supply on the high frequency side. In addition, by satisfying the second requirement, the amount of the supplied electric charges can be further improved, and the occurrence of the fog can be effectively suppressed.

<Method of Measuring Impedance>

The impedance of the developing member can be measured by the following method.

In order to eliminate an influence of a contact resistance between the developing member and the measuring electrode at the time of measuring the impedance, it is preferable to deposit a thin film having a low resistance on the surface of the developing member, use the thin film as an electrode, and measure the impedance at two terminals using the electro-conductive support as a ground electrode.

Examples of a method of forming the thin film include a method of forming a metal film such as metal vapor deposition, sputtering, coating of a metal paste, and attachment of a metal tape. Among these, the method of forming a metal thin film such as platinum or palladium as an electrode by vapor deposition is preferable from the viewpoint of decreasing a contact resistance with the developing member.

In a case where the metal thin film is formed on the surface of the developing member, considering simplicity and uniformity of the thin film, it is preferable to use a vacuum vapor deposition apparatus to which a mechanism capable of gripping the developing member is provided and a rotation mechanism is further provided with respect to the developing member having a cylindrical cross section.

It is preferable to form a metal thin film electrode having a width of about 10 mm in a longitudinal direction of the developing member and connect a metal sheet wound around the metal thin film electrode in a direction intersecting with the longitudinal direction without a gap to the measuring electrode coming out of a measuring apparatus to perform measurement. In a case of a cylindrical developing member, it is preferable to use a metal sheet wound around the developing member in a circumferential direction of the developing member without a gap. Therefore, the impedance measurement can be performed without being affected by a deflection of a size of an outer edge (outer diameter in the case of the cylindrical developing member) in a cross section orthogonal to the longitudinal direction of the developing member or a surface shape. As the metal sheet, an aluminum foil, a metal tape or the like can be used.

It is sufficient that an impedance measuring apparatus is an apparatus capable of measuring impedance in a frequency region up to $10^7$ Hz, such as an impedance analyzer, a network analyzer, or a spectrum analyzer. Among these, it is preferable to measure the impedance by the impedance analyzer from an electric resistance region of the developing member.

Impedance measurement conditions will be described.

The impedance is measured in a frequency range of $1.0\times10^{-2}$ Hz to $1.0\times10^7$ Hz using the impedance measuring apparatus. The measurement is performed under an environment of a temperature of 23° C. and a relative humidity of 50%. In order to decrease a measurement variation, five or more measurement points are provided for each digit of frequency, and an oscillation voltage is 1 Vpp.

Regarding a measurement voltage, the measurement may be performed while applying a direct current voltage in consideration of a shared voltage applied to the developing member in an electrophotographic apparatus. Specifically, it is suitable to perform the measurement while superimposing a direct currentvoltage of 10V or less on the oscillation voltage and applying the resultant voltage in order to quantify characteristics of transport and accumulation of electric charges.

Next, a method of calculating the inclination of the impedance will be described.

With respect to a measurement result measured under the above conditions, the absolute value of the impedance is plotted in a log-log graph with respect to a measurement frequency using spreadsheet software such as Windows Excel (trademark). It is sufficient to calculate an inclination of the absolute value of the impedance in a frequency region of $1.0\times10^6$ Hz to $1.0\times10^7$ Hz in a graph obtained from the log-log plot, using measurement points in the frequency region of $1.0\times10^6$ Hz to $1.0\times10^7$ Hz. Specifically, for a plot of the graph in the frequency range, it is sufficient to calculate an approximate straight line of a linear function by the least square method and calculate an inclination of the approximate straight line.

Next, it is sufficient to calculate an arithmetic mean value at measurement points in a frequency region of $1.0\times10^{-2}$ Hz to $1.0\times10^0$ Hz in the logarithmic graph and use an obtained value as an impedance of the low frequency side.

In the measurement of the inclination of the impedance, it is sufficient to perform the measurement at five spots at any places in each region when the longitudinal direction of the developing member is divided into five equal regions and calculate an arithmetic mean of measured values of the inclination at the five spots.

(1) Developing Member

An electrophotographic developing member according to the present aspect has an electro-conductive support and at least one conductive layer provided on the electro-conductive support.

As an example, a roller-shaped developing member (developing roller) is illustrated in FIG. 1. The developing roller 1A illustrated in FIG. 1 has an electro-conductive support 2 and an electro-conductive layer 3 provided on an outer peripheral surface (outer surface) of the electro-conductive support. In the developing roller 1A, in order to more effectively accomplish an effect according to an embodiment of the present disclosure, it is preferable that the electro-conductive layer 3 is directly provided on the support 2 as the only layer of the developing roller 1A, as illustrated in FIG. 1.

Figure 5:
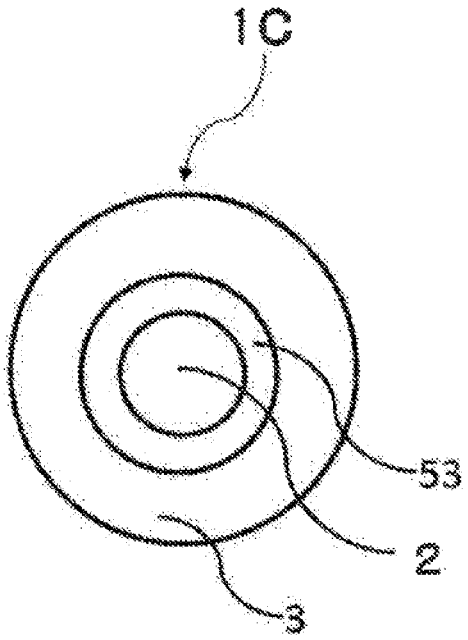
FIG. 5 is a cross-sectional view perpendicular to a longitudinal direction of a developing roller.

It should be noted that a layer structure of the developing roller 1A is not limited to a form illustrated in FIG. 1. Another form of the developing roller 1A includes a developing roller 1C having an intermediate layer 53 between a support 2 and an electro-conductive layer 3 provided on an outer peripheral surface of the support 2, as illustrated in FIG. 5.

In addition, another aspect of the electrophotographic developing member includes a developing member having a blade shape (hereinafter, also referred to as a "developing blade").

Figure 2:
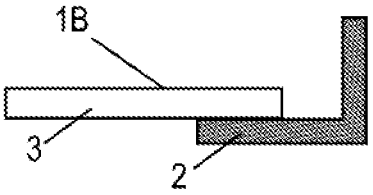
FIG. 2 is a schematic cross-sectional view of an electrophotographic developing blade according to an embodiment of the present disclosure.

FIG. 2 is a schematic sectional view of a developing blade 1B. The developing blade 1B illustrated in FIG. 2 includes an electro-conductive support 2 and an electro-conductive layer 3 provided in a partial region including an end portion of an outer surface of the support 2.

The developing blade 1B can have a configuration in which the electro-conductive layer 3 is coated on a front end portion of an electro-conductive stainless steel sheet, which is a part of the electro-conductive support, and a rear end portion of the stainless steel sheet is welded to the electro-conductive support 2.

The developing member can be used as a developing roller, a developing sleeve, a developing blade, and a toner supply roller.

Hereinafter, a configuration of the developing member according to an embodiment of the present disclosure will be described in detail.

<Electro-Conductive Support>

The electro-conductive support 2 functions as a support member of the developing member and, in some cases, an electrode. Regarding a specific example of the support, in a case where the developing member has a roller shape, the support 2 has a solid cylindrical shape or a hollow cylindrical shape, and in a case where the developing member has a blade shape, the support 2 has a thin plate shape.

A material constituting the electro-conductive support can be appropriately selected and used from materials known in the field of electrophotographic conductive members or materials that can be used as such a developing member. As an example, a metal typified by aluminum or stainless steel, a carbon steel alloy, a synthetic resin having conductivity, or a metal or an alloy such as iron or a copper alloy can be used.

Further, oxidation treatment or plating treatment with chromium, nickel or the like, may be performed on these materials. Either electroplating or electroless plating can be used as a type of plating. From the viewpoint of dimensional stability, the electroless plating is preferable. Examples of the electroless plating used here include nickel plating, copper plating, gold plating, and various alloy plating. A plating thickness is preferably 0.05 μm or more, and is preferably 0.1 μm to 30 μm in consideration of the balance between work efficiency and rust prevention ability.

When there is an intermediate resistance layer or an insulating layer between the support and the electro-conductive layer, it is impossible to quickly supply electric charges after electric charges are consumed by electrification. Therefore, it is preferable to provide the electro-conductive layer directly on the support or provide the electro-conductive layer on an outer periphery of the support with only an intermediate layer including a thin film and an electro-conductive resin layer, such as a primer, interposed therebetween.

As the primer, a known material can be selected and used according to a rubber material for forming the electro-conductive layer, a material of the support, and the like. Examples of the material for the primer include a thermosetting resin or a thermoplastic resin, and specifically, materials such as a phenolic resin, a urethane resin, an acrylic resin, a polyester resin, a polyether resin, and an epoxy resin can be used as the material of the primer.

Impedances of the resin layer and the support are preferably in the range of $1.0\times10^{-5}\Omega$ to $1.0\times10^{1}\Omega$ at a frequency of $1.0\times10^{-2}$ Hz to $1.0\times10^{0}$ Hz. When the impedances of the support and the resin layer at a low frequency are in the above range, sufficient electric charges can be supplied to the electro-conductive layer, and a function of suppressing discharge omission according to the first requirement and the second requirement, of a matrix-domain structure included in the electro-conductive layer, is not hindered, which is preferable.

The impedance of the resin layer can be measured by a method similar to the measurement of the inclination of the impedance described above, except that the measurement is performed in a state where the electro-conductive layer existing on the outermost surface is peeled off. In addition, the impedance of the support can be measured by a method similar to the measurement of the impedance described above in a state before the resin layer or the electro-conductive layer is coated or in a state where the electro-conductive layer or a coating layer including the resin layer and the electro-conductive layer is peeled off after forming the developing roller.

<Electro-Conductive Layer>

As the developing member that satisfies the <First requirement> and the <Second requirement>, for example, a developing member in which an electro-conductive layer satisfies at least one of the following configurations (i) to (iii) is preferable.

(i) A volume resistivity of the matrix is more than $1.0\times10^{12}$ Ω·cm and $1.0\times10^{17}$ Ω·cm or less.

(ii) A volume resistivity of the domain is $1.0\times10^{1}$ Ω·cm or more and $1.0\times10^{4}$ Ω·cm or less.

(iii) A distance between adjacent wall surfaces of the domains is within the range of 0.2 μm or more and 2.0 μm or less.

Hereinafter, elements of the above (i) to (iii) will be described.

Figure 6:
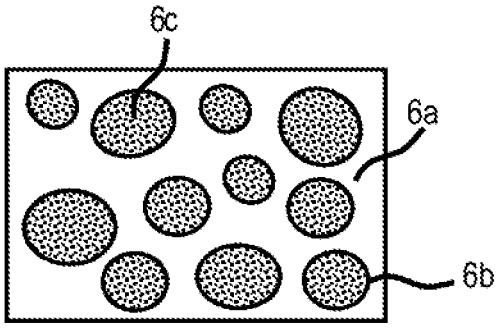
FIG. 6 is a schematic view of a sea-island structure in an electro-conductive layer.

FIG. 6 illustrates a partial cross-sectional view of an electro-conductive layer in a direction perpendicular to a longitudinal direction of an electro-conductive roller. The electro-conductive layer 3 has a matrix-domain structure having a matrix 6*a* and domains 6*b*. Then, the domain 6*b* contains an electronic conductive agent 6*c* as the electronic conductive agent.

As described above, in the electro-conductive layer when a bias is applied between the electro-conductive support and the other member to the developing member including the electro-conductive layer in which the domains containing the electronic conductive agent are dispersed in the matrix, it is considered that the electric charges are transferred from an electro-conductive support side of the electro-conductive layer to an opposite side, that is, to an outer surface side of the developing member as follows. That is, the electric charges are accumulated in the vicinity of interfaces with the matrix in the domains. Then, the electric charges are sequentially delivered from a domain located on the electro-conductive support side to a domain located on the opposite side to the electro-conductive support side, and reach a surface of the opposite side to the electro-conductive support side of the electro-conductive layer (hereinafter, also referred to as an "outer surface of the electro-conductive layer"). At this time, when the electric charges of all the domains are transferred to the outer surface side of the electro-conductive layer in one-time electric charge supply step, it takes time to accumulate the electric charges in the electro-conductive layer toward the next charge supply step. That is, it becomes difficult to support a high-speed electrophotographic image forming process. Therefore, it is preferable that the delivery of the electric charges between the domains does not occur simultaneously even though the bias is applied. In addition, even in a high frequency region where the transfer of the electric charges is restricted, it is effective to accumulate a sufficient amount of electric charges in the domains in order to supply a sufficient amount of electric charges by one-time electric charge supply.

As described above, in order to suppress the simultaneous occurrence of the delivery of the electric charges between the domains when the bias is applied and accumulate sufficient charges in the domains, it is preferable to satisfy at least one of the following configurations: the volume resistivity of the matrix is more than $1.0\times10^{12}$ Ω·cm and $1.0\times10^{17}$ Ω·cm or less (configuration (i)), the volume resistivity of the domain is $1.0\times10^{1}$ Ω·cm or more and $1.0\times10^{4}$ Ω·cm or less (configuration (ii)), and the distance between the adjacent wall surfaces of the domains is within the range of 0.2 μm or more and 2.0 μm or less (configuration (iii)).

<Configuration (i)>

Volume Resistivity of Matrix;

By making the volume resistivity of the matrix more than $1.0\times10^{12}$ Ω·cm and $1.0\times10^{17}$ Ω·cm or less, it is possible to suppress the electric charges from circumventing the domains and being transferred in the matrix. In addition, it is possible to prevent a state as if an electro-conductive path communicating in the electro-conductive layer is formed due to leakage of the electric charges accumulated in the domains to the matrix.

Regarding the <First requirement>, in order to transfer the electric charges in the electro-conductive layer through the domains even under application of a high-frequency bias, the inventors have considered that a configuration in which regions (domains) in which the electric charges are sufficiently accumulated are separated by an electrically insulating region (matrix) is effective. Then, by making the volume resistivity of the matrix be within the range of the high resistance region as described above, it is possible to retain sufficient electric charges at the interface with each domain, and it is possible to suppress the leakage of the electric charges from the domains.

In addition, it has been found that it is effective that a transfer path of the electric charges is limited to a path through the domains in order to obtain the electro-conductive layer satisfying the <Second requirement>. By suppressing the leakage of the electric charges from the domains to the matrix and limiting a transport path of the electric charges to a path through a plurality of domains, a density of the electric charges existing in the domains can be improved, and an amount of electric charges filled in each domain can thus be further increased. Therefore, it is possible to improve the total number of electric charges that can participate in the electrification on a surface of the domain as an electro-conductive phase, which is a starting point of the electrification. As a result, it is considered that it is possible to improve the ease of the emission of the electric charges from the surface of the developing member.

<Method of Measuring Volume Resistivity of Matrix>

The volume resistivity of the matrix can be measured by a fine probe after manufacturing a thin piece of the developing member. Examples of a unit manufacturing the thin piece include a sharp razor, a microtome, a focused ion beam (FIB) or the like.

Regarding the manufacture of a thin piece, it is necessary to eliminate an influence of the domains and measure the volume resistivity of only the matrix, and it is thus necessary to produce a thin piece having a film thickness smaller than an inter-domain distance measured in advance by a scanning electron microscope (SEM), a transmission electron microscope (TEM) or the like. Therefore, as a unit manufacturing the thin piece, a unit capable of producing a very thin sample such as a microtome is preferable.

In the measurement of the volume resistivity, one side of the thin piece is first grounded, and places of a matrix and domains in the thin piece are then specified. A unit capable of measuring the volume resistivities or hardness distributions of the matrix and the domains, such as a scanning probe microscope (SPM), an atomic force microscope (AFM) or the like can be used for specifying the places. Then, it is sufficient to bring a probe into contact with the matrix, and measure a ground current when a DC voltage of 10V is applied to calculate electric resistance. At this time, a unit also capable of measuring a shape of the thin piece, such as the SPM or the AFM, is suitable because it can measure the film thickness of the thin piece and can measure the volume resistivity.

The measurement of the volume resistivity of the matrix in the cylindrical developing member can be performed by dividing the electro-conductive layer into four regions in the circumferential direction, dividing the electro-conductive layer into five regions in the longitudinal direction, cutting out one thin piece sample from each of these regions, obtaining the above measured values, and then calculating an arithmetic mean value of the volume resistivities of a total of 20 samples.

<Configuration (ii)>

Volume Resistivity of Domain;

The volume resistivity of the domain is preferably $1.0\times10^{1}$ Ω·cm or more and $1.0\times10^{4}$ Ω·cm or less. By making the volume resistivity of the domain lower, it is possible to more effectively limit a transport path of the electric charges to a path through the plurality of domains while suppressing unintended transfer of the electric charges in the matrix.

Further, the volume resistivity of the domain is more preferably $1.0\times10^{2}$ Ω·cm or less. By decreasing the volume resistivity of the domain to the above range, an amount of electric charges transferred in the domain can be dramatically improved. Therefore, an impedance of the electro-conductive layer at a frequency of $1.0\times10^{-3}$ Hz to $1.0\times10^{0}$ Hz can be controlled to a lower range of $1.0\times10^{5}$Ω or less, and the transport path of the electric charges can be more effectively limited to the path through the domains.

The volume resistivity of the domain is adjusted by making conductivity of a rubber component of the domain a predetermined value by using an electro-conductive agent.

A rubber composition containing a rubber component for the matrix can be used as a rubber material for the domain, but a difference in a solubility parameter (SP value) from the rubber material forming the matrix is preferably 0.4 $(J/cm)^{0.5}$ or more and 5.0 $(J/cm^{3})^{0.5}$ or less, and particularly more preferably 0.4 $(J/cm^{3})^{0.5}$ or more and 2.2 $(J/cm)^{0.5}$ or less, in order to form the matrix-domain structure.

The volume resistivity of the domain can be adjusted by appropriately selecting a type and an addition amount of electronic conductive agent. The electro-conductive agent used to control the volume resistivity of the domain to $1.0\times10^{1}$ Ω·cm or more and $1.0\times10^{4}$ Ω·cm or less is preferably an electronic conductive agent that can greatly change the volume resistivity from a high resistance to a low resistance depending on an amount of dispersion.

Examples of the electronic conductive agent mixed in the domain include carbon black, graphite, and oxides such as titanium oxide and tin oxide; metals such as Cu and Ag; and particles having surface coated with an oxide or metal to be electrically conductive. In addition, if necessary, two or more kinds of these electro-conductive agents may be mixed and used in an appropriate amount.

It is preferable to use electro-conductive carbon black, which has a high affinity with rubber and can easily control a distance between the electronic conductive agents, among the electronic conductive agents described above. A type of carbon black mixed in the domain is not particularly limited. Specific examples of the carbon black compounded in the domain include gas furnace black, oil furnace black, thermal black, lamp black, acetylene black, ketjen black, and the like.

Among these, electro-conductive carbon black having a DBP oil absorption amount of 40 $cm^{3}$/100 g or more and 170 $cm^{3}$/100 g or less, which can impart high conductivity to the domain, can be suitably used.

The electronic conductive agent such as the electro-conductive carbon black is preferably mixed in the domain in an amount of 20 parts by mass or more and 150 parts by mass or less with respect to 100 parts by mass of the rubber component contained in the domain. A particularly preferable mixing ratio is 50 parts by mass or more and 100 parts by mass or less. In the mixing of the electro-conductive agent in these ratios, it is preferable that a large amount of the electro-conductive agent is mixed as compared with a general electrophotographic conductive member. Therefore, the volume resistivity of the domain can be easily controlled within the range of $1.0\times10^{1}$ Ω·cm or more and $1.0\times10^{4}$ Ω·cm or less.

An ion conductive agent may be used as an electro-conductive agent used for the domain, in combination with the electronic conductive agent.

As the ion conductive agent, for example, a quaternary ammonium salt, an imidazolium salt, a pyridinium salt, or the like can be used. Examples of anions of the ionic conductive agent include a perchlorate anion, a fluoroalkylsulfonylimide anion, a fluorosulfonylimide anion, a trifluoromethanesulfonate anion, and a tetrafluoroborate anion. At least one of these can be used.

In addition, if necessary, a filler, a processing aid, a cross-linking aid, a cross-linking accelerator, an antioxidant, a cross-linking acceleration aid, a cross-linking retarder, a softener, a dispersant, a colorant, and the like, which are generally used as a rubber compounding agent, may be added to the rubber composition for the domain within a range that does not impair an effect according to the present disclosure.

Method of Measuring Volume Resistivity of Domain;

It is sufficient to perform measurement of the volume resistivity of the domain by a method similar to the method of measuring a volume resistivity of a matrix described above except that the measuring places are changed to places corresponding to the domain and an applied voltage at the time of measuring a current value is changed to 1 V.

Here, the volume resistivities of the domains are preferably uniform. In order to improve the uniformity of the volume resistivities of the domains, it is preferable to uniformize amounts of the electronic conductive agents in each domain. Therefore, it is possible to further stabilize discharge from the outer surface of the electro-conductive member to a charged body.

<Configuration (iii)>

Distance Between Adjacent Walls Between Domains (Hereinafter Also Referred to as "Inter-Domain Distance")

An arithmetic mean value Dm of inter-domain distances is preferably 0.2 or more and 2.0 μm or less.

In order for the electro-conductive layer in which the domains of the volume resistivity according to the configuration (ii) are dispersed in the matrix having the volume resistivity according to the configuration (i) to satisfy the <Second requirement>, the arithmetic mean value Dm of the inter-domain distances is preferably 2.0 μm or less, and particularly preferably 1.0 μm or less. Meanwhile, in order to accumulate sufficient electric charges in the domains by certainly separating the domains from each other in an insulating region, the arithmetic mean value Dm of the inter-domain distances is preferably 0.2 μm or more, and particularly preferably 0.3 μm or more.

Method of Measuring Inter-Domain Distance;

It is sufficient to perform a method of measuring the inter-domain distance as follows.

First, a section is manufactured by a method similar to the method of measuring the volume resistivity of the matrix described above. Then, a fracture surface is formed by a method such as a freeze fracture method, a cross polisher method, and a focused ion beam (FIB) method. Considering smoothness of the fracture surface and pretreatment for observation, the FIB method is preferable. In addition, in order to suitably perform observation of the matrix-domain structure, pretreatment that can suitably obtain a contrast between an electro-conductive phase and an insulating phase, such as dyeing treatment or vapor deposition treatment may be performed.

The existence of the matrix-domain structure is confirmed by observing the section on which the formation of the fracture surface and the pretreatment are performed, with a scanning electron microscope (SEM) or a transmission electron microscope (TEM). Among these, it is preferable to perform observation with the SEM at 1,000 to 100,000 magnifications in terms of accuracy of quantification of areas of the domains.

The measurement of the inter-domain distance is preferably performed by quantifying a captured image of the fracture surface where the matrix-domain structure appears. 8-bit gray scale conversion is performed on the fracture surface image obtained by the observation with the SEM using image processing software (for example, "Luzex" (product name, produced by Nireco Corporation)) to obtain a 256-gradation monochrome image. Next, a black and a white of the image are inverted so that the domain in the fracture surface becomes white, and binarization is performed. Next, a distance between wall surfaces of a domain size group in the image is calculated. The distance between the wall surfaces at this time is the shortest distance between close domains.

Figure 8A:
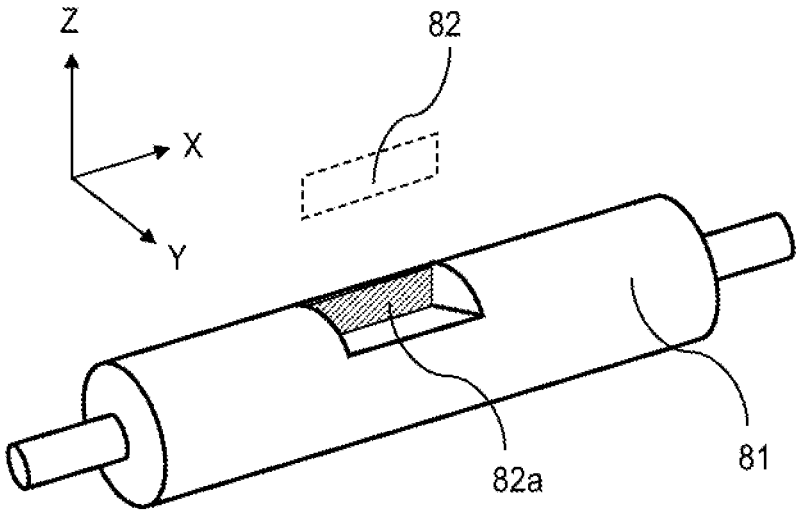
FIG. 8A is an explanatory diagram of a cutting direction of a cross section cutting out a developing member.
Figure 8B:
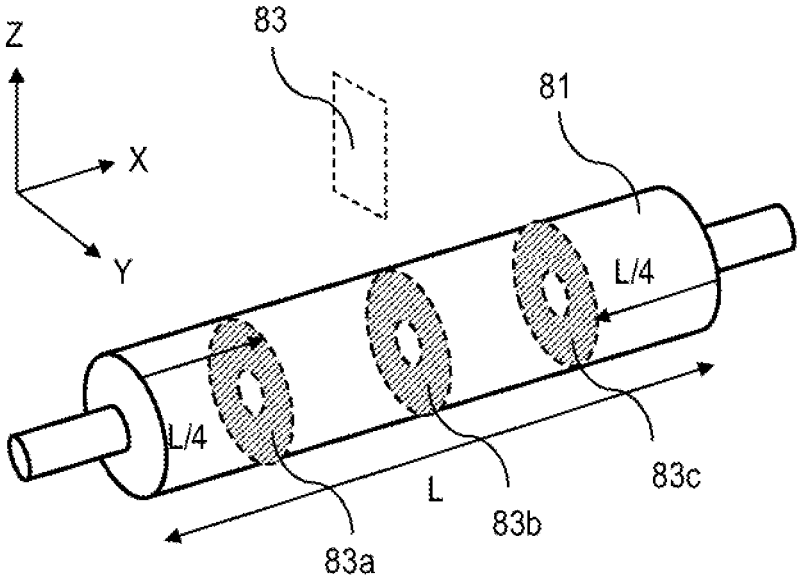
FIG. 8B is an explanatory diagram of a cutting direction of a cross section cutting out a developing member.

In the case of the cylindrical developing member, when a length of the electro-conductive layer in the longitudinal direction is L and a thickness of the electro-conductive layer is T, cross sections of the electro-conductive layer in a thickness direction as illustrated in FIG. 8B are acquired at three places of the center of the electro-conductive layer in the longitudinal direction and L/4 from both ends of the electro-conductive layer toward the center. For each of the acquired cross sections, it is sufficient to place observation regions of 50 μm square at any three places in a thickness region up to a depth of 0.1 T to 0.9 T from the outer surface of the electro-conductive layer toward the support and measure each inter-domain distance observed in each of all nine observation regions. Since it is necessary to observe a surface including the outer surface of the electro-conductive layer from the support, which is the transfer direction of the electric charges, the section is cut out in a direction in which a cross section including a normal line starting from a central axis of the support can be observed. It should be noted that the thickness T of the electro-conductive layer is preferably 100 μm or more.

Uniformity of Inter-Domain Distance;

Regarding the above configuration (iii), it is more preferable that a distribution of the inter-domain distances is uniform. Since the distribution of the inter-domain distances is uniform, some places having a long inter-domain distance locally appear in the electro-conductive layer. Therefore, when places where the supply of the electric charges is delayed as compared with the surroundings occur, it is possible to decrease a phenomenon that the ease of the emission of the electric charges is suppressed.

When acquiring the observation regions of 50 μm square at any three points in the thickness region up to the depth of 0.1 T to 0.9 T from the outer surface of the electro-conductive layer toward the support in a cross section in which the electric charges are transported, that is, a cross section of the electro-conductive layer in the thickness direction as illustrated in FIG. 8B, σm/Dm is preferably 0 or more and 0.4 or less using an arithmetic mean value Dm of the inter-domain distances in the observation regions and a variation σm of the inter-domain distances.

<Method of Controlling Inter-Domain Distance>

A method of controlling the inter-domain distance will be described below.

With respect to an inter-domain distance (1/τ) in a case where two incompatible polymers are melt-kneaded, a Tokita's theoretical equation (Equation (8)) based on a Taylor's equation (Equation (5)) and Wu's empirical equations (Equation (6) and Equation (7)) has been proposed.

Taylor's Equation $$D=[C\cdot\sigma/\eta m\cdot\gamma]\cdot f(\eta m/\eta d) \quad (5)$$

Wu's Empirical Equations $$\gamma\cdot D\cdot\eta m/\sigma=4(\Theta d/\eta m)0.84\cdot\eta d/\eta m>1 \quad (6)$$

$$\gamma\cdot D\cdot\eta m/\sigma=4(\eta d/\eta m)-0.84\cdot\eta d/\eta m<1 \quad (7)$$

Tokita's Equation $$D=12\cdot P\cdot\sigma\cdot\varphi/(\pi\cdot\eta\cdot\gamma)\cdot(1+4\cdot P\cdot\varphi\cdot EDK/(\pi\cdot\eta\cdot\gamma)) \quad (8)$$

In Equations (5) to (8), D indicates a maximum Feret's diameter of a domain of CMB, C indicates a constant, σ indicates an interfacial tension, ηm indicates the viscosity of the matrix, ηd indicates the viscosity of the domain, γ indicates a shear rate, η indicates a viscosity of a mixing system, P indicates a collision coalescence probability, φ indicates a domain phase volume, and EDK indicates a domain phase cutting energy.

As represented in the above Equations, the inter-domain distance can be controlled mainly by (A) Volume ratio of domain phase, (B) Viscosity ratio of domain and matrix (C) Shear rate, and (D) Magnitude of domain phase cutting energy Specifically, control can be performed by the following method to decrease the inter-domain distance.

Decrease an interfacial tension between a domain polymer and a matrix polymer.

Decrease a viscosity difference between the domain polymer and the matrix polymer.

Increase a shear rate at the time of kneading/increase energy at the time of shearing.

Increase a volume ratio of the domain phase.

Decrease a collision coalescence probability.

As described above, the control of the inter-domain distance proceeds simultaneously with the control of a domain size, but the control of the inter-domain distance is possible independently by the control of the volume ratio of the domain phase or the collision coalescence probability, that is, a kneading time and a shear rate.

In order to perform the transfer of the electric charges more efficiently in the electro-conductive path even in a high-speed process, it is more preferable to allow the developing member to have a configuration having an electro-conductive path that is extremely uniform and does not have unevenness by arranging the electro-conductive domains having a uniform electric resistance three-dimensionally evenly and densely in the electro-conductive layer.

Specifically, when an average value of ratios of cross-sectional areas of portions made of electro-conductive particles contained in each domain to cross-sectional areas of each domain appearing in the cross section of the electro-conductive layer in the thickness direction is μ and a standard deviation of the ratios is σ, σ/μ is preferably 0 or more and 0.4 or less, and μ is preferably 20% or more and 40% or less. In addition to these conditions of σ and μ, it is particularly preferable that at least eight of a total of nine sample cubes sampled from any nine places in the electro-conductive layer, having one side of 9 μm and having a cubic shape satisfy the following requirement (B1).

Requirement (B1):

"When one sample cube is divided into 27 unit cubes whose one side is 3 μm and a volume Vd of the domains included in each of the unit cubes is calculated, the number of unit cubes in which Vd is 2.7 $\mu m^3$ to 10.8 $\mu m^3$ is at least 20."

The inventors have estimated the following mechanism as a factor that enables more efficient transfer of electric charges in an electro-conductive path even under a high-speed process in an electrophotographic developing member having an electro-conductive path in which conductive domains having a uniform electric resistance are three-dimensionally uniformly and densely arranged in an electro-conductive layer and which is extremely uniform and does not have unevenness.

In a developing member in a manner of applying a bias, it is desirable that toners having different charge densities are developed and destaticized in a blade nip to be developed at a uniform charge density. For that reason, it is necessary to keep a surface potential of the developing blade uniform in a toner size. Therefore, it is preferable that the electro-conductive paths are formed uniformly and at a high density in the thickness direction and an in-plane direction from the electro-conductive support to the surface of the developing member.

When the relationship between μ and σ described above is "σ/μ is 0 or more and 0.4 or less", there is no variation in the number and an amount of portions (for example, electro-conductive particles) made of the electro-conductive agent contained in each domain. As a result, the domains having the uniform electric resistance are formed. In particular, in a case where the relationship between μ and σ described above is "σ/μ is 0 or more and 0.25 or less", it becomes a domain having a more uniform electric resistance, and thus, an effect in the present disclosure tends to be further enhanced, which is particularly preferable.

In order to make σ/μ a low value, it is preferable to increase the number and the amount of portions made of the electro-conductive particles contained in each domain, and it is preferable to make sizes of the domains uniform.

It should be noted that here, μ is preferably 20% or more and 40% or less. As described later, in a case where μ is less than 20%, an amount of the electro-conductive particles is necessarily small, and electric connection of the electro-conductive particles in the domain may become unstable in a percolation manner. On the other hand, when μ is more than 40%, an amount of the electro-conductive particles in the domain increases, such that it may be difficult to confine the electro-conductive particles in the domain. In addition, as described later, it has been found that when an amount of the electro-conductive particles filled in the domain is increased, an effect of the present disclosure is enhanced, and μ is more preferably 23% or more, and further preferably 28% or more.

In addition, since the domains are included in 10 vol % to 40 vol % in the unit cubes whose one side is 3 μm and the sample cubes uniformly exist in the entire electro-conductive layer, the electro-conductive domains are three-dimensionally uniformly and densely arranged in the electro-conductive layer. It should be noted that as described later, even in a case where the total volume of the domains is increased, a proportion of the domains uniformly existing in the entire electro-conductive layer tends to increase. In addition, even though the total volume of the domains is the same, the proportion of the domains uniformly existing in the entire electro-conductive layer tends to dramatically increase by decreasing a domain size and increasing the number of the domains.

That is, when the number of unit cubes satisfying the above Requirement (B1) and having one side of 3 μm increases, the effect of the present disclosure is inevitably enhanced. Therefore, the number of unit cubes in which Vd is 2.7 $\mu m^3$ to 10.8 $\mu m^3$ among 27 unit cubes is preferably 20 or more, more preferably 22 or more, and further preferably 25 or more.

It should be noted that, needless to say, the domains need to be three-dimensionally arranged in order for the electro-conductive path to be formed to be connected from the electro-conductive support to the surface of the electroconductive layer. In other words, the connection of the electro-conductive path from the electro-conductive support to the surface of the electro-conductive layer cannot be accurately constructed only by the control of a domain arrangement in a certain two-dimensional cross section. Note that here, a phrase "the electro-conductive path is connected" refers to a state where the electric charges can be efficiently transferred between the domains forming the electro-conductive path in accordance with a desired applied voltage (hopping conduction, tunnel conduction, band conductivity, or the like). The distance between the adjacent wall surfaces of the domains in three-dimensional evaluation is particularly preferably 2.0 μm or less even though it depends on an applied voltage to be used or a thickness of the electro-conductive layer and electrical resistances of the domains and the matrix.

The developing member according to the present aspect can be formed, for example, by a method including the following steps (i) to (iv).

Step (i): a step of preparing a rubber mixture for a domain (hereinafter, also referred to as "CMB") containing carbon black and a second rubber;

Step (ii): a step of preparing a rubber mixture for forming a matrix (hereinafter also referred to as "MRC") containing a first rubber;

Step (iii): a step of preparing a rubber mixture having a matrix-domain structure by kneading the CMB and the MRC.

Step (iv): a step of forming a layer of the rubber mixture prepared in step (iii) on an electro-conductive support directly or with another layer interposed therebetween and curing the layer of the rubber composition to form an electro-conductive layer according to the present aspect.

Then, the configurations (i) to (iii) can be controlled by, for example, selection of a material used in each of the steps and adjustment of manufacturing conditions. This will be described below.

First, regarding the configuration (i), a volume resistivity of a matrix is determined by a composition of the MRC.

As the first rubber used for the MRC, at least one kind of rubber such as natural rubber, butadiene rubber, butyl rubber, acrylonitrile butadiene rubber, urethane rubber, silicone rubber, fluorine rubber, isoprene rubber, chloroprene rubber, styrene-butadiene rubber, ethylene-propylene rubber, or polynorbornene rubber that has low conductivity can be used. In addition, if necessary, a filler, a processing aid, a cross-linking agent, a cross-linking aid, a cross-linking accelerator, a cross-linking acceleration aid, a cross-linking retarder, an antioxidant, a softener, a dispersant, and a colorant may be added to the MRC on the assumption that that the volume resistivity of the matrix can be within the above range. Meanwhile, it is preferable that the MRC does not contain an electronic conductive agent such as carbon black in order to make the volume resistivity of the matrix be within the above range.

In addition, the configuration (ii) can be adjusted by an amount of electronic conductive agent in the CMB. For example, when taking as an example a case of using electro-conductive carbon black having a DBP oil absorption amount of 40 $cm^3$/100 g or more and 170 $cm^3$/100 g or less as the electronic conductive agent, the configuration (ii) can be achieved by preparing the CMB so as to contain 40 mass % or more and 200 mass % or less of electro-conductive carbon black based on the total mass of the CMB.

Further, regarding the configuration (iii), it is effective to control four of the following (a) to (d).

(a) Difference in interfacial tension σ between CMB and MRC;

(b) Ratio (ηm/ηd) between viscosity (ηd) of CMB and viscosity (ηm) of MRC;

c) Shear rate (γ) at the time of kneading CMB and MRC and energy amount (EDK) at the time of shearing, in step (iii); and (d) Volume fraction of CMB to MRC in step (iii).

(a) Difference in interfacial tension between CMB and MRC

Generally, in a case where two types of incompatible rubbers are mixed with each other, the two types of incompatible rubbers are phase-separated. This is because an interaction between the same polymers is stronger than an interaction between heterogeneous polymers, such that the same polymers agglomerate with each other to decrease free energy and be stabilized. Since an interface of a phase-separated structure brings into contact with the heterogeneous polymer, free energy of the interface becomes higher than that of the inside stabilized by an interaction between the same molecules. As a result, in order to decrease the free energy of the interface, an interfacial tension that is to decrease an area in contact with the heterogeneous polymer is generated. In a case where the interfacial tension is small, the CMB and the MRC are directed toward a direction in which they are more uniformly mixed with each other even in the heterogeneous polymer in order to increase entropy. A state where the rubbers are uniformly mixed with each other is dissolution, and an SP value (solubility parameter), which is a measure of solubility, and the interfacial tension tend to correlate with each other.

That is, it is considered that the difference in the interfacial tension between the CMB and the MRC correlates with a difference in the SP value between the rubbers contained in each of the CMB and the MRC. It is preferable to select rubbers between which a difference in an absolute value of a solubility parameter is 0.4 $(J/cm^3)^{0.5}$ or more and 5.0 $(J/cm^3)^{0.5}$ or less, and particularly 0.4 $(J/cm^3)^{0.5}$ or more and 2.2 $(J/cm^3)^{0.5}$ or less as the first rubber in the MRC and the second rubber in the CMB. When the difference in the absolute value of the solubility parameter is within this range, a stable phase-separated structure can be formed, and a domain diameter D of the CMB can be decreased.

Here, specific examples of the second rubber that can be used for the CMB include natural rubber (NR), isoprene rubber (IR), butadiene rubber (BR), styrene-butadiene rubber (SBR), butyl rubber (IIR), ethylene-propylene rubber (EPM or EPDM), chloroprene rubber (CR), nitrile rubber (NBR), hydrogenated nitrile rubber (H-NBR), silicone rubber, and urethane rubber (U). At least one of these can be used.

A thickness of the electro-conductive layer is not particularly limited as long as an intended function and effect of the electro-conductive member can be obtained. The thickness of the electro-conductive layer is preferably at least 100 μm (0.1 mm) or more, particularly preferably 0.3 mm or more, and further preferably 1.0 mm or more. In addition, the thickness of the electro-conductive layer is preferably 4.5 mm or less.

<Method of Measuring SP Value>

The SP value can be accurately calculated by producing a calibration curve using a material whose SP value is known. A material manufacturer's catalog value can also be used as this known SP value. For example, SP values of the NBR and the SBR are almost determined by a content ratio of acrylonitrile and styrene without depending on molecular weights. Therefore, by analyzing content ratios of acrylonitrile or styrene of the rubbers constituting the matrix and the domains using an analysis method such as pyrolysis gas chromatography (Py-GC) and solid-state nuclear magnetic resonance (NMR), the SP values can be calculated from a calibration curve obtained from a material whose SP value is known. In addition, an SP value of isoprene rubber is determined by an isomer structure such as 1,2-polyisoprene, 1,3-polyisoprene, 3,4-polyisoprene, and cis-1,4-polyisoprene and trans-1,4-polyisoprene. Therefore, similarly to the SBR and the NBR, an isomer content ratio can be analyzed by the Py-GC, the solid-state NMR and the like, and the SP value can be calculated from a material whose SP value is known.

(b) Viscosity Ratio Between CMB and MRC

The closer the viscosity ratio (ηd/ηm) between the CMB and the MRC is to 1, the smaller the maximum Feret's diameter of the domain can be. Specifically, the viscosity ratio is preferably 1.0 or more and 2.0 or less. The viscosity ratio between the CMB and the MRC can be adjusted by selecting Mooney viscosities of raw material rubbers used for the CMB and the MRC or mixing a type or an amount of filler. In addition, it is also possible to add a plasticizer such as paraffin oil to the extent that the formation of the phase-separated structure is not hindered. In addition, the viscosity ratio can be adjusted by adjusting a temperature at the time of kneading. It should be noted that the viscosity of the rubber mixture for forming the domain or the rubber mixture for forming the matrix is obtained by measuring a Mooney viscosity ML(1+4) at a rubber temperature at the time of kneading based on JIS K6300-1:2013.

(c) Shear Rate at the Time of Kneading MRC and CMB and Energy Amount at the Time of Shearing The higher the shear rate at the time of kneading the MRC and the CMB and the larger the energy amount at the time of shearing, the smaller the inter-domain distance can be.

The shear rate can be increased by increasing an inner diameter of a stirring member such as a blade or a screw of a kneading machine, decreasing a gap from an end surface of the stirring member up to an inner wall of the kneading machine, or increasing a rotation speed. In addition, an increase in the energy at the time of shearing can be achieved by increasing the rotation speed of the stirring member or increasing the viscosities of the first rubber in the CMB and the second rubber in the MRC.

(d) Volume Fraction of CMB to MRC

A volume fraction of the CMB to the MRC correlates with the collision coalescence probability of the rubber mixture for forming the domain to the rubber mixture for forming the matrix. Specifically, when the volume fraction of the rubber mixture for forming the domain to the rubber mixture for forming the matrix is decreased, the collision coalescence probability of the rubber mixture for forming the domain and the rubber mixture for forming the matrix is decreased. In other words, the inter-domain distance can be decreased by decreasing the volume fraction of the domains in the matrix within a range where required conductivity can be obtained. Then, the volume fraction of the CMB to the MRC is preferably 15% or more and 40% or less.

<Shape of Domain>

A shape of the domain is preferably close to a circle. A ratio of an area of the domain to an area of a circle corresponding to a maximum Feret's diameter of the domain is preferably 0.6 or more and 1 or less. This ratio has a maximum value of 1, and a state where this ratio is 1 indicates that the domain is a perfect circle. When these ratios are smaller than 0.6, the shape of the domain has anisotropy, that is, anisotropy of an electric field is exhibited. Therefore, electric field concentration points are formed and concentration of transport of electric charges occurs, and discharge whose persistency is large is thus likely to occur. As these ratios become closer to 1, the electric field concentration is suppressed, and a fog image is thus unlikely to occur.

It should be noted that the maximum Feret's diameter is a value when an outer circumference of the observed domain is sandwiched by two parallel lines and a length at the time of connecting the two parallel lines to each other with a perpendicular line becomes the largest. In addition, the circle corresponding to the maximum Feret's diameter is a circle whose diameter is the maximum Feret's diameter.

<Method of Measuring Domain Area S1 and Area S2 of Circle Corresponding to Maximum Feret's Diameter>

The shape of the domain can be quantified using an image obtained by producing and observing a fracture surface by a method similar to the method of measuring a size of the domain and the inter-domain distance described above. Specifically, binarization in the fracture surface is performed using a method similar to as the method of measuring a size of the domain described above, and a domain area and a maximum Feret's diameter are thus calculated for each of the domains in the image using image processing software. Next, it is sufficient to calculate a ratio between an actual domain area S1 and an area S2 of the circle obtained from the maximum Feret's diameter and corresponding to the maximum Feret's diameter.

In the measurement of S1 and S2, it is sufficient to cut out one thin piece sample from each of regions into which the developing member is evenly divided, and preferably evenly divided into 20 partitions, obtain the measured values described above, and then use arithmetic mean values of S1 and S2 of a total of 20 samples as measured values of S1 and S2.

In the case of the cylindrical developing member, it is sufficient to cut out one thin piece sample from each of four regions divided in a circumferential direction of a cylindrical shape and five regions divided in a longitudinal direction, obtain the measured values described above, and then use arithmetic mean values of S1 and S2 of a total of 20 samples as measured values of S1 and S2.

In addition, in order to suppress the resistance variation and the electric field concentration due to the aggregation of the electro-conductive agent and more efficiently accomplish an effect of the present disclosure, when the length of the electro-conductive layer in the longitudinal direction is L and when observation regions of 15 μm square are placed at any three places in a thickness region up to a depth of 0.1 T to 0.9 T from an outer surface of an elastic layer for each of the cross sections of the electro-conductive layer in the thickness direction at three places of the center of the electro-conductive layer in the longitudinal direction and L/4 from both ends of the electro-conductive layer toward the center, it is preferable that 80% or more of the number of domains observed in each of a total of nine observation regions satisfy the following requirement (B2) and requirement (B3).

Requirement (B2)

A ratio of cross-sectional areas of the electro-conductive particles contained in the domain to a cross-sectional area of the domain is 20% or more.

Requirement (B3)

When a perimeter of the domain is A and an envelope perimeter of the domain is B, A/B is 1.00 or more and 1.10 or less.

The above requirement (B2) and requirement (B3) can be said to be stipulations regarding the shape of the domain.

The "shape of the domain" is defined as a cross-sectional shape of the domain appearing in the cross section of the electro-conductive layer in the thickness direction. In a case of a cylindrically-shaped charging member, when a length of the electro-conductive layer in the longitudinal direction is L and a thickness of the electro-conductive layer is T, cross sections of the electro-conductive layer in a thickness direction as illustrated in FIG. 8B are acquired at three places of the center of the electro-conductive layer in the longitudinal direction and L/4 from both ends of the electro-conductive layer toward the center. For each of the acquired cross sections, observation regions of 15 μm square are placed at any three places in the thickness region up to the depth of 0.1 T to 0.9 T from the outer surface of the electro-conductive layer toward the support. The shape of the domain is defined by a shape of each domain observed in each of a total of nine observation regions.

It is preferable that the shape of the domain is a shape in which a peripheral surface thereof has no ruggedness. By decreasing the number of rugged structures related to the shape, it is possible to decrease non-uniformity of an electric field between the domains, that is, to decrease places where the electric field concentration occurs to decrease a phenomenon in which transport of electric charges more than necessary occurs in the matrix. The inventors have found that an amount of electro-conductive particles contained in one domain affects an outer shape of the domain.

That is, the inventors have found that the outer shape of the domain becomes closer to a sphere as an amount of the electro-conductive particles filled in one domain increases. The more the number of domains close to the sphere, the less the concentration points of delivery of the electric charges between the domains can be. Then, according to investigations by the inventors, the reason is not clear, but a domain in which a ratio of the sum of cross-sectional areas of the electro-conductive particles observed in a cross section of one domain is 20% or more on the basis of an area of the cross section of one domain can have a shape closer to a sphere. As a result, an outer shape that can significantly alleviate the concentration of the delivery of the electric charges between the domains can be taken, which is preferable. Specifically, the ratio of the cross-sectional areas of the electro-conductive particles contained in the domain to the cross-sectional area of the domain is preferably 20% or more.

The inventors have found that it is preferable to satisfy the following Equation (9) regarding a shape in which the peripheral surface of the domain has no ruggedness.

$$1.00 \leq A/B \leq 1.10 \quad (9)$$

(A: Domain Perimeter, B: Domain Envelope Perimeter)

Figure 7:
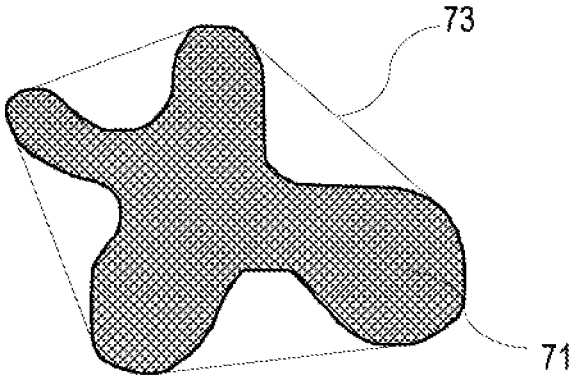
FIG. 7 is an explanatory diagram of a method of measuring an envelope perimeter of a domain.

Equation (9) represents a ratio of the perimeter A of the domain to the envelope perimeter B of the domain. Here, the envelope perimeter is a length of a convex envelope 73 of a domain 71 observed in an observation region, as illustrated in FIG. 7. It should be noted that the convex envelope is the smallest convex set including all points in the domain 71.

The ratio of the perimeter of the domain to the envelope perimeter of the domain has a minimum value of 1, and a state where the ratio is 1 indicates that the domain has a shape that does not have a concave portion in a cross-sectional shape, such as a perfect circle or an ellipse. When these ratios exceed 1.1, a large rugged shape exits in the domain, that is, anisotropy of an electric field is exhibited.

As stipulated in the requirement (B2), by filling the domain with the electro-conductive particles at a high density, it is possible to make the outer shape of the domain close to the sphere, and it is possible to make the ruggedness small as stipulated in the requirement (B3).

In order to obtain the domain filled with the electro-conductive particles at the high density as stipulated in the requirement (B2), carbon black having a DBP absorption amount of 40 $cm^3$/100 g or more and 80 $cm^3$/100 g or less can be particularly suitably used as the electro-conductive particles. The DBP absorption amount ($cm^3$/100 g) is a volume of dibutyl phthalate (DBP) capable of adsorbing 100 g of carbon black, and is measured according to Japanese Industrial Standard (JIS) K6217-4:2017 (Carbon black for rubber-Basic characteristics-Part 4: Method of determining oil absorption amount (including compressed sample)). Generally, the carbon black has a tufted higher-order structure in which primary particles having an average particle size of 10 μm or more and 50 μm or less are aggregated. This tufted higher-order structure is called a structure, and a degree of the tufted higher-order structure is quantified by the DBP absorption amount ($cm^3$/100 g).

Generally, carbon black having a developed structure has a high reinforcing performance to rubber, incorporation of the carbon black into the rubber becomes poor, and a shear torque at the time of kneading is very high. For that reason, it is difficult to increase an amount of carbon black filled in the domain.

Meanwhile, since electro-conductive carbon black having a DBP absorption amount that is within the above range has a structure that is not developed, aggregation of the carbon black is small and dispersibility of the carbon black in the rubber is good. For that reason, an amount of carbon black filled in the domain can be increased, and as a result, it is easy to obtain the outer shape of the domain closer to the sphere.

Further, in the carbon black having the developed structure, the carbon blacks are easily aggregated with each other, and an aggregate is likely to be a lump having a large rugged structure. When such an aggregate is included in the domain, it is difficult to obtain the domain according to the requirement (B3). There is a case of forming a rugged structure while affecting the shape. Meanwhile, the electro-conductive carbon black having the DBP absorption amount that is within the range described above is difficult to form an aggregate, and is thus effective in producing the domain according to the requirement (B3).

<Method of Measuring Each Parameter Related to Shape of Domain>

First, a section is manufactured by a method similar to the method of measuring the volume resistivity of the matrix described above. However, as described below, it is necessary to produce a section by a cross section perpendicular to the longitudinal direction of the electro-conductive member and evaluate the shape of the domain in a fracture surface of the section. The reason will be described below.

FIGS. 8A and 8B are views illustrating a shape of a developing member 81 as three dimensions of three axes, specifically, X, Y, and Z axes. In FIGS. 8A and 8B, the X axis indicates a direction parallel to a longitudinal direction (axial direction) of the developing member, and the Y axis and the Z axis indicate directions perpendicular to the axial direction of the developing member.

FIG. 8A illustrates an image view obtained by cutting out the developing member in a cross section 82*a* parallel to an XZ plane 82 with respect to the developing member. The XZ plane can rotate by 360° around an axis of the developing member. Considering that the developing member rotates in a state where it is in contact with the toner on a surface thereof and supplies electric charges to the toner, the cross section 82*a* parallel to the XZ plane 82 indicates a surface where the supply of the electric charges simultaneously occurs at a certain timing. The electric charges are supplied to the toner by passing through a surface corresponding to a certain amount of cross section 82*a*.

Therefore, in order to evaluate the shape of the domain correlating with the electric field concentration in the developing member, evaluation needs to be performed in a cross section parallel to a YZ plane 83 perpendicular to the axial direction of the developing member in which the shape of the domain including a certain amount of cross section 82*a* can be evaluated rather than an analysis of a cross section where the supply of the electric charges simultaneously occurs at a certain moment, such as the cross section 82*a*. In this evaluation, when a length of the electro-conductive layer in the longitudinal direction is L, a total of three places such as a cross section 83*b* at the center of the electro-conductive layer in the longitudinal direction and two cross sections 83*a* and 83*c* of L/4 from both ends of the electro-conductive layer toward the center are selected.

In addition, regarding observation positions of the cross sections 83*a* to 83*c*, it is sufficient to perform measurement in a total of nine observation regions when observation regions of 15 μm square are placed at any three places in a thickness region up to a depth of 0.1 T or more and 0.9 T or less from an outer surface of each section when a thickness of the electro-conductive layer is T.

In formation of a fracture surface, the fracture surface can be formed by a method such as a freeze fracture method, a cross polisher method, and a focused ion beam (FIB) method. Considering smoothness of the fracture surface and pretreatment for observation, the FIB method is preferable. In addition, in order to suitably perform observation of the matrix-domain structure, pretreatment that can suitably obtain a contrast between an electro-conductive phase and an insulating phase, such as dyeing treatment or vapor deposition treatment may be performed.

A matrix-domain structure can be observed for the section on which the formation of the fracture surface and the pretreatment are performed, with a scanning electron microscope (SEM) or a transmission electron microscope (TEM). Among these, it is preferable to perform observation with the SEM at 1,000 to 100,000 magnifications in terms of accuracy of quantification of areas of the domains.

The measurement of a perimeter and an envelope perimeter of the domain and the number of domains can be performed by quantifying the captured image as described above. With respect to a fracture surface image obtained by the observation with the SEM, analysis regions of 15 μm square are extracted from each of nine images obtained at each observation position and 8-bit gray scale conversion is performed, using image processing such as ImageProPlus (produced by Media Cybernetics, Inc.), to obtain a 256-gradation monochrome image. Next, a black and a white of the image are inverted so that the domain in the fracture surface becomes white, and binarization is performed, such that a binarized image for analysis can be obtained.

<<Method of Measuring Cross-Sectional Area Ratio μ of Electronic Conductive Agent in Domain>>

The measurement of the cross-sectional area ratio of the electronic conductive agent in the domain can be performed by quantifying the binarized image described above. With respect to the binarized image, a cross-sectional area S of the domain and the sum Sc of cross-sectional areas of portions made of the electro-conductive agent in each domain are calculated by a count function of image processing software ImageProPlus (produced by Media Cybernetics, Inc.). Then, it is sufficient to calculate an arithmetic mean value μ(%) of Sc/S.

In the case of the cylindrical developing member, when a length of the electro-conductive layer in the longitudinal direction is L and a thickness of the electro-conductive layer is T, cross sections of the electro-conductive layer in a thickness direction as illustrated in FIG. 8B are acquired at three places of the center of the electro-conductive layer in the longitudinal direction and L/4 from both ends of the electro-conductive layer toward the center. For each of the acquired cross sections, it is sufficient to perform the above measurement in regions of 15 μm square at any three places in a thickness region up to a depth of 0.1 T to 0.9 T from the outer surface of the electro-conductive layer toward the support, and calculate an arithmetic mean of measured values from a total of nine regions.

<<Method of Measuring Perimeter A and Envelop Perimeter B of Domain>>

The measurement of a perimeter and an envelope perimeter of the domain and the number of domains can be performed by quantifying the binarized image described above. With respect to the binarized image, it is sufficient to calculate a perimeter A of each domain of a domain size group in the image and an envelope perimeter B of the domain using the count function of the image processing software ImageProPlus (produced by Media Cybernetics, Inc.), and calculate an arithmetic mean value of perimeter ratios AB of the domains.

In the case of the cylindrical developing member, when a length of the electro-conductive layer in the longitudinal direction is L and a thickness of the electro-conductive layer is T, cross sections of the electro-conductive layer in a thickness direction as illustrated in FIG. 8B are acquired at three places of the center of the electro-conductive layer in the longitudinal direction and L/4 from both ends of the electro-conductive layer toward the center. For each of the acquired cross sections, it is sufficient to perform the above measurement in regions of 15 μm square at any three places in a thickness region up to a depth of 0.1 T to 0.9 T from the outer surface of the electro-conductive layer toward the support, and calculate an arithmetic mean of measured values from a total of nine regions.

<Domain Size>

In the domain according to the present aspect, an average of maximum Feret's diameters (hereinafter, also simply referred to as "domain diameters") L of the domains included in each of the domains satisfying the configuration (iv) and the configuration (v) described above is preferably 0.1 μm or more and 5.0 μm or less.

By making an average value of the domain diameters L 0.1 μm or more, it is possible to effectively limit a path through which the electric charges are transferred in the electro-conductive layer to an intended path. In addition, by making the average value of the domain diameters L 5.0 μm or less, it is possible to exponentially increase a ratio of a surface area to a total volume of the domains, that is, a specific surface area and dramatically improve discharging efficiency of the electric charges from the domains. For the above reason, the average value of the domain diameters L is preferably 2.0 μm or less, and further preferably 1.0 μm or less.

It should be noted that in order to further reduce electric field concentration between the domains, it is preferable to make the outer shape of the domain closer to the sphere. For that reason, it is preferable to make the domain diameter smaller within the range described above. Examples of a method of making the domain diameter smaller within the range described above include a method of performing control to decrease the domain diameter of the CMB in a step of kneading the MRC and the CMB and phase-separating the MRC and the CMB and preparing a rubber mixture in which the domains of the CMB are formed in the matrix of the MRC in step (iv). Since the specific surface area of the CMB is increased and an interface of the domain of the CMB with the matrix is increased by decreasing the domain diameter of the CMB, a tension that is to decrease a tension acts on the interface of the domain of the CMB. As a result, an outer shape of the domain of the CMB becomes closer to the sphere.

In order to uniformize the inter-domain distances in relation to the configuration (iii), it is effective to reduce the domain size according to the Taylor equation (Equation (5)), the Wu empirical equations (Equations (6) and (7)), and the Tokita's equation (Equation (8)). Further, the matrix-domain structure is also governed by where a kneading process was stopped in a process in which a raw material rubber of the domain is split in the kneading step, such that a grain diameter gradually becomes small. Therefore, the uniformity of the inter-domain distances can be controlled by a kneading time in a kneading process and a kneading rotation speed that is an index of a strength of the kneading, and as the kneading rotation speed becomes higher, the uniformity of the inter-domain distances can be improved.

Uniformity of Domain Sizes;

It is preferable that the domain sizes are uniform, that is, a particle size distribution is narrow. By making a distribution of sizes of the domains through which the electric charges pass in the electro-conductive layer uniform, it is possible to suppress the concentration of the electric charges in the matrix-domain structure and effectively increase the ease of the emission of the electric charges over the entire surface of the developing member. When acquiring the observation regions of 50 μm square at any three points in the thickness region up to the depth of 0.1 T to 0.9 T from the outer surface of the electro-conductive layer toward the support in a cross section in which the electric charges are transported, that is, a cross section of the electro-conductive layer in the thickness direction, a ratio σd/D between a standard deviation σd of the domain sizes and an average value D of the domain sizes is preferably 0 or more and 0.4 or less.

If the domain size is decreased according to Equations (5) to (8), similar to the method of improving the uniformity of the inter-domain distances described above, the uniformity of the domain sizes is also improved. Further, the matrix-domain structure is also governed by where a kneading process was stopped in a process in which a raw material rubber of the domain is split in the kneading step, such that a grain diameter gradually becomes small. Therefore, the uniformity of the domain sizes can be controlled by a kneading time in a kneading process and a kneading rotation speed that is an index of a strength of the kneading, and as the kneading rotation speed becomes higher, the uniformity of the domain sizes can be improved.

<Method of Confirming Matrix-Domain Structure>

The existence of the matrix-domain structure in the electro-conductive layer can be confirmed by manufacturing a thin piece from the electro-conductive layer and observing a fracture surface formed on the thin piece in detail.

Examples of a unit manufacturing the thin piece include a sharp razor, a microtome, a FIB or the like. In addition, in order to perform more accurate observation of the matrix-domain structure, pretreatment that can suitably obtain a contrast between the domain as an electro-conductive phase and the matrix as an insulating phase, such as dyeing treatment or vapor deposition treatment may be performed on the thin piece for observation.

With respect to the thin piece on which a fracture surface is formed and the pretreatment is performed if necessary, the existence of the matrix-domain structure can be confirmed by observing the fracture surface with a laser microscope, a scanning electron microscope (SEM), or a transmission electron microscope (TEM). As a method of easily and accurately confirming a sea-island structure, it is preferable to observe the sea-island structure with a scanning electron microscope (SEM).

The thin piece of the electro-conductive layer is acquired by the method as described above, a surface of the thin piece is observed at 1,000 to 10,000 magnifications to acquire an image, and 8-bit gray scale conversion is then performed using image processing software such as ImageProPlus (product name, produced by Media Cybernetics, Inc.) to obtain a 256-gradation monochrome image. Next, a black and a white of the image are inverted so that the domain in the fracture surface becomes white, and binarization is performed to acquire an analysis image. It is sufficient to determine the presence or absence of the matrix-domain structure by the analysis image image-processed in a state where the domain and the matrix are distinguished from each other by the binarization.

In a case where a structure in which the plurality of domains exist in an isolated state in the matrix as illustrated in FIG. 6 is included in the analysis image, the existence of the matrix-domain structure in the electro-conductive layer can be confirmed. It is sufficient that the isolated state of the domains is a state in which each domain is arranged in a state in which it is not connected to other domains, the matrix communicates in the image, and the domains are separated by the matrix. Specifically, when a region within 50 μm square in the analysis image is defined as an analysis region, a state in which the number of domains existing in the isolated state as described above is 80% or more of the total number of domain groups that do not have contacts with a frame line of the analysis region is defined as a state having the sea-island structure.

In the confirmation as described above, it is sufficient to equally divide the electro-conductive layer of the developing member into five equal regions in the longitudinal direction, equally divide the electro-conductive layer of the developing member into four equal regions in the circumferential direction, manufacture the sections from any one point of each of the regions, that is, a total of 20 points, and perform the measurement described above.

The developing member may have an appropriate surface roughness, if necessary. In a case where the developing member is a developing roller or a developing sleeve, a surface roughness is preferably in the range of 2.0 μm to 8.0 μm, and particularly preferably in the range of 2.0 μm to 4.5 μm, in a ten-point average roughness (Rz).

In a case where the developing member is a developing blade, a surface roughness is preferably in the range of 0.0 μm to 6.0 μm, and particularly preferably in the range of 0.0 μm to 1.5 μm, in a ten-point average roughness (Rz).

When the surface roughness is within this range, both of uniform contact with the toner and an appropriate toner transport amount are achieved, and it is possible to easily make the electric charge supply to the toner uniform.

Examples of a method of forming the surface roughness of the developing member include polishing, mold transfer, and laser treatment.

In a case where the developing member has a roller shape, examples of a method of molding the electro-conductive layer include a method of molding a liquid rubber material or a method of extruding a kneaded rubber material.

In addition, in a case where the developing member has a blade shape, examples of a method of molding the electro-conductive layer include a molding method, an injection molding method, an extrusion molding method, and a centrifugal molding method.

(2) Electrophotographic Apparatus

The developing member according to the present disclosure can be suitably used as a developing roller, a toner supply roller, a developing sleeve, and a developing blade in an electrophotographic apparatus as an electrophotographic image forming apparatus. The developing member can be applied to any of a non-contact type developing device and a contact type developing device using a magnetic one-component toner or a non-magnetic one-component toner, and a developing device using a two-component toner.

Figure 10:
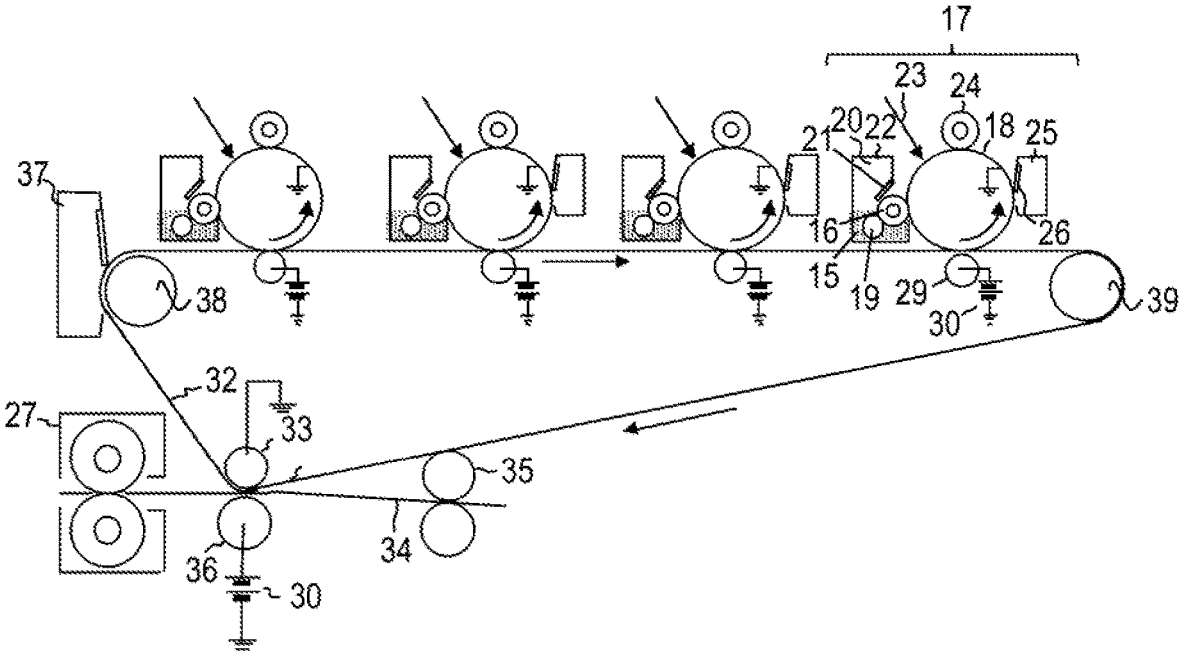
FIG. 10 is a schematic diagram of an electrophotographic apparatus.

FIG. 10 is a schematic cross-sectional view illustrating an example of an electrophotographic apparatus in which the developing member according to the present disclosure is mounted as a developing roller of a contact type developing device using a one-component toner. The developing device 22 includes a toner container 20 containing a toner 15 as a one-component toner, a developing roller 16, a toner supply roller 19 supplying the toner to the developing roller 16, and a developing blade 21 regulating a thickness of a toner layer on the developing roller 16. The developing roller 16 is located in an opening extending in a longitudinal direction inside the toner container 20, and is installed to be in contact with a photosensitive member 18. It should be noted that the photosensitive member 18, a cleaning blade 26, a waste toner container 25, and a charging roller 24 may be provided in a main body of the electrophotographic apparatus. The developing device 22 is prepared for each color toner of black (Bk), cyan (C), magenta (M), and yellow (Y), and enables color printing.

Hereinafter, a printing operation of the electrophotographic apparatus will be described. The photosensitive member 18 rotates in an arrow direction and is uniformly charged by the charging roller 24 for charging the photosensitive member 18. Next, an electrostatic latent image is formed on a surface of the photosensitive member 18 by a laser light 23, which is an exposing unit. The electrostatic latent image is visualized (developed) as a toner image by imparting the toner 15 from the developing roller 16 arranged to be in contact with the photosensitive member 18 by the developing device 22. The development is so-called reversal development in which the toner image is formed on an exposed portion.

The toner image formed on the photosensitive member 18 is transferred to an endless belt-shaped intermediate transfer body 32 by a transfer roller 29, which is a transfer member.

A paper 34, which is a recording medium, is fed into the device by a paper feed roller 35 and a secondary transfer roller 36 and is conveyed to a nip portion between the secondary transfer roller 36 and a driven roller 33 together with the intermediate transfer body 32 having the toner image, such that the toner image is transferred to the paper 34. The intermediate transfer body 32 is operated by the driven roller 33, a driving roller 39, and a tension roller 38. The toner remaining on the intermediate transfer body 32 is cleaned by a cleaning device 37.

A voltage is applied from a bias power source 30 to the developing roller 16, the developing blade 21, the transfer roller 29, and the secondary transfer roller 36. The paper 34 to which the toner image is transferred is fixed by a fixing device 27, discharged to the outside of the device, and the printing operation ends. Meanwhile, a transfer residual toner remaining on the photosensitive member 18 without being transferred is scraped off by the cleaning blade 26, which is a cleaning member for cleaning the surface of the photosensitive member, and is stored in the waste toner container 25. The cleaned photosensitive member 18 repeatedly performs the above printing operation.

(3) Process Cartridge

Figure 9:
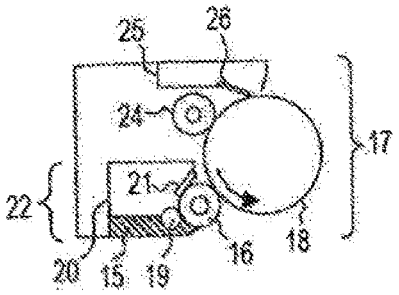
FIG. 9 is a schematic view of a process cartridge.

The developing member according to the present aspect described above can be suitably used as a developing roller, a toner supply roller, a developing sleeve, and a developing blade in a process cartridge. FIG. 9 is a schematic sectional view of an example of a process cartridge according to an aspect of the present disclosure. In FIG. 9, the developing member is mounted as a developing roller 16. The process cartridge 17 is configured to be attachable to and detachable from a body of the electrophotographic apparatus. The process cartridge 17 includes a developing device 22 including the developing roller 16 and a developing blade 21, a photosensitive member 18, a cleaning blade 26, a waste toner container 25, and a charging roller 24 which are integrated with each other. The developing device 22 further includes a toner container 20, and a toner 15 is filled in the toner container 20. The toner 15 in the toner container 20 is supplied to a surface of the developing roller 16 by a toner supply roller 19, and a layer of the toner 15 having a predetermined thickness is formed on the surface of the developing roller 16 by the developing blade 21.

According to an aspect of the present disclosure, an electrophotographic developing member capable of maintaining high image quality and high durability even in a high-speed process can be obtained. In addition, according to another aspect of the present disclosure, an electrophotographic apparatus capable of stably outputting a high-quality electrophotographic image and a process cartridge used for the same can be obtained.

EXAMPLE

Hereinafter, specific examples and comparative examples are shown.

<Manufacture of Developing Roller>

Example 1

1. Production of Unvulcanized Domain Rubber Composition

[1-1] Preparation of Unvulcanized Domain Composition

Respective materials were mixed with each other by amounts shown in Table 1 by a pressurizing kneader to obtain an unvulcanized domain composition. As a mixer, a 6 liter pressure kneader (product name: TD6-15MDX, produced by Toshin Co.) was used. As mixing conditions, a packing factor was 70 vol %, a rotation speed of a blade was 30 rpm, and a mixing time was 16 minutes.

TABLE 1

| | Raw material name | Mixing amount (parts by mass) |
|---|---|---|
| Raw material rubber | Butadiene rubber (Product name: T0700, produced by JSR Corporation) | 100 |
| Electro-conductive particle | Carbon black (Product name: TOKA | 45 |

TABLE 1-continued

| | Raw material name | Mixing amount (parts by mass) |
|---|---|---|
| | BLACK #7360, produced by Tokai Carbon Co., Ltd.) | |
| Vulcanization acceleration aid | Zinc oxide (Product name: Zinc White, produced by Sakai Chemical Industry Co., Ltd.) | 5 |
| Processing aid | Zinc stearate (Product name: SZ-2000, produced by Sakai Chemical Industry Co., Ltd.) | 2 |

[1-2] Preparation of Unvulcanized Matrix Rubber Composition

Respective materials were mixed with each other by amounts shown in Table 2 by a pressurizing kneader to obtain an unvulcanized matrix rubber composition. As a mixer, a 6 liter pressure kneader (product name: TD6-15MDX, produced by Toshin Co.) was used. As mixing conditions, a packing factor was 70 vol %, a rotation speed of a blade was 30 rpm, and a mixing time was 16 minutes.

TABLE 2

| | Raw material name | Mixing amount (parts by mass) |
|---|---|---|
| Raw material rubber | EPDM (Product name: Esplene 505A, produced by Sumitomo Chemical Co., Ltd.) | 100 |
| Filler | Calcium carbonate (Product name: NANOX#30, produced by Maruo Calcium Co., Ltd.) | 70 |
| Vulcanization acceleration aid | Zinc oxide (Product name: Zinc White, produced by Sakai Chemical Industry Co., Ltd.) | 7 |
| Processing aid | Zinc stearate (Product name: SZ-2000, produced by Sakai Chemical Industry Co., Ltd.) | 2.8 |

[1-3] Preparation of Unvulcanized Rubber Composition

Respective materials were mixed with each other by amounts shown in Table 3 by a pressurizing kneader to obtain an unvulcanized rubber composition. As a mixer, a 6 liter pressure kneader (product name: TD6-15MDX, produced by Toshin Co.) was used. As mixing conditions, a packing factor was 70 vol %, a rotation speed of a blade was 30 rpm, and a mixing time was 16 minutes.

TABLE3

| | Raw material name | Mixing amount (parts by mass) |
|---|---|---|
| Raw material rubber | Unvulcanized domain composition | 25 |
| Raw material rubber | Unvulcanized matrix composition | 75 |

[1-4] Preparation of Rubber Composition for Molding Developing Roller

Respective materials were mixed with each other by amounts shown in Table 4 with an open roll to prepare a rubber composition for molding a developing member. As a mixer, an open roll having a roll diameter of 12 inches (0.30 m) was used. After cut-back at the left and the right was performed twenty times in total under mixing conditions in which a rotation speed of a front roll was 10 rpm, a rotation speed of a rear roll was 8 rpm, a roll clearance was 2 mm, tight milling was performed ten times under a mixing condition in which a roll clearance is 0.5 mm.

TABLE 4

| | Raw material name | Mixing amount (parts by mass) |
|---|---|---|
| Raw material rubber | Unvulcanized rubber composition | 100 |
| Vulcanizing agent | Sulfur Product name: SULFAX PMC, produced by Tsurumi Chemical Industry Co., Ltd.) | 3 |
| Vulcanization aid | Tetrabenzyl thiuram disulfide (Product name: TBZTD, produced by Sanshin Chemical Industry Co., Ltd.) | 2 |

2. Molding of Developing Roller

As a support, a core metal having an outer diameter of 6 mm was prepared by subjecting a surface of free-cutting steel to electroless nickel plating. The core metal was used as the support, which is an electro-conductive mandrel.

Next, a die having an inner diameter of 16.0 mm was attached to a tip of a crosshead extruder having a supply mechanism of the electro-conductive support and a discharge mechanism of an unvulcanized rubber roller, temperatures of an extruder and a crosshead were adjusted to 80° C., and a transport speed of the electro-conductive support was adjusted to 60 mm/sec. Under this condition, an unvulcanized rubber composition was supplied from the extruder, and an outer peripheral portion of the electro-conductive support was covered with the unvulcanized rubber composition in the crosshead to obtain an unvulcanized rubber roller.

Next, the unvulcanized rubber roller was put into a hot air vulcanizing furnace of 170° C., and the unvulcanized rubber composition was vulcanized by performing heating for 60 minutes to obtain a roller having an electro-conductive resin layer formed on an outer peripheral portion of the electro-conductive support. Thereafter, both ends of the electro-conductive resin layer were cut off, and a surface of the electro-conductive resin layer was polished with a rotary grindstone. As a result, a crown-shaped developing roller A1 having each diameter of 12.0 mm at each of positions of 90 mm from a central portion to both end portions and a central diameter of 12.2 mm was obtained.

3. Characteristic Evaluation

[3-1] Confirmation of Matrix-Domain Structure

The following confirmation was performed in order to confirm whether or not a matrix-domain structure can be suitably formed.

A section was cut out using a razor so that a cross section perpendicular to a circumferential direction of the electro-conductive layer can be observed. Next, platinum vapor deposition was performed, and an image of the cross section was captured at 1,000 magnifications using a scanning electron microscope (SEM) (product name: S-4800, produced by Hitachi High-Tech Corporation) to obtain a cross-sectional image.

The matrix-domain structure is in a state where a plurality of domain components **6*b* are dispersed in a matrix 6*a* and an electro-conductive path is separated, as illustrated in FIG. 6**, in this cross-sectional image, while the matrix is in a state where it communicates in the cross-sectional image.

The developing roller A1 (whose length in a longitudinal direction is 230 mm) was divided into five equal regions in the longitudinal direction, was divided into four equal regions in the circumferential direction, the sections were manufactured from any one point of each of the regions, that is, a total of 20 points, and the measurement was performed. "Presence or absence of sea-island structure" was shown in Table 7-1 in which a case where the matrix-domain structure could be confirmed is "present" and a case where the matrix-domain structure could not be confirmed is "absent".

[3-2] Measurement of inclination at $1\times10^6$ Hz to $1\times10^7$ Hz and impedance at $1\times10^{-2}$ Hz to $1\times10^0$ Hz Measurement of an impedance was performed as follows.

First, as pretreatment, a measuring electrode was formed by performing vacuum platinum vapor deposition on the developing member A1 while rotating the developing member A1. At this time, an electrode having a width of 1.5 cm and uniform in the circumferential direction was formed using a masking tape. By forming the electrode, contribution of a contact area between the measuring electrode and an electro-conductive member can be decreased as much as possible by a surface roughness of the electro-conductive member.

Next, an aluminum sheet was wound around the electrode without a gap, and the aluminum sheet was connected to a measuring electrode of an impedance measuring device (product name: Solartron 1260 and Solartron 1296, produced by Solartron Metrology).

Figure 11:
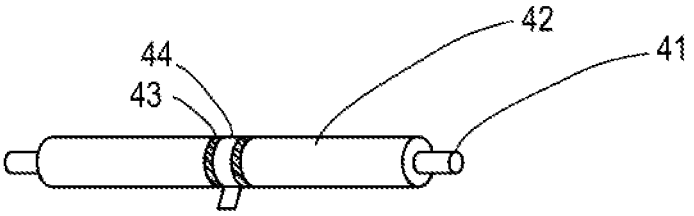
FIG. 11 is a schematic diagram of a developing roller in which a measuring electrode is formed.

FIG. 11 illustrates a schematic diagram of a developing roller on which a measuring electrode is formed. In FIG. 11, an electro-conductive support is denoted by reference numeral 41, an electro-conductive layer having a matrix-domain structure is denoted by reference numeral 42, a platinum vapor deposition layer is denoted by reference numeral 44, and an aluminum sheet is denoted by reference numeral 43.

Figure 12:
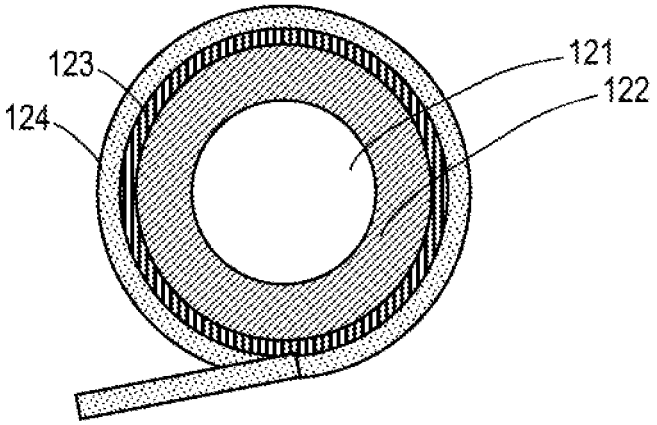
FIG. 12 is a cross-sectional view of a developing roller in which a measuring electrode is formed on an electro-conductive member.

FIG. 12 illustrates a cross-sectional view of a developing roller in which a measuring electrode is formed on an electro-conductive member. An electro-conductive support is denoted by 121, an electro-conductive layer having a matrix-domain structure is denoted by 122, a platinum vapor deposition layer is denoted by 123, and an aluminum sheet is denoted by 124. As illustrated in FIG. 12, it is important that the electro-conductive support and the measuring electrode sandwich the electro-conductive layer having the matrix-domain structure.

Figure 13:
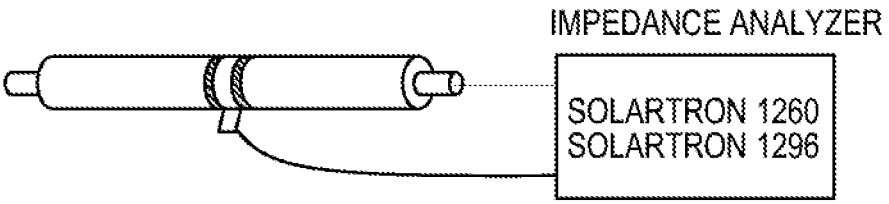
FIG. 13 is a schematic diagram of an impedance measurement system for an electro-conductive layer.

Then, the aluminum sheet was connected to a measuring electrode on an impedance measuring device (product name: Solartron 1260 and Solartron 1296, produced by Solartron Metrology) side. FIG. 13 illustrates a schematic diagram of the present measurement system. Impedance measurement was performed by using an electro-conductive support and an aluminum sheet as two electrodes for measurement.

The impedance was measured at an oscillation voltage of 1 Vpp, a direct current voltage of 10V, and a frequency of $1\times10^{-2}$ Hz to $1\times10^7$ Hz in an environment of a temperature of 23° C. and a relative humidity of 50% (measured at five points when a frequency changes by one digit) to obtain an absolute value of the impedance. Next, with respect to a measurement result, the absolute value of the impedance and an angular frequency (measurement frequency$\times2\times\pi$ (the ratio of the circumference)) are log-log-plotted using spreadsheet software such as Excel (registered trademark), and an inclination at $1\times10^6$ Hz to $1\times10^7$ Hz was calculated.

The developing roller A1 (whose length in a longitudinal direction is 230 mm) was divided into five equal regions in the longitudinal direction, measuring electrodes were formed from any one point of each of the regions, that is, a total of 5 points, and the measurement was performed. An average value of the measured impedances was used as the inclination of the impedance.

Results obtained in the electro-conductive layer are shown in items of "Inclination" and "Impedance" of Table 7-1.

An impedance of the electro-conductive support was measured by a method similar to the above method except that the electro-conductive layer was peeled off from the developing roller. The obtained results are shown in Table 7-1 as "Impedance" of "Electro-conductive support".

[3-3] Measurement of Volume Resistivity of Matrix

A volume resistivity of the matrix was measured in a contact mode using a scanning probe microscope (SPM) (product name: Q-Scope250, produced by Quesant Instrument Corporation).

First, an ultrathin section having a thickness of about 2 μm was cut out from the electro-conductive layer of the developing roller at a cutting temperature of −100° C. using a microtome (product name: Leica EM FCS, produced by Leica Microsystems).

Next, in an environment of a temperature of 23° C. and a relative humidity of 50%, the ultrathin section was installed on a metal plate, a place in direct contact with the metal plate was selected, a cantilever of the SPM was brought into contact with a place corresponding to the matrix, and a voltage of 50 V was then applied to the cantilever to measure a current value.

A thickness of a measurement place was calculated from a height profile by observing a surface shape of the measurement section with the SPM. Further, a concave portion area of a contact portion of the cantilever was calculated from an observation result of the surface shape. A volume resistivity was calculated from the thickness and the concave portion area to obtain the volume resistivity of the matrix.

The developing roller A1 (whose length in a longitudinal direction is 230 mm) was divided into five equal regions in the longitudinal direction, was divided into four equal regions in the circumferential direction, the sections were manufactured from any one point of each of the regions, that is, a total of 20 points, and the measurement was performed. An average value of the measured volume resistivities was used as the volume resistivity of the matrix.

The obtained results are shown in Table 7-1 as "Volume resistivity" of "Matrix".

[3-4] Measurement of Volume Resistivity of Domain

A volume resistivity of the domain was measured by a method similar to the measurement of the volume resistivity of the matrix described above except that a measurement place is a place corresponding to the domain.

The obtained results are shown in Table 7-1 as "Volume resistivity" of "Domain".

[3-5] Ratio Between Volume Resistivity of Matrix and Volume Resistivity of Domain By dividing a common logarithm of the volume resistivity R1 of the matrix and a common logarithm of the volume resistivity R2 of the domain, a ratio (log(R1/R2)) between the volume resistivities of the matrix and the domain was calculated.

The obtained results are shown in Table 7-1 as "Resistance ratio" of "Matrix domain".

[3-6] Measurement of Shape of Domain

The following measurement was performed in order to evaluate a size of the domain.

An observation image obtained by a scanning electron microscope (SEM) was calculated by performing quantification by image processing according to the following method.

Platinum was vapor-deposited on the section obtained in the measurement of the volume resistivity of the matrix described above to obtain a vapor-deposited section. Next, an image of a surface of the vapor-deposited section was captured at 1,000 magnifications using a scanning electron microscope (SEM) (product name: S-4800, produced by Hitachi High-Tech Corporation) to obtain a surface image.

Next, the surface image was image-processed (binarized) using image processing software Image-pro plus (product name, produced by Media Cybernetics, Inc.) so that the matrix becomes white and the domain becomes black, and arithmetic mean values of the following items were calculated for any 50 domains in the observation image by a counting function.

It should be noted that in order to obtain the electro-conductive layer as stipulated by the requirements (B2) and requirements (B3), in the domain according to the present aspect, when an observation region of 15 μm square is placed at any position in the thickness region up to the depth of 0.1 T to 0.9 T from the outer surface of the electro-conductive layer in a cross section of the electro-conductive layer in the thickness direction when the thickness of the electro-conductive layer is T, it is more preferable that 20 to 300 domains exist in the observation region.

Perimeter: A

Envelope perimeter: B

Ratio between A and B: A/B

Number of domains satisfying requirement (B3)

This was divided into five equal regions in the longitudinal direction of the developing member A1 and was divided into four equal regions in the circumferential direction, and an arithmetic mean value of measurement results of each of the above items for twenty regions was used for evaluation of the domains.

In the requirement 3, "A" is a perimeter of a domain 71 observed in the observation region, and "B" is a length (envelope perimeter) of a convex envelope 73 of the domain as illustrated in FIG. 7.

Values of the domain perimeter A and the envelope perimeter B were also calculated as arithmetic mean values by the above method.

The obtained results are shown in Table 8-1 as "Perimeter A", "Envelope perimeter B", "A/B (average value)", and "Number of domains satisfying requirement (B3)", respectively.

[3-7] Measurement of Inter-Domain Distance

An inter-domain distance according to the present disclosure was obtained by performing image processing on an observation image obtained by observing an image obtained with a scanning electron microscope (SEM).

Specifically, the inter-domain distance was calculated by a method similar to the method of measuring the shape of the domain described above except that a function of counting a distance between wall surfaces of the domains is used in a method of image processing.

This was divided into five equal regions in the longitudinal direction of the developing roller A1 and was divided into four equal regions in the circumferential direction, and an arithmetic mean of the above measurement results for twenty regions was used as the inter-domain distance Dm.

The obtained results were shown as "Distance" of "Matrix" in Table 7-1 and "Inter-domain distance Dm" in Table 8-1.

[3-8] Measurement of Volume Fraction

A volume of the domains can be calculated by measurement of the electro-conductive layer in three dimensions using a FIB-SEM.

The FIB-SEM is a method of processing a sample with a focused ion beam (FIB) apparatus and observing an exposed cross section with a scanning electron microscope (SEM). Investigation of a three-dimensional structure can be performed by repeating continuous processing and observation to acquire a large number of photographs and then performing 3D reconstruction processing on the SEM images by computer software to construct a sample structure as a three-dimensional stereoscopic image.

As a specific measuring method of the domain volume, FIB-SEM (produced by FEI Company) was used to obtain a three-dimensional stereoscopic image, and the above configuration was confirmed from the three-dimensional stereoscopic image. That is, the electro-conductive layer is sampled from any nine places, but in a case of a roller shape, when the length of the electro-conductive layer in the longitudinal direction is L, one sample is cut out per 120° in the circumferential direction of the roller from each of three places near (¼)L, (2/4)L, and (¾)L from an end portion.

Thereafter, three-dimensional measurement using FIB-SEM is performed, and a cube-shaped image whose one side is 9 μm is measured at intervals of 60 nm. Here, cross sections of the electro-conductive layer in each cross section of (¼)L, (2/4)L, and (¾)L are measured per 90° in the circumferential direction of the roller at a central portion of a surface from a core metal position.

It should be noted that in order to suitably perform observation of the domain structure, it is also preferable to perform pretreatment that can suitably obtain a contrast between the domain and the matrix. Here, dyeing processing can be suitably used.

Thereafter, in the obtained image, a volume of the domains in 27 unit cubes whose one side is 3 μm included in one cubic shaped sample shape whose one side is 9 μm, is calculated using 3D visualization/analysis software "Avizo" (product name, produced by FEI Company).

It should be noted that measurement of a distance between adjacent wall surfaces of the domains can also be performed in the similar manner using the 3D visualization/analysis software "Avizo", and after the above measured value is obtained, it can be calculated by an arithmetic mean of a total of 27 samples.

The obtained results are shown in Table 7-1 as "Domain volume fraction".

[3-9] Uniform Dispersibility of Domains

A uniform dispersibility of the domains in the electro-conductive layer can be determined by measurement of the electro-conductive layer in three dimensions using a FIB-SEM.

The FIB-SEM is a method of processing a sample with a focused ion beam (FIB) apparatus and observing an exposed cross section with a scanning electron microscope (SEM). Investigation of a three-dimensional structure can be performed by repeating continuous processing and observation to acquire a large number of photographs and then performing 3D reconstruction processing on the SEM images by computer software to construct a sample structure as a three-dimensional stereoscopic image.

As a specific measuring method, FIB-SEM (produced by FEI Company) was used to obtain the three-dimensional stereoscopic image described above, and the above configuration was confirmed from the three-dimensional stereoscopic image.

It should be noted that in order to suitably perform observation of the domain structure, it is also preferable to perform pretreatment that can suitably obtain a contrast between the domain and the matrix. Here, dyeing processing can be suitably used.

Thereafter, in the obtained image, a volume of the domains included in a unit cube-shaped sample is calculated using 3D visualization/analysis software "Avizo" (product name, produced by FEI Company).

It should be noted that measurement of the distance between adjacent wall surfaces of the domains can also be performed in the similar manner using the 3D visualization/analysis software "Avizo" described above, and after the above measured value is obtained, it can be calculated by an arithmetic mean of samples.

It was verified by the above method that the electro-conductive domains were three-dimensionally uniformly and densely arranged in the electro-conductive layer. Here, as described above, three-dimensional measurement using the FIB-SEM is performed, and it is evaluated whether or not at least eight of cube-shape samples (sample cubes) whose one side is 9 μm satisfy the following condition. Requirement (B1):

"When one cube sample is divided into 27 unit cubes whose one side is 3 μm and a volume Vd of the domains included in each of the unit cubes is calculated, the number of unit cubes in which Vd is 2.7 $\mu m^3$ to 10.8 $\mu m^3$ is at least 20."

As described above, when the number of unit cubes in the sample cube satisfying the requirement (B1) increases, an effect of the present disclosure is inevitably improved.

The obtained results are shown in Table 8-1 as "Number of cubes satisfying requirement (B1)".

[3-10] Ratio of Cross-Sectional Area of Electronic Conductive Agent Contained in Domain to Cross-Sectional Area of Domain It can be calculated using the SEM image observed in the above "Measurement of shape of domain". Platinum was vapor-deposited on the section obtained by the above method to obtain a vapor-deposited section. Next, an image of a surface of the vapor-deposited section was captured at 1,000 to 100,000 magnifications using a scanning electron microscope (SEM) (product name: S-4800, produced by Hitachi High-Tech Corporation) to obtain a surface image. Next, 8-bit grayscale conversion is performed on the image using an image analysis device (product name: LUZEX-AP, produced by Nireco Corporation) to obtain a 256-gradation monochrome image. Next, a black and a white of the image are inverted so that the domain in the fracture surface becomes white, and binarization is performed.

Further, an observation region having a size in which at least one domain is contained is extracted from the above SEM image, and a cross-sectional area Sd of the domain and a cross-sectional area Sc of the electronic conductive agent (carbon black) contained in the domain are calculated.

By calculating $\mu = Sc/Sd$ from the obtained cross-sectional area Sc of the electronic conductive agent (carbon black) and the obtained cross-sectional area Sd of the domain, a ratio of the cross-sectional area of the electronic conductive agent included in the domain to the cross-sectional area of the domain is obtained.

The obtained results were shown in Table 8-1 as "μ" (average value of ratios of cross-sectional areas of electronic conductive agents), "σ" (standard deviation of ratios of cross-sectional areas of electronic conductive agents), "μ/σ", "Requirement (B2) cross-sectional area ratio (average)", and "Number (%) of domains satisfying requirement (B2)".

Examples 2 to 34

Developing rollers of Examples 2 to 34 were manufactured and evaluated in a manner similar to that of Example 1 except that raw materials, vulcanizing agents, vulcanization aids, and the like, of an electro-conductive support, a domain rubber, and a matrix rubber were changed to those shown in Table 5-1 to Table 6-5. Evaluation results are shown in Table 7-1, Table 7-2, Table 8-1, and Table 8-2.

Example 35

As in Example 1, a core metal having an outer diameter of 6 mm was prepared by subjecting a surface of free-cutting steel to electroless nickel plating. Next, "Metaloc U-20" (product name, produced by Toyo Kagaku Kenkyusho Co., Ltd.) was coated as an adhesive over the entire circumference of the core metal except for 15 mm at both ends of the core metal using a roll coater. In Example 35, the core metal coated with the adhesive was used as an electro-conductive mandrel. Then, a developing roller of Example 35 was obtained in a manner similar to that of Example 1 except that raw materials, vulcanizing agents, vulcanization aids, and the like, of an electro-conductive support, a domain rubber, and a matrix rubber were changed to those shown in Table 5-3 and Tables 6-2 to 6-5.

Example 36

A round bar having an outer diameter of 8 mm was molded by injection molding using an electro-conductive thermoplastic resin (product name: TORAYCA™ TLP1060, produced by Toray Industries, Inc.). Next, the round bar was polished to prepare an electro-conductive resin core metal having the same shape as that of the free-cutting steel used in Example 1 and having an outer diameter of 6 mm.

In Example 36, the present conductive resin core metal was used as an electro-conductive mandrel. Then, a developing roller of Example 36 was obtained in a manner similar to that of Example 1 except that raw materials, vulcanizing agents, vulcanization aids, and the like, of an electro-conductive support, a domain rubber, and a matrix rubber were changed to those shown in Table 5-3 and Tables 6-2 to 6-5.

Example 37

The electro-conductive resin core metal used in Example 36 was prepared. Next, Metaloc U-20 (product name, produced by Toyo Kagaku Kenkyusho Co., Ltd.) was coated as an adhesive over the entire circumference of the core metal except for 15 mm at both ends of the core metal using a roll coater. In Example 37, the electro-conductive resin core metal coated with the adhesive was used as an electro-conductive mandrel.

Then, a developing roller of Example 37 was obtained in a manner similar to that of Example 1 except that raw materials, vulcanizing agents, vulcanization aids, and the like, of an electro-conductive support, a domain rubber, and a matrix rubber were changed to those shown in Table 5-3 and Tables 6-2 to 6-5.

Example 38

A round bar having an outer diameter of 8 mm was molded by injection molding using a PPS resin (product name: TORELINA™ A503-X05, produced by Toray Industries, Inc.). Next, the round bar was polished to prepare a PPS resin core metal having the same shape as that of the free-cutting steel used in Example 1 and having an outer diameter of 6 mm. Platinum vapor-deposition was performed on the entire outer surface of the obtained PPS resin core metal to obtain a mandrel. Next, the mandrel was coated with an adhesive in a manner similar to that of Example 37.

Then, a developing roller having a shape of Example 38 was obtained in a manner similar to that of Example 1 except that raw materials, vulcanizing agents, vulcanization aids, and the like, of an electro-conductive support, a domain rubber, and a matrix rubber were changed to those shown in Table 5-3 and Tables 6-2 to 6-5.

TABLE 5-1

| | Electro-conductive substrate | | Unvulcanized domain rubber composition | | | | | | | | Unvulcanized matrix rubber composition | | | | | |
|---|---|---|---|---|---|---|---|---|---|---|---|---|---|---|---|---|
| | | | Rubber | | | | | | | | Type of rubber | | | | | |
| | Type | Electro-conductive surface | Type | Product name | SP value | Mooney viscos-ity | Electro-conductive particle Type | phr | DBP | pH | Type | Product name | SP value | Mooney viscos-ity | Additive Type | phr |
| Example 1 | SUS | Ni plating | BR | JSR T0700 | 17.1 | 72 | #7360 | 75 | 87 | 7.5 | EPDM | Esplene505A | 16 | 47 | — | — |
| Example 2 | SUS | Ni plating | BR | JSR T0700 | 17.1 | 64 | #5500 | 55 | 155 | 6.0 | EPDM | Esplene505A | 16 | 47 | — | — |
| Example 3 | SUS | Ni plating | BR | JSR T0700 | 17.1 | 72 | #7360 | 75 | 87 | 7.5 | EPDM | Esplene505A | 16 | 47 | — | — |
| Example 4 | SUS | Ni plating | BR | JSR T0700 | 17.1 | 72 | #7360 | 75 | 87 | 7.5 | EPDM | Esplene505A | 16 | 47 | — | — |
| Example 5 | SUS | Ni plating | BR | JSR T0700 | 17.1 | 72 | #7360 | 75 | 87 | 7.5 | EPDM | Esplene505A | 16 | 47 | — | — |
| Example 6 | SUS | Ni plating | BR | JSR T0700 | 17.1 | 72 | #7360 | 75 | 87 | 7.5 | SBR | T2003 | 17 | 45 | — | — |
| Example 7 | SUS | Ni plating | BR | JSR T0700 | 17.1 | 72 | #7360 | 75 | 87 | 7.5 | SBR | T1000 | 16.8 | 45 | — | — |
| Example 8 | SUS | Ni plating | BR | JSR T0700 | 17.1 | 72 | #7360 | 75 | 87 | 7.5 | SBR | T2100R | 17 | 33 | — | — |
| Example 9 | SUS | Ni plating | BR | JSR T0700 | 17.1 | 72 | #7360 | 75 | 87 | 7.5 | SBR | A303 | 17 | 46 | — | — |
| Example 10 | SUS | Ni plating | BR | JSR T0700 | 17.1 | 58 | #7360 | 65 | 87 | 7.5 | SBR | T2003 | 17 | 45 | — | — |
| Example 11 | SUS | Ni plating | BR | JSR T0700 | 17.1 | 55 | #7360 | 55 | 87 | 7.5 | SBR | T2003 | 17 | 45 | — | — |
| Example 12 | SUS | Ni plating | BR | JSR T0700 | 17.1 | 72 | #7360 | 75 | 87 | 7.5 | CR | B31 | 17.4 | 40 | — | — |
| Example 13 | SUS | Ni plating | BR | JSR T0700 | 17.1 | 72 | #7360 | 75 | 87 | 7.5 | EPDM | Esplene301A | 17 | 44 | — | — |

TABLE 5-2

| | Electro-conductive substrate | | Unvulcanized domain rubber composition | | | | | | | | Unvulcanized matrix rubber composition | | | | | |
|---|---|---|---|---|---|---|---|---|---|---|---|---|---|---|---|---|
| | | | Rubber | | | | | | | | Type of rubber | | | | | |
| | Type | Electro-conductive surface | Type | Product name | SP value | Mooney viscos-ity | Electro-conductive particle Type | phr | DBP | pH | Type | Product name | SP value | Mooney viscos-ity | Additive Type | phr |
| Example 14 | SUS | Ni plating | BR | JSR T0700 | 17.1 | 55 | #7360 | 55 | 87 | 7.5 | EPDM | Esplene301A | 17 | 44 | — | — |
| Example 15 | SUS | Ni plating | BR | JSR T0700 | 17.1 | 88 | #7360 | 95 | 87 | 7.5 | EPDM | Esplene505A | 16 | 47 | — | — |
| Example 16 | SUS | Ni plating | BR | JSR T0700 | 17.1 | 37 | #7360 | 35 | 87 | 7.5 | EPDM | Esplene505A | 16 | 47 | — | — |
| Example 17 | SUS | Ni plating | NBR | DN401LL | 17.4 | 50 | #7360 | 55 | 87 | 7.5 | SBR | T2003 | 17 | 45 | — | — |
| Example 18 | SUS | Ni plating | NBR | DN401LL | 17.4 | 50 | #7360 | 55 | 87 | 7.5 | SBR | T2003 | 17 | 45 | — | — |
| Example 19 | SUS | Ni plating | NBR | DN401LL | 17.4 | 50 | #7360 | 55 | 87 | 7.5 | SBR | T2003 | 17 | 45 | — | — |
| Example 20 | SUS | Ni plating | NBR | DN401LL | 17.4 | 50 | #7360 | 55 | 87 | 7.5 | SBR | T2003 | 17 | 45 | — | — |
| Example 21 | SUS | Ni plating | NBR | DN401LL | 17.4 | 45 | #7360 | 35 | 87 | 7.5 | SBR | T2003 | 17 | 45 | — | — |
| Example 22 | SUS | Ni plating | NBR | DN401LL | 17.4 | 50 | #7360 | 55 | 87 | 7.5 | CR | B31 | 17.4 | 40 | — | — |
| Example 23 | SUS | Ni plating | NBR | N230SV | 19.2 | 52 | #7360 | 55 | 87 | 7.5 | SBR | T2003 | 17 | 45 | — | — |

TABLE 5-2-continued

| | Electro-conductive substrate | | Unvulcanized domain rubber composition | | | | | | | | Unvulcanized matrix rubber composition | | | | | |
|---|---|---|---|---|---|---|---|---|---|---|---|---|---|---|---|---|
| | | | Rubber | | | | | | | | Type of rubber | | | | | |
| | Type | Electro-conductive surface | Type | Product name | SP value | Mooney viscosity | Electro-conductive particle Type | phr | DBP | pH | Type | Product name | SP value | Mooney viscosity | Additive Type | Additive phr |
| Example 24 | SUS | Ni plating | NBR | N230SV | 19.2 | 52 | #7360 | 55 | 87 | 7.5 | SBR | T2003 | 17 | 45 | — | — |
| Example 25 | SUS | Ni plating | NBR | N230SV | 19.2 | 52 | #7360 | 55 | 87 | 7.5 | SBR | T2003 | 17 | 45 | — | — |
| Example 26 | SUS | Ni plating | NBR | N230SV | 19.2 | 52 | #7360 | 55 | 87 | 7.5 | SBR | T2003 | 17 | 45 | — | — |
| Example 27 | SUS | Ni plating | NBR | N230S | 20 | 54 | #7360 | 55 | 87 | 7.5 | SBR | T2003 | 17 | 45 | — | — |
| Example 28 | SUS | Ni plating | NBR | N230S | 20 | 49 | #7360 | 35 | 87 | 7.5 | SBR | T2003 | 17 | 45 | — | — |

TABLE 5-3

| | Electro-conductive substrate | | Unvulcanized domain rubber composition | | | | | | | | Unvulcanized matrix rubber composition | | | | | |
|---|---|---|---|---|---|---|---|---|---|---|---|---|---|---|---|---|
| | | | Rubber | | | | | | | | Type of rubber | | | | | |
| | Type | Electro-conductive surface | Type | Product name | SP value | Mooney viscosity | Electro-conductive particle Type | phr | DBP | pH | Type | Product name | SP value | Mooney viscosity | Additive Type | Additive phr |
| Example 29 | SUS | Ni plating | EPDM | Esplene301A | 16 | 52 | #7360 | 75 | 87 | 7.5 | SBR | T2003 | 17 | 45 | — | — |
| Example 30 | SUS | Ni plating | EPDM | Esplene301A | 16 | 52 | #7360 | 75 | 87 | 7.5 | SBR | T2003 | 17 | 45 | — | — |
| Example 31 | SUS | Ni plating | SBR | T2000R | 17 | 55 | #7360 | 55 | 87 | 7.5 | BR | JSR T0700 | 17.1 | 43 | — | — |
| Example 32 | SUS | Ni plating | SBR | T2000R | 17 | 50 | #7360 | 35 | 87 | 7.5 | BR | JSR T0700 | 17.1 | 43 | — | — |
| Example 33 | SUS | Ni plating | NBR | N232SH | 20.2 | 58 | #7360 | 55 | 87 | 7.5 | SBR | T2003 | 17 | 45 | — | — |
| Example 34 | SUS | Ni plating | NBR | N232SH | 20.2 | 53 | #7360 | 35 | 87 | 7.5 | CR | B31 | 17.4 | 40 | — | — |
| Example 35 | SUS | Ni plating/ Primer | NBR | DN401LL | 17.4 | 50 | #7360 | 55 | 87 | 7.5 | SBR | T2003 | 17 | 45 | — | — |
| Example 36 | Resin core metal | — | NBR | DN401LL | 17.4 | 50 | #7360 | 55 | 87 | 7.5 | SBR | T2003 | 17 | 45 | — | — |
| Example 37 | Resin core metal | Primer | NBR | DN401LL | 17.4 | 50 | #7360 | 55 | 87 | 7.5 | SBR | T2003 | 17 | 45 | — | — |
| Example 38 | Insulating resin core metal | Primer | NBR | DN401LL | 17.4 | 50 | #7360 | 55 | 87 | 7.5 | SBR | T2003 | 17 | 45 | — | — |

TABLE 6-1

| | Unvulcanized rubber dispersion | Unvulcanized rubber composition | | Vulcanizing agent | | Vulcanization aid | |
|---|---|---|---|---|---|---|---|
| | Rotation speed | Domain | Matrix | | | | |
| | rpm | phr | phr | Type | phr | Type | phr |
| Example 1 | 30 | 15 | 85 | Sulfur | 3 | MBTS | 2 |
| Example 2 | 30 | 15 | 85 | Sulfur | 3 | MBTS | 2 |
| Example 3 | 30 | 25 | 75 | Sulfur | 3 | MBTS | 2 |

TABLE 6-1-continued

| | Unvulcanized rubber dispersion | Unvulcanized rubber composition | | Vulcanizing agent | | Vulcanization aid | |
|---|---|---|---|---|---|---|---|
| | Rotation speed | Domain | Matrix | | | | |
| | rpm | phr | phr | Type | phr | Type | phr |
| Example 4 | 30 | 30 | 70 | Sulfur | 3 | MBTS | 2 |
| Example 5 | 30 | 40 | 60 | Sulfur | 3 | MBTS | 2 |
| Example 6 | 30 | 25 | 75 | Sulfur | 3 | MBTS | 2 |
| Example 7 | 30 | 25 | 75 | Sulfur | 3 | MBTS | 2 |
| Example 8 | 30 | 25 | 75 | Sulfur | 3 | MBTS | 2 |
| Example 9 | 30 | 25 | 75 | Sulfur | 3 | MBTS | 2 |
| Example 10 | 30 | 25 | 75 | Sulfur | 3 | MBTS | 2 |
| Example 11 | 30 | 25 | 75 | Sulfur | 3 | MBTS | 2 |
| Example 12 | 30 | 25 | 75 | Sulfur/ZnO/MgO | 1/5/4 | ETU | 1 |
| Example 13 | 30 | 25 | 75 | Sulfur | 3 | MBTS | 2 |
| Example 14 | 30 | 25 | 75 | Sulfur | 3 | MBTS | 2 |
| Example 15 | 30 | 25 | 75 | Sulfur | 3 | MBTS | 2 |
| Example 16 | 30 | 25 | 75 | Sulfur | 3 | MBTS | 2 |
| Example 17 | 30 | 15 | 85 | Sulfur | 3 | TBZTD | 1 |
| Example 18 | 30 | 25 | 75 | Sulfur | 3 | TBZTD | 1 |
| Example 19 | 30 | 30 | 70 | Sulfur | 3 | TBZTD | 1 |
| Example 20 | 30 | 40 | 60 | Sulfur | 3 | TBZTD | 1 |
| Example 21 | 30 | 25 | 75 | Sulfur | 3 | TBZTD | 1 |
| Example 22 | 30 | 25 | 75 | Sulfur/ZnO/MgO | 1/5/4 | ETU | 1 |
| Example 23 | 30 | 15 | 85 | Sulfur | 3 | TBZTD | 1 |
| Example 24 | 30 | 25 | 75 | Sulfur | 3 | TBZTD | 1 |
| Example 25 | 30 | 30 | 70 | Sulfur | 3 | TBZTD | 1 |
| Example 26 | 30 | 40 | 60 | Sulfur | 3 | TBZTD | 1 |

TABLE 6-2

| | Unvulcanized rubber dispersion | Unvulcanized rubber composition | | Vulcanizing agent | | Vulcanization aid | |
|---|---|---|---|---|---|---|---|
| | Rotation speed | Domain | Matrix | | | | |
| | rpm | phr | phr | Type | phr | Type | phr |
| Example 27 | 30 | 25 | 75 | Sulfur | 3 | TBZTD | 1 |
| Example 28 | 30 | 25 | 75 | Sulfur | 3 | TBZTD | 1 |
| Example 29 | 30 | 25 | 75 | Sulfur | 3 | TET | 3 |
| Example 30 | 20 | 25 | 75 | Sulfur | 3 | TET | 3 |
| Example 31 | 30 | 25 | 75 | Sulfur | 3 | TBZTD | 3 |
| Example 32 | 30 | 25 | 75 | Sulfur | 3 | TBZTD | 3 |
| Example 33 | 30 | 25 | 75 | Sulfur | 3 | TBZTD | 1 |
| Example 34 | 30 | 25 | 75 | Sulfur/ZnO/MgO | 1/5/4 | ETU | 1 |
| Example 35 | 30 | 25 | 75 | Sulfur | 3 | TBZTD | 1 |
| Example 36 | 30 | 25 | 75 | Sulfur | 3 | TBZTD | 1 |
| Example 37 | 30 | 25 | 75 | Sulfur | 3 | TBZTD | 1 |
| Example 38 | 30 | 25 | 75 | Sulfur | 3 | TBZTD | 1 |

TABLE 6-3

| Abbreviated name of material | | Material name | Product name | Manufacturer's name |
|---|---|---|---|---|
| Butyl | Butyl065 | Butyl rubber | JSR Butyl 065 | JSR Cooperation |
| BR | T0700 | Polybutadiene rubber | JSR T0700 | JSR Cooperation |
| ECO | ON301 | Epichlorohydrin rubber | EPION ON301 | Osaka Soda Co., Ltd. |
| EPDM | Esplene301A | Ethylene propylene diene rubber | Esprene301A | Sumitomo Chemical Co., Ltd |
| EPDM | Esplene505A | Ethylene propylene diene rubber | Esprene505A | Sumitomo Chemical Co., Ltd |
| NBR | DN401LL | Acrylonitrile butadiene rubber | Nipol DN401LL | Zeon Corporation |
| NBR | N230SV | Acrylonitrile butadiene rubber | NBR N230SV | JSR Cooperation |
| NBR | N230S | Acrylonitrile butadiene rubber | NBR N230S | JSR Cooperation |
| NBR | N232SH | Acrylonitrile butadiene rubber | NBR N232SH | JSR Cooperation |
| SBR | T2003 | Styrene butadiene rubber | TUFDENE 2003 | Asahi Kasei Corporation |
| SBR | T1000 | Styrene butadiene rubber | TUFDENE 1000 | Asahi Kasei Corporation |
| SBR | T2000R | Styrene butadiene rubber | TUFDENE 2000R | Asahi Kasei Corporation |
| SBR | T2100R | Styrene butadiene rubber | TUFDENE 2100R | Asahi Kasei Corporation |

TABLE 6-3-continued

| Abbreviated name of material | | Material name | Product name | Manufacturer's name |
|---|---|---|---|---|
| CR | B31 | Chloroprene rubber | SKYPRENE B31 | Tosoh Corporation |
| SBR | A303 | Styrene butadiene rubber | ASAPRENE 303 | ASAHI KASEI Corporation |
| Polyvinyl butyral resin | | Polyvinyl butyral resin | Mowital B30H | Kuraray Co., Ltd. |

TABLE 6-4

| Abbreviated name of material | Material name | Product name | Manufacturer's name |
|---|---|---|---|
| #7360 | Electro-conductive carbon black | TOKA BLACK 7360SB | Tokai Carbon Co., Ltd. |
| #5500 | Electro-conductive carbon black | TOKA BLACK 5500 | Tokai Carbon Co., Ltd. |
| Ketjen | Electro-conductive carbon black | CARBON ECP | Lion Specialty Chemicals Co., Ltd. |
| MONARCH880 | Electro-conductive carbon black | MONARCH880 | CABOT Corporation |
| LV | Ion conductive material | LV70 | ADEKA |

TABLE 6-5

| Abbreviated name of material | Material name | Product name | Manufacturer's name |
|---|---|---|---|
| Sulfur | Sulfur | SULFAX PMC | Tsurumi Chemical Industry Co., Ltd. |
| MBTS | Dibenzothiazyl disulfide | SANCELER DM | Sanshin Chemical Industry Co., Ltd. |
| TBZTD | Tetrabenzyl thiuram disulfide | SANCELER TBZTD | Sanshin Chemical Industry Co., Ltd. |
| TET | Tetraethyl thiuram disulfide | SANCELER TET-G | Sanshin Chemical Industry Co., Ltd. |
| ETU | 2-imidazoline-2-thiol | SANCELER 22-C | Sanshin Chemical Industry Co., Ltd. |

4. Evaluation as Developing Roller

The following evaluations were performed on the obtained developing rollers according to Examples 1 to 38.

[4-1] Image (Fog) Evaluation ("Fog Image")

Developing rollers according to each of Examples and Comparative Examples was loaded in a magenta toner cartridge for a laser printer (product name: HP Color Laserjet Enterprise CP4515dn, produced by HP Inc.) having a configuration illustrated in FIG. 10 to evaluate a fog image. In order to evaluate the fog image in a high-speed process, the laser printer was modified so that the number of output sheets per unit time is 50 sheets/minute in A4 size paper, which are more than original output sheets.

The magenta toner cartridge loaded with each developing roller was loaded in the laser printer, installed in a high temperature and high humidity environment of a temperature of 32° C. and a relative humidity of 85%, and then left for six hours. Next, an image (hereinafter, also referred to as an "E letter image") in which a letter "E" of an alphabet with a size of 4 points is printed so that a coverage rate is 1% with respect to an area of A4 size paper was continuously output on a predetermined number of copy sheets. Thereafter, a white solid image was output on a new copy sheet, and the printer was stopped during the output of the white solid image. At this time, a toner adhered on a photosensitive member was peeled off with a tape (product name: CT18, Nichiban Co., Ltd.), and a reflectance was measured with a reflection densitometer (product name: TC-6DS/A, produced by Tokyo Denshoku Co., Ltd.). A decrease amount (%) of the reflectance with respect to a reflectance of the tape was measured, and the measured decrease amount was used as the fog value. An evaluation was performed according to the following criteria based on these fog values.

Rank A: A fog value is less than 1.5%.

Rank B: A fog value is 1.5% or more and less than 3.0%.

Rank C: A fog value is 3.0% or more and less than 5.0%.

Rank D: A fog value is 5.0% or more.

[4-2] Toner Charged Quantity

A charged quantity was measured in order to evaluate an electric charge imparting property of the developing roller to the toner.

At the time of evaluating the fog image described above, the toner carried on a portion having a narrow range of a portion of the developing roller sandwiched between a toner regulation blade and a photosensitive member abutment position was sucked and collected by a metal cylindrical tube and a cylindrical filter. At that time, an amount of electric charges accumulated in a capacitor through the metal cylindrical tube and a mass of the sucked toner were measured. It should be noted that the measurement of the amount of electric charges was performed using a measuring instrument (product name: 8252) produced by ADC Corporation. Then, an amount (μC/g) of electric charges per unit mass was calculated from these values. In a case of using a negatively chargeable toner, a sign of an amount of electric charges per unit mass is negative, and it can be said that the larger the absolute value, the higher the charge imparting property of the developing roller. The value obtained by the measurement was used as the toner charged quantity.

[4-3] Toner Charged Quantity Distribution

A charged quantity distribution was measured in order to evaluate the spread of the charged quantity of the toner.

The charged quantity distribution was measured using E-spart Analyzer Model EST-III (produced by Hosokawa Micron Corporation). Otherwise, the charged quantity distribution was measured in a manner similar to that of the measurement of the charged quantity of the toner. It should be noted that the number of measurement particles was about 3000. A standard deviation was calculated from the obtained charged quantity distribution, and the obtained value was used as an initial charged quantity distribution of the toner.

The evaluation results are shown in Table 8-1 and Table 8-2.

TABLE 7-1

| | Electro-conductive support 10^−2-10^0 Hz Impedance | Presence or absence of sea-island structure | 10^−2-10^0 Hz Impedance Ω | 10^6-10^7 Hz Inclination — | Matrix domain Resistance ratio — | Domain volume fraction % | Matrix Distance μm | Matrix Volume resistivity Ωcm | Domain Volume resistivity Ωcm |
|---|---|---|---|---|---|---|---|---|---|
| Example 1 | 9.08E−03 | Present | 6.95E+08 | −0.34 | 15.5 | 15.3 | 0.22 | 7.13E+16 | 2.33E+01 |
| Example 2 | 5.95E−03 | Present | 2.64E+06 | −0.33 | 15.7 | 15.2 | 0.25 | 5.22E+16 | 1.01E+01 |
| Example 3 | 3.32E−03 | Present | 9.66E+08 | −0.35 | 15.1 | 25.5 | 0.44 | 3.04E+16 | 2.51E+01 |
| Example 4 | 8.27E−03 | Present | 1.15E+09 | −0.37 | 15.0 | 29.5 | 0.89 | 8.16E+16 | 7.91E+01 |
| Example 5 | 6.80E−03 | Present | 2.38E+08 | −0.43 | 16.0 | 41.4 | 1.18 | 6.62E+16 | 6.63E+00 |
| Example 6 | 7.98E−03 | Present | 3.77E+08 | −0.38 | 14.4 | 25.0 | 0.23 | 9.58E+15 | 3.94E+01 |
| Example 7 | 7.99E−03 | Present | 1.44E+08 | −0.32 | 12.8 | 26.5 | 0.24 | 1.47E+14 | 2.31E+01 |
| Example 8 | 3.88E−03 | Present | 5.45E+07 | −0.31 | 11.8 | 26.7 | 0.22 | 4.69E+13 | 6.92E+01 |
| Example 9 | 4.24E−03 | Present | 1.77E+07 | −0.30 | 11.2 | 24.9 | 0.22 | 9.02E+12 | 6.15E+01 |
| Example 10 | 3.66E−03 | Present | 6.34E+08 | −0.38 | 13.0 | 24.6 | 0.25 | 7.97E+15 | 8.45E+02 |
| Example 11 | 6.52E−03 | Present | 6.92E+08 | −0.45 | 11.5 | 25.8 | 0.23 | 2.21E+15 | 7.06E+03 |
| Example 12 | 8.69E−03 | Present | 3.21E+06 | −0.38 | 8.6 | 26.7 | 0.24 | 3.00E+10 | 7.88E+01 |
| Example 13 | 3.05E−03 | Present | 3.90E+08 | −0.79 | 13.0 | 26.6 | 0.24 | 7.79E+16 | 7.06E+03 |
| Example 14 | 1.86E−03 | Present | 2.03E+04 | −0.78 | 3.5 | 25.7 | 0.26 | 2.76E+07 | 8.83E+03 |
| Example 15 | 4.06E−03 | Present | 6.51E+08 | −0.79 | 14.5 | 27.0 | 0.23 | 6.53E+15 | 1.98E+01 |
| Example 16 | 7.01E−03 | Present | 3.60E+08 | −0.80 | 12.0 | 26.1 | 0.21 | 8.45E+15 | 7.91E+03 |
| Example 17 | 9.23E−03 | Present | 3.38E+08 | −0.37 | 13.9 | 15.0 | 0.23 | 8.39E+14 | 1.12E+01 |
| Example 18 | 3.57E−03 | Present | 6.42E+08 | −0.37 | 12.5 | 27.0 | 0.55 | 1.64E+14 | 5.41E+01 |
| Example 19 | 5.48E−03 | Present | 2.14E+08 | −0.41 | 14.8 | 31.1 | 0.91 | 8.21E+15 | 1.21E+01 |
| Example 20 | 1.42E−04 | Present | 2.74E+08 | −0.52 | 15.1 | 42.5 | 1.1 | 6.42E+15 | 4.57E+00 |
| Example 21 | 1.97E−03 | Present | 4.98E+08 | −0.50 | 12.2 | 26.0 | 0.21 | 6.40E+15 | 3.73E+03 |
| Example 22 | 9.33E−03 | Present | 3.54E+05 | −0.53 | 7.2 | 26.8 | 0.22 | 1.69E+08 | 1.05E+01 |

TABLE 7-2

| | Electro-conductive support 10^−2-10^0 Hz Impedance | Presence or absence of sea-island structure | 10^−2-10^0 Hz Impedance Ω | 10^−6-10^7 Hz Inclination — | Matrix domain Resistance ratio — | Domain volume fraction % | Matrix Distance μm | Matrix Volume resistivity Ωcm | Domain Volume resistivity Ωcm |
|---|---|---|---|---|---|---|---|---|---|
| Example 23 | 9.94E−03 | Present | 6.18E+08 | −0.41 | 14.4 | 15.3 | 0.26 | 7.41E+15 | 3.06E+01 |
| Example 24 | 4.88E−03 | Present | 2.42E+08 | −0.46 | 13.9 | 26.7 | 0.23 | 1.37E+15 | 1.55E+01 |
| Example 25 | 7.22E−03 | Present | 5.28E+08 | −0.54 | 14.0 | 31.5 | 0.24 | 8.07E+15 | 8.63E+01 |
| Example 26 | 4.24E−04 | Present | 3.04E+08 | −0.65 | 12.6 | 42.6 | 0.22 | 1.55E+14 | 4.29E+01 |
| Example 27 | 6.37E−03 | Present | 5.62E+08 | −0.56 | 14.3 | 24.9 | 0.23 | 9.86E+15 | 5.23E+01 |
| Example 28 | 9.96E−03 | Present | 6.66E+08 | −0.70 | 11.8 | 26.0 | 0.24 | 5.00E+15 | 8.38E+03 |
| Example 29 | 4.50E−03 | Present | 1.27E+09 | −0.41 | 14.5 | 26.8 | 1.9 | 2.95E+15 | 9.18E+00 |
| Example 30 | 5.05E−03 | Present | 9.17E+10 | −0.46 | 14.1 | 25.8 | 3.04 | 9.77E+15 | 7.22E+01 |
| Example 31 | 6.32E−03 | Present | 1.41E+08 | −0.60 | 14.9 | 26.5 | 5.7 | 3.72E+15 | 5.23E+00 |
| Example 32 | 1.18E−03 | Present | 3.12E+08 | −0.62 | 11.7 | 24.8 | 6.09 | 3.72E+15 | 7.25E+03 |
| Example 33 | 6.96E−03 | Present | 3.53E+08 | −0.75 | 14.1 | 24.6 | 5.6 | 6.27E+15 | 5.12E+01 |
| Example 34 | 6.86E−03 | Present | 1.42E+06 | −0.80 | 4.8 | 25.9 | 5.67 | 5.64E+08 | 8.28E+03 |
| Example 35 | 2.50E−02 | Present | 7.93E+06 | −0.37 | 14.3 | 26.7 | 0.22 | 4.27E+15 | 1.94E+01 |
| Example 36 | 1.50E+00 | Present | 3.98E+08 | −0.37 | 14.0 | 25.4 | 0.22 | 2.46E+15 | 2.50E+01 |
| Example 37 | 9.80E+00 | Present | 5.80E+08 | −0.40 | 13.4 | 26.8 | 0.21 | 1.62E+15 | 5.89E+01 |
| Example 38 | 2.30E+00 | Present | 5.21E+08 | −0.38 | 13.6 | 26.9 | 0.22 | 3.12E+15 | 7.56E+01 |

TABLE 8-1

| | Inter-domain distance Dm μm | Domain: Requirement (B2) cross-sectional area ratio (average value) % | Domain: Number (%) of domains satisfying requirement (B2) % | Domain: Perimeter A μm | Domain: Envelope perimeter B μm | Domain: A/B (average value) — | Domain: Number (%) of domains satisfying requirement (B3) |
|---|---|---|---|---|---|---|---|
| Example 1 | 0.22 | 31 | 90 | 0.85 | 0.84 | 1.01 | 85 |
| Example 2 | 0.25 | 26 | 84 | 0.91 | 0.90 | 1.01 | 87 |
| Example 3 | 0.44 | 38 | 97 | 1.61 | 1.59 | 1.01 | 88 |
| Example 4 | 0.89 | 30 | 94 | 1.80 | 1.78 | 1.01 | 85 |
| Example 5 | 1.18 | 37 | 97 | 3.37 | 3.24 | 1.04 | 92 |
| Example 6 | 0.23 | 32 | 95 | 0.83 | 0.83 | 1.01 | 90 |

TABLE 8-1-continued

| | | | | | | | |
|---|---|---|---|---|---|---|---|
| Example 7 | 0.24 | 40 | 94 | 0.74 | 0.73 | 1.01 | 90 |
| Example 8 | 0.22 | 36 | 97 | 0.81 | 0.79 | 1.02 | 89 |
| Example 9 | 0.22 | 36 | 96 | 0.84 | 0.81 | 1.04 | 98 |
| Example 10 | 0.25 | 36 | 91 | 0.91 | 0.88 | 1.04 | 96 |
| Example 11 | 0.23 | 28 | 83 | 0.92 | 0.90 | 1.02 | 84 |
| Example 12 | 0.24 | 35 | 92 | 0.96 | 0.94 | 1.02 | 85 |
| Example 13 | 0.24 | 30 | 89 | 0.74 | 0.71 | 1.04 | 85 |
| Example 14 | 0.26 | 31 | 85 | 0.92 | 0.89 | 1.03 | 91 |
| Example 15 | 0.23 | 47 | 87 | 0.99 | 0.98 | 1.01 | 85 |
| Example 16 | 0.21 | 22 | 81 | 0.81 | 0.79 | 1.02 | 91 |
| Example 17 | 0.23 | 32 | 85 | 3.91 | 3.83 | 1.02 | 88 |
| Example 18 | 0.55 | 31 | 84 | 5.54 | 5.32 | 1.04 | 95 |
| Example 19 | 0.91 | 30 | 80 | 6.33 | 6.27 | 1.01 | 89 |
| Example 20 | 1.1 | 29 | 82 | 6.07 | 5.83 | 1.04 | 96 |
| Example 21 | 0.21 | 21 | 82 | 4.87 | 4.73 | 1.03 | 92 |
| Example 22 | 0.22 | 30 | 82 | 4.39 | 4.35 | 1.01 | 83 |

| | Domain Number of cubes satisfying requirement (B1) Number | Electro-conductive particle Area ratio μ % | σ — | μ/σ — | Evaluation result Toner charged quantity μC/g | Toner charged quantity distribution | Fog image — |
|---|---|---|---|---|---|---|---|
| Example 1 | 9 | 31 | 137 | 0.23 | −42 | 2.9 | A |
| Example 2 | 9 | 26 | 183 | 0.14 | −46 | 2.2 | A |
| Example 3 | 9 | 38 | 343 | 0.11 | −47 | 2.5 | A |
| Example 4 | 9 | 30 | 173 | 0.17 | −45 | 2.6 | A |
| Example 5 | 9 | 37 | 371 | 0.10 | −40 | 3.0 | A |
| Example 6 | 9 | 32 | 158 | 0.20 | −42 | 2.9 | A |
| Example 7 | 9 | 40 | 366 | 0.11 | −44 | 2.7 | A |
| Example 8 | 9 | 36 | 360 | 0.10 | −46 | 2.5 | A |
| Example 9 | 9 | 36 | 198 | 0.18 | −44 | 2.5 | A |
| Example 10 | 9 | 36 | 324 | 0.11 | −43 | 2.6 | A |
| Example 11 | 9 | 28 | 201 | 0.14 | −42 | 2.7 | A |
| Example 12 | 9 | 35 | 182 | 0.19 | −43 | 2.4 | A |
| Example 13 | 9 | 30 | 156 | 0.19 | −36 | 3.8 | C |
| Example 14 | 9 | 31 | 307 | 0.10 | −38 | 3.6 | C |
| Example 15 | 7 | 47 | 239 | 0.20 | −38 | 3.4 | C |
| Example 16 | 7 | 22 | 358 | 0.06 | −40 | 3.7 | C |
| Example 17 | 9 | 32 | 161 | 0.20 | −40 | 2.9 | A |
| Example 18 | 9 | 31 | 175 | 0.18 | −39 | 2.4 | A |
| Example 19 | 9 | 30 | 156 | 0.19 | −38 | 2.9 | A |
| Example 20 | 8 | 29 | 179 | 0.16 | −38 | 3.2 | B |
| Example 21 | 9 | 21 | 151 | 0.14 | −42 | 3.3 | B |
| Example 22 | 9 | 30 | 218 | 0.14 | −39 | 3.3 | B |

TABLE 8-2

| | | Domain | | | | | |
|---|---|---|---|---|---|---|---|
| | Inter-domain distance Dm μm | Requirement (B2) cross-sectional area ratio (average value) % | Number (%) of domains satisfying requirement (B2) % | Perimeter A μm | Envelope perimeter B μm | A/B — | Number (%) of domains satisfying requirement (B3) % |
| Example 23 | 0.26 | 29 | 86 | 8.35 | 8.27 | 1.01 | 88 |
| Example 24 | 0.23 | 30 | 85 | 8.79 | 8.45 | 1.04 | 94 |
| Example 25 | 0.24 | 30 | 87 | 8.74 | 8.57 | 1.02 | 90 |
| Example 26 | 0.22 | 31 | 85 | 8.33 | 8.16 | 1.02 | 89 |
| Example 27 | 0.23 | 31 | 87 | 18.45 | 17.91 | 1.03 | 92 |
| Example 28 | 0.24 | 24 | 83 | 17.77 | 17.42 | 1.02 | 91 |
| Example 29 | 1.90 | 42 | 97 | 0.81 | 0.79 | 1.02 | 90 |
| Example 30 | 3.04 | 45 | 96 | 0.96 | 0.93 | 1.03 | 86 |
| Example 31 | 5.70 | 24 | 87 | 0.76 | 0.75 | 1.01 | 82 |
| Example 32 | 6.09 | 33 | 82 | 1.00 | 0.99 | 1.01 | 81 |
| Example 33 | 5.60 | 35 | 89 | 17.26 | 16.76 | 1.03 | 87 |
| Example 34 | 5.67 | 19 | 76 | 15.50 | 15.05 | 1.03 | 91 |
| Example 35 | 0.22 | 31 | 90 | 4.50 | 4.32 | 1.04 | 93 |
| Example 36 | 0.22 | 34 | 91 | 4.42 | 4.29 | 1.03 | 87 |
| Example 37 | 0.21 | 34 | 88 | 4.44 | 4.27 | 1.04 | 87 |
| Example 38 | 0.22 | 32 | 89 | 4.82 | 4.73 | 1.02 | 94 |

TABLE 8-2-continued

| | Domain | | | | Evaluation result | | |
|---|---|---|---|---|---|---|---|
| | Number of cubes satisfying requirement (B1) Number | Electro-conductive particle Area ratio μ % | σ — | μ/σ — | Toner charged quantity μC/g | Toner charged quantity distribution — | Fog image — |
| Example 23 | 9 | 29 | 222 | 0.13 | −39 | 2.9 | A |
| Example 24 | 9 | 30 | 136 | 0.22 | −40 | 2.9 | A |
| Example 25 | 9 | 30 | 186 | 0.16 | −42 | 3.1 | B |
| Example 26 | 9 | 31 | 279 | 0.11 | −38 | 3.2 | B |
| Example 27 | 8 | 31 | 164 | 0.19 | −42 | 3.1 | B |
| Example 28 | 8 | 24 | 182 | 0.13 | −42 | 3.1 | B |
| Example 29 | 9 | 42 | 337 | 0.12 | −41 | 2.6 | A |
| Example 30 | 9 | 45 | 338 | 0.13 | −38 | 3.0 | A |
| Example 31 | 9 | 24 | 173 | 0.14 | −38 | 3.4 | B |
| Example 32 | 9 | 33 | 141 | 0.23 | −39 | 3.2 | B |
| Example 33 | 8 | 35 | 267 | 0.13 | −36 | 3.8 | C |
| Example 34 | 7 | 19 | 281 | 0.07 | −37 | 3.8 | C |
| Example 35 | 9 | 31 | 205 | 0.15 | −40 | 2.7 | A |
| Example 36 | 9 | 34 | 306 | 0.11 | −39 | 2.4 | A |
| Example 37 | 9 | 34 | 137 | 0.25 | −39 | 2.6 | A |
| Example 38 | 9 | 32 | 265 | 0.12 | −41 | 2.6 | A |

Comparative Example 1

Respective materials were mixed with each other by amounts shown in Table 9 by a pressurizing kneader to obtain a masterbatch. As a mixer, a 6 liter pressure kneader (product name: TD6-15MDX, produced by Toshin Co.) was used. As mixing conditions, a packing factor was 70 vol %, a rotation speed of a blade was 30 rpm, and a mixing time was 16 minutes.

The present material was used as a rubber composition for molding a developing roller, and then, a developing roller of Comparative Example 1 was obtained in a manner similar to that of Example 1.

TABLE 9

| | Raw material name | Mixing amount (parts by mass) |
|---|---|---|
| Raw material rubber | NBR (Product name: N230SV; produced by JSR Corporation) | 100 (Solid content) |
| Vulcanizing agent | Sulfur | 3 |
| Electro-conductive agent | Ion conductive agent (Product name: ADEKA CIZER LV-70, produced by ADEKA Corporation) | 3 |
| Vulcanization aid | Tetrabenzyl thiuram disulfide (Product name: TBZTD, produced by Sanshin Chemical Industry Co., Ltd.) | 1 |

Comparative Example 2

A developing roller of Comparative Example 2 was obtained in a manner similar to that of Comparative Example 1 except that a rubber composition for molding a developing roller was changed to that illustrated in Table 10.

TABLE 10

| | Raw material name | Mixing amount (parts by mass) |
|---|---|---|
| Raw material rubber | NBR (Product name: N230SV, produced by JSR Corporation) | 100 |
| Electro-conductive particle | Carbon black (Product name: TOKA BLACK #7360, produced by Tokai Carbon Co., Ltd.) | 50 |
| Vulcanizing agent | Sulfur | 3 |
| Vulcanization aid | Tetrabenzyl thiuram disulfide (Product name: TBZTD, produced by Sanshin Chemical Industry Co., Ltd.) | 1 |

Comparative Example 3

Respective materials were mixed with each other by amounts shown in Table 11 by a pressurizing kneader to obtain an unvulcanized domain composition. As a mixer, a 6 liter pressure kneader (product name: TD6-15MDX, produced by Toshin Co.) was used. As mixing conditions, a packing factor was 70 vol %, a rotation speed of a blade was 30 rpm, and a mixing time was 16 minutes.

TABLE 11

| | Raw material name | Mixing amount (parts by mass) |
|---|---|---|
| Raw material rubber | NBR (Product name: N230SV, produced by JSR Corporation) | 100 |
| Electro-conductive particle | Carbon black (Product name: Ketjenblack EC300J, produced by Lion Specialty Chemicals Co., Ltd.) | 10 |
| Vulcanization acceleration aid | Zinc oxide (Product name: Zinc White, produced by Sakai Chemical Industry Co., Ltd.) | 5 |

TABLE 11-continued

| | Raw material name | Mixing amount (parts by mass) |
|---|---|---|
| Processing aid | Zinc stearate (Product name: SZ-2000, produced by Sakai Chemical Industry Co., Ltd.) | 2 |

Next, respective materials were mixed with each other by amounts shown in Table 12 by a pressurizing kneader to obtain an unvulcanized matrix composition. As a mixer, a 6 liter pressure kneader (product name: TD6-15MDX, produced by Toshin Co.) was used. As mixing conditions, a packing factor was 70 vol %, a rotation speed of a blade was 30 rpm, and a mixing time was 16 minutes.

TABLE 12

| | Raw material name | Mixing amount (parts by mass) |
|---|---|---|
| Raw material rubber | Epichlorohydrin rubber (Product name: EPION ON301, produced by Daiso Corporation) | 100 |
| Electro-conductive agent | Ion conductive agent (Product name: ADEKA CIZER LV-70, produced by ADEKA Corporation) | 3 |
| Filler | Calcium carbonate (Product name: NANOX#30, manufactured by Maruo Calcium Co., Ltd.) | 70 |
| Vulcanization acceleration aid | Zinc oxide (Product name: Zinc White, manufactured by Sakai Chemical Industry Co., Ltd.) | 7 |
| Processing aid | Zinc stearate (Product name: SZ-2000, manufactured by Sakai Chemical Industry Co., Ltd.) | 2.8 |

Next, respective materials were mixed with each other by amounts shown in Table 13 by a pressurizing kneader to obtain an unvulcanized rubber composition. As a mixer, a 6 liter pressure kneader (product name: TD6-15MDX, produced by Toshin Co.) was used. As mixing conditions, a packing factor was 70 vol %, a rotation speed of a blade was 30 rpm, and a mixing time was 16 minutes.

TABLE 13

| | Raw material name | Mixing amount (parts by mass) |
|---|---|---|
| Raw material rubber | Unvulcanized domain composition | 20 |
| Raw material rubber | Unvulcanized matrix composition | 80 |

Next, respective materials were mixed with each other by amounts shown in Table 14 with an open roll to prepare a rubber composition for molding an electro-conductive member. As a mixer, an open roll having a roll diameter of 12 inches (0.30 m) was used. After cut-back at the left and the right was performed twenty times in total under mixing conditions in which a rotation speed of a front roll was 10 rpm, a rotation speed of a rear roll was 8 rpm, a roll clearance was 2 mm, tight milling was performed ten times under a mixing condition in which a roll clearance is 0.5 mm.

TABLE 14

| | Raw material name | Mixing amount (parts by mass) |
|---|---|---|
| Raw material rubber | Unvulcanized rubber composition | 100 |
| Vulcanizing agent | Sulfur (Product name: SULFAX PMC, manufactured by Tsurumi Chemical Industry Co., Ltd.) | 3 |
| Vulcanization aid | Tetrabenzyl thiuram disulfide (Product name: TBZTD, manufactured by Sanshin Chemical Industry Co., Ltd.) | 2 |

The present material was used as a rubber composition for molding a developing roller, and then, a developing roller of Comparative Example 3 was obtained in a manner similar to that of Example 1.

Comparative Examples 4 to 8 and Comparative Example 12

Developing rollers of Comparative Examples 4 to 8 and 12 were obtained in a manner similar to that of Comparative Example 3 except that raw materials, vulcanizing agents, and vulcanization aids of an electro-conductive support, a domain rubber, and a matrix rubber were changed to those shown in Tables 16 and 17.

Comparative Example 9

An elastic layer made of a hydrin rubber was formed in a manner similar to that of Comparative Example 1 except that a rubber composition for molding a developing roller was changed to those illustrated in Tables 16 and 17.

Next, materials of Table 15 were added to methanol: 1-butanol=3:1, and adjusted so that a solid content is 10 mass %.

Next, 210 g of the above mixed solution and 200 g of glass bead having an average particle diameter of 0.8 mm as a medium were mixed with each other in a glass bottle of 450 mL, and pre-dispersion was performed for 24 hours using a paint shaker disperser to obtain a paint for forming an electro-conductive resin layer.

The elastic layer made of the hydrin rubber was dipped in the paint for forming the electro-conductive resin layer and coated by a dipping method, with a longitudinal direction being a vertical direction. A dipping time of the dipping coating was 9 seconds, an initial speed of a pulling speed was 20 mm/sec, a final speed of the pulling speed was 2 mm/sec, and a speed was changed linearly with time during that time. The obtained coated product was air-dried at room temperature for 30 minutes, dried for 1 hour in a hot-air circulating dryer set at 90° C., and further dried for 1 hour in a hot-air circulating dryer set at 160° C. to obtain a developing roller of Comparative Example 9.

TABLE 15

| | Raw material name | Mixing amount (parts by mass) |
|---|---|---|
| Main agent 1 | Soluble polyamide (Product name: PA-100 produced by T&K TOKA Corporation) | 50 |
| Main agent 2 | Polyvinyl butyral (Product name: Mowital B30H produced by Kuraray Co., Ltd.) | 50 |

TABLE 15-continued

| | Raw material name | Mixing amount (parts by mass) |
|---|---|---|
| Electro-conductive particle | Carbon black (Product name: MONARCH880 produced by CABOT Corporation) | 25 |
| Additive | Modified dimethyl silicone oil (Product name: KF-640 produced by Shin-Etsu Silicones) | 0.2 |

Comparative Example 10

A developing roller of Comparative Example 10 was obtained in a manner similar to that of Comparative Example 1 except that a rubber composition for molding a developing roller was changed to those illustrated in Tables 16 and 17.

Comparative Example 11

A developing roller of Comparative Example 11 was obtained in a manner similar to that of Example 1 except that raw materials, vulcanizing agents, and vulcanization aids of an electro-conductive support and a matrix rubber were changed to those shown in Tables 16 and 17 and a raw material of a domain rubber was heated and vulcanized alone and then changed to freeze-pulverized rubber particles. In the present comparative example, since the electro-conductive rubber particles formed by the freeze pulverization, having a large size, and having anisotropy are dispersed, electro-conductive paths in the electro-conductive member are unevenly formed, which is synonymous with a state where thicknesses of the domains are large. As a result, an inclination of an impedance at a high frequency is −1.

Tables 18 and 19 illustrate results obtained by evaluating the developing rollers obtained in Comparative Examples 1 to 12 in a manner similar to that of Example 1.

TABLE 16

| | Electro-conductive support | | Unvulcanized domain rubber composition | | | | | | | |
|---|---|---|---|---|---|---|---|---|---|---|
| | | | Rubber | | | | Electro-conductive particle | | | |
| | Type | Electro-conductive surface | Type | Product name | SP value | Mooney viscosity | Type | phr | DBP | pH |
| Comparative Example 1 | SUS | Ni plating | — | — | — | — | — | — | — | — |
| Comparative Example 2 | SUS | Ni plating | — | — | — | — | — | — | — | — |
| Comparative Example 3 | SUS | Ni plating | NBR | N230SV | 19.2 | 122 | Ketjen | 10 | 360 | 9.0 |
| Comparative Example 4 | SUS | Ni plating | NBR | N230SV | 19.2 | 122 | #7360 | 60 | 87 | 7.5 |
| Comparative Example 5 | SUS | Ni plating | SBR | T2003 | 17 | 135 | — | — | — | — |
| Comparative Example 6 | SUS | Ni plating | BR | JSR T0700 | 17.1 | 132 | #7360 | 80 | 87 | 7.5 |
| Comparative Example 7 | SUS | Ni plating | BR | JSR T0700 | 17.1 | 132 | #7360 | 50 | 87 | 7.5 |
| Comparative Example 8 | SUS | Ni plating | NBR | N230SV | 19.2 | 122 | Ketjen | 20 | 360 | 9.0 |
| Comparative Example 9 | SUS | Hydrin rubber | — | — | — | — | — | — | — | — |
| Comparative Example 10 | SUS | CB dispersion rubber | — | — | — | — | — | — | — | — |
| Comparative Example 11 | SUS | Ni plating | BR | JSR T0700 | 17.1 | 133 | #7360 | 80 | 87 | 7.5 |
| Comparative Example 12 | SUS | Ni plating | SBR | T2003 | 17 | 135 | #7360 | 60 | 87 | 7.5 |

| | Unvulcanized matrix rubber composition | | | | | |
|---|---|---|---|---|---|---|
| | Type of rubber | | | | Additive | |
| | Type | Product name | SP value | Mooney viscosity | Type | phr |
| Comparative Example 1 | NBR | N230SV | 19.2 | 120 | LV | 3 |
| Comparative Example 2 | NBR | N230SV | 19.2 | 120 | #7360 | 50 |
| Comparative Example 3 | ECO | ON301 | 19.2 | 32 | LV | 3 |
| Comparative Example 4 | SBR | T2003 | 17 | 45 | #7360 | 20 |
| Comparative Example 5 | NBR | N230SV | 19.2 | 32 | #7360 | 60 |
| Comparative Example 6 | EPDM | Esplene505A | 16 | 47 | — | — |

TABLE 16-continued

| | | | | | | |
|---|---|---|---|---|---|---|
| Comparative Example 7 | EPDM | Esplene505A | 16 | 47 | — | — |
| Comparative Example 8 | SBR | T2003 | 17 | 45 | — | — |
| Comparative Example 9 | ECO | ON301 | 19.2 | 32 | LV | 3 |
| Comparative Example 10 | NBR | N230SV19.2 | 19.2 | 120 | #7360 | 50 |
| Comparative Example 11 | EPDM | Esplene505A | 16 | 47 | — | — |
| Comparative Example 12 | NBR | N230SV | 19.2 | 32 | — | — |

TABLE 17

| | Unvulcanized rubber dispersion | Unvulcanized rubber composition | | Vulcanizing agent | | Vulcanization aid | |
|---|---|---|---|---|---|---|---|
| | Rotation speed | Domain | Matrix | | | | |
| | rpm | phr | phr | Type | phr | Type | phr |
| Comparative Example 1 | — | 0 | 100 | Sulfur | 3 | TBZTD | 1 |
| Comparative Example 2 | — | 0 | 100 | Sulfur | 3 | TBZTD | 1 |
| Comparative Example 3 | 30 | 20 | 80 | Sulfur | 3 | TBZTD | 1 |
| Comparative Example 4 | 30 | 25 | 75 | Sulfur | 3 | TBZTD | 1 |
| Comparative Example 5 | 30 | 75 | 25 | Sulfur | 3 | TBZTD | 1 |
| Comparative Example 6 | 30 | 60 | 40 | Sulfur | 3 | MBTS (SANCELER DM) | 2 |
| Comparative Example 7 | 30 | 10 | 90 | Sulfur | 3 | MBTS (SANCELER DM) | 2 |
| Comparative Example 8 | 30 | 45 | 55 | Sulfur | 3 | TBZTD | 1 |
| Comparative Example 9 | — | 0 | 100 | Sulfur | 3 | TBZTD | 1 |
| Comparative Example 10 | — | 0 | 100 | Sulfur | 3 | TBZTD | 1 |
| Comparative Example 11 | 30 | 25 | 75 | Sulfur | 3 | MBTS (SANCELER DM) | 2 |
| Comparative Example 12 | 30 | 75 | 25 | Sulfur | 3 | TBZTD | 1 |

TABLE 18

| | Electro-conductive support 10^−2-10^0 Hz Impedance | Presence or absence of sea-island structure | 10^−2-10^0 Hz Impedance Ω | 10^−6-10^7 Hz Inclination — | Matrix domain Resistance ratio — | Matrix domain Blend ratio % | Matrix Distance μm | Matrix Volume resistivity Ωcm | Domain Volume resistivity Ωcm |
|---|---|---|---|---|---|---|---|---|---|
| Comparative Example 1 | 8.79E−03 | Absent | 2.10E+06 | −1 | — | — | — | — | — |
| Comparative Example 2 | 9.51E−03 | Absent | 3.10E+04 | −1 | — | — | — | — | — |
| Comparative Example 3 | 5.60E−03 | Present | 5.12E+06 | −1 | 3.9 | 19.7 | 0.21 | 1.44E+07 | 9.80E+02 |
| Comparative Example 4 | 5.20E−03 | Present | 6.15E+06 | −1 | −0.3 | 24.6 | 0.21 | 1.87E+07 | 9.56E+06 |
| Comparative Example 5 | 9.23E−03 | Present | 2.21E+04 | −1 | — | 24.9 | 0.21 | 9.18E+04 | 3.14E+14 |
| Comparative Example 6 | 5.50E−03 | Absent | 1.60E+05 | −1 | 13.8 | 59.9 | — | — | — |
| Comparative Example 7 | 1.56E−03 | Present | 2.16E+11 | −1 | 14.6 | 10.5 | 0.21 | 6.56E+15 | 7.51E+03 |
| Comparative Example 8 | 9.30E−03 | Present | 1.50E+02 | −0.7 | 14.0 | 48.2 | 0.21 | 7.61E+15 | 3.61E+01 |

TABLE 18-continued

| | Electro-conductive support 10^−2-10^0 Hz Impedance | Presence or absence of sea-island structure | 10^−2-10^0 Hz Impedance Ω | 10^−6-10^7 Hz Inclination — | Matrix domain Resistance ratio — | Matrix domain Blend ratio % | Matrix Distance μm | Matrix Volume resistivity Ωcm | Domain Volume resistivity Ωcm |
|---|---|---|---|---|---|---|---|---|---|
| Comparative Example 9 | 2.50E+06 | Present | 1.50E+06 | −1 | 14.4 | 41.9 | 0.21 | 8.70E+15 | 4.99E+01 |
| Comparative Example 10 | 2.10E+04 | Present | 2.40E+06 | −1 | 13.4 | 39.4 | 0.21 | 3.45E+14 | 8.20E−01 |
| Comparative Example 11 | 4.20E−03 | Present | 6.97E+04 | −0.9 | 15.6 | 25.0 | 11.2 | 9.27E+15 | 8.65E+01 |
| Comparative Example 12 | 8.66E−03 | Present | 1.80E+03 | −1 | 7.0 | 24.9 | 0.26 | 7.66E+08 | 7.79E+01 |

TABLE 19

| | Inter-domain distance Dm μm | Domain: Requirement (B2) cross-sectional area ratio (average value) % | Domain: Number (%) of domains satisfying requirement (B2) % | Domain: Perimeter A μm | Domain: Envelope perimeter B μm | Domain: A/B — | Domain: Number (%) of domains satisfying requirement (B3) % |
|---|---|---|---|---|---|---|---|
| Comparative Example 1 | — | — | — | — | — | — | — |
| Comparative Example 2 | — | — | — | — | — | — | — |
| Comparative Example 3 | 0.21 | 12 | 66 | 4.66 | 4.44 | 1.05 | 76 |
| Comparative Example 4 | 0.21 | 25 | 82 | 4.90 | 4.80 | 1.02 | 71 |
| Comparative Example 5 | 0.21 | — | — | 5.59 | 5.43 | 1.03 | 53 |
| Comparative Example 6 | — | — | — | — | — | — | — |
| Comparative Example 7 | 0.21 | 35 | 86 | 4.76 | 4.74 | 1.00 | 65 |
| Comparative Example 8 | 0.21 | 15 | 67 | 4.98 | 4.88 | 1.02 | 52 |
| Comparative Example 9 | 0.21 | 22 | 75 | 5.18 | 5.03 | 1.03 | 74 |
| Comparative Example 10 | 0.21 | 23 | 78 | 5.02 | 4.78 | 1.05 | 76 |
| Comparative Example 11 | 11.2 | 33 | 83 | 34.86 | 23.24 | 1.50 | 22 |
| Comparative Example 12 | 0.24 | 30 | 89 | 0.74 | 0.71 | 1.04 | 85 |

| | Domain Number of cubes satisfying requirement (B1) Number | Electro-conductive particle Area ratio μ % | Electro-conductive particle σ — | Electro-conductive particle μ/σ — | Evaluation result Toner charged quantity μC/g | Evaluation result Toner charged quantity distribution | Evaluation result Fog image — |
|---|---|---|---|---|---|---|---|
| Comparative Example 1 | — | — | — | — | −36 | 4.8 | D |
| Comparative Example 2 | — | — | — | — | −38 | 5.1 | D |
| Comparative Example 3 | 4 | 12 | 80 | 0.15 | −35 | 4.7 | D |
| Comparative Example 4 | 6 | 25 | 208 | 0.12 | −35 | 4.9 | D |
| Comparative Example 5 | 4 | — | — | — | −31 | 5.3 | D |
| Comparative Example 6 | — | — | — | — | −38 | 4.8 | D |
| Comparative Example 7 | 5 | 35 | 233 | 0.15 | −20 | 6.6 | D |
| Comparative Example 8 | 6 | 15 | 115 | 0.13 | −22 | 5.2 | D |
| Comparative Example 9 | 7 | 22 | 100 | 0.22 | −28 | 5.6 | D |

TABLE 19-continued

| | | | | | | | |
|---|---|---|---|---|---|---|---|
| Comparative Example 10 | 4 | 23 | 115 | 0.20 | −30 | 5.0 | D |
| Comparative Example 11 | 3 | 33 | 51 | 0.65 | −32 | 5.7 | D |
| Comparative Example 12 | 9 | 30 | 156 | 0.19 | −36 | 4.8 | D |

Since the developing rollers according to Examples 1 to 38 have the configuration of the present disclosure in the electro-conductive layer, a charged quantity distribution was sharp and a high-quality image with a very small fog value was obtained. On the other hand, in the developing rollers according to Comparative Examples 1 to 12 that do not have the electro-conductive layer according to the present disclosure, a charged quantity distribution was large and image quality was not good.

5. Evaluation as Developing Blade

<1. Development of Developing Blade>

Example 39

The unvulcanized rubber composition obtained in Example 2 was used. Here, a rubber sheet 1 having a corresponding thickness of 0.7 mm was obtained by treating the unvulcanized rubber composition at 160° C. for 10 minutes while pressing the unvulcanized rubber composition into a mold having a width of 250 mm, a length of 150 mm, and a thickness of 0.7 mm with a pressure press machine.

The rubber sheet 1 was cut into a width of 215 mm and a length of 12 mm, and was adhered to a sheet metal (having the same shape as that of a sheet metal used for a developing blade of an electrophotographic process cartridge to be described later) processed in advance so as to be attached to a predetermined cartridge using an adhesive to obtain a developing blade of Example 39. At this time, the developing blade was adhered to the sheet metal so that a length of a portion overlapping the sheet metal is 4.5 mm of 12 mm and the remaining portion of 7.5 mm protrudes from the sheet metal. It should be noted that an electro-conductive hot melt type adhesive was used as the adhesive.

2. Characteristic Evaluation

[2-1] Measurement of Inclination of Impedance

The measurement of the impedance according to the present disclosure was performed as follows.

First, as pretreatment, the developing blade was coated with a silver paste to form a measuring electrode. At this time, a rectangular electrode having a length of 213 mm was formed at a tip portion of 1 mm to 6 mm of a surface of the developing blade to which the sheet metal was not adhered, using a masking tape. Next, an electro-conductive wire was attached to the electrode using a silver paste, and an aluminum sheet was connected to a measuring electrode of an impedance measuring device (product name: Solartron 1260 and Solartron 1296, produced by Solartron Metrology).

The impedance was measured at an oscillation voltage of 1 Vpp, a direct current voltage of 10V, and a frequency of $1.0\times10^{-2}$ Hz to $1.0\times10^{7}$ Hz in an environment of a temperature of 23° C. and a relative humidity of 50% (measured at five points when a frequency changes by one digit) to obtain an absolute value of the impedance. Next, with respect to a measurement result, the absolute value of the impedance and an angular frequency (measurement frequency×2×π (the ratio of the circumference)) are log-log-plotted using spreadsheet software such as Excel, and an inclination at $1.0\times10^{6}$ Hz to $1.0\times10^{7}$ Hz was calculated. In addition, in the measurement of the inclination of the impedance, an impedance at $1.0\times10^{-2}$ Hz to $1.0\times10^{0}$ Hz was calculated.

Evaluations other than the impedance were measured in a manner similar to that of the developing roller.

Examples 40 to 44

Developing blades of Examples 40 to 44 were manufactured in a manner similar to that of Example 39 except that raw materials, vulcanizing agents, and vulcanization aids of an electro-conductive support, a domain rubber, and a matrix rubber were changed to those shown in Tables 20 and 21. It should be noted that "Zeospan" in Table 20 is a polyether synthetic rubber produced by Zeon Corporation.

Comparative Examples 13 to 17

Developing blades of Comparative Examples 13 to 17 were manufactured in a manner similar to that of Example 39 except that raw materials, vulcanizing agents, and vulcanization aids of an electro-conductive support, a domain rubber, and a matrix rubber were changed to those shown in Tables 22 and 23.

TABLE 20

| | Electro-conductive support | | Unvulcanized domain rubber composition | | | | | | | |
|---|---|---|---|---|---|---|---|---|---|---|
| | | | Rubber | | | | Electro-conductive particle | | | |
| | Type | Electro-conductive surface | Type | Product name | SP value | Mooney viscosity | Type | phr | DBP | pH |
| Example 39 | SUS | Ni plating | BR | JSR T0700 | 17.1 | 132 | #5500 | 55 | 155 | 6.0 |
| Example 40 | SUS | Ni plating | BR | JSR T0700 | 17.1 | 135 | #7360 | 75 | 87 | 7.5 |
| Example 41 | SUS | Ni plating | BR | JSR T0700 | 17.1 | 130 | #7360 | 85 | 87 | 7.5 |
| Example 42 | SUS | Ni plating | NBR | DN401LL | 17.4 | 125 | #7360 | 55 | 87 | 7.5 |
| Example 43 | SUS | Ni plating | NBR | N230S | 20 | 135 | #7360 | 35 | 87 | 7.5 |
| Example 44 | SUS | Ni plating | SBR | T2000R | 17 | 152 | #7360 | 55 | 87 | 7.5 |

TABLE 20-continued

| | Unvulcanized matrix rubber composition | | | | | |
|---|---|---|---|---|---|---|
| | Type of rubber | | | | Additive | |
| | Type | Product name | SP value | Mooney viscosity | Type | phr |
| Example 39 | EPDM | Esplene505A | 16 | 47 | — | — |
| Example 40 | SBR | T1000 | 16.8 | 45 | — | — |
| Example 41 | | Zeospan | 17.8 | 65 | — | — |
| Example 42 | SBR | T2003 | 17 | 45 | — | — |
| Example 43 | SBR | T2003 | 17 | 45 | — | — |
| Example 44 | NBR | DN401LL | 17.4 | 32 | — | — |

TABLE 21

| | Unvulcanized rubber dispersion | Unvulcanized rubber composition | | Vulcanizing agent | | Vulcanization aid | |
|---|---|---|---|---|---|---|---|
| | Rotation speed | Domain | Matrix | | | | |
| | rpm | phr | phr | Type | phr | Type | phr |
| Example 39 | 30 | 15 | 85 | Sulfur | 3 | MBTS | 2 |
| Example 40 | 30 | 25 | 75 | Sulfur | 3 | MBTS | 2 |
| Example 41 | 30 | 25 | 75 | Sulfur | 3 | MBTS | 2 |
| Example 42 | 30 | 25 | 75 | Sulfur | 3 | TBZTD | 1 |
| Example 43 | 30 | 25 | 75 | Sulfur | 3 | TBZTD | 1 |
| Example 44 | 30 | 25 | 75 | Sulfur | 3 | TBZTD | 1 |

TABLE 22

| | Electro-conductive support | | Unvulcanized domain rubber composition | | | | | | | |
|---|---|---|---|---|---|---|---|---|---|---|
| | | Electro- | Rubber | | | | Electro-conductive particle | | | |
| | Type | conductive surface | Type | Product name | SP value | Mooney viscosity | Type | phr | DBP | pH |
| Comparative Example 13 | SUS | Ni plating | NBR | N230SV | 19.2 | 120 | LV | 3 | — | — |
| Comparative Example 14 | SUS | Ni plating | NBR | N230SV | 19.2 | 120 | #7360 | 50 | 87 | 7.5 |
| Comparative Example 15 | SUS | Ni plating | NBR | N230SV | 19.2 | 122 | #7360 | 60 | 87 | 7.5 |
| Comparative Example 16 | SUS | Ni plating | BR | JSR T0700 | 17.1 | 132 | #7360 | 50 | 87 | 7.5 |
| Comparative Example 17 | SUS | Ni plating | NBR | N230SV | 19.2 | 122 | Ketjen | 20 | 360 | 9.0 |

| | Unvulcanized matrix rubber composition | | | | | |
|---|---|---|---|---|---|---|
| | Type of rubber | | | | Additive | |
| | Type | Product name | SP value | Mooney viscosity | Type | phr |
| Comparative Example 13 | — | — | — | — | — | — |
| Comparative Example 14 | — | — | — | — | — | — |
| Comparative Example 15 | SBR | T2003 | 17 | 45 | #7360 | 20 |
| Comparative Example 16 | EPDM | Esplene505A | 16 | 47 | — | — |
| Comparative Example 17 | SBR | T2003 | 17 | 45 | — | — |

TABLE 23

| | Unvulcanized rubber dispersion | Unvulcanized rubber composition | | Vulcanizing agent | | Vulcanization aid | |
|---|---|---|---|---|---|---|---|
| | Rotation speed | Domain | Matrix | | | | |
| | rpm | phr | phr | Type | phr | Type | phr |
| Comparative Example 13 | — | 100 | 0 | Sulfur | 3 | TBZTD | 1 |
| Comparative Example 14 | — | 100 | 0 | Sulfur | 3 | TBZTD | 1 |
| Comparative Example 15 | 30 | 25 | 75 | Sulfur | 3 | TBZTD | 1 |
| Comparative Example 16 | 30 | 10 | 90 | Sulfur | 3 | MBTS | 2 |
| Comparative Example 17 | 30 | 45 | 55 | Sulfur | 3 | TBZTD | 1 |

3. Evaluation as Developing Blade

[3-1] Image (Fog) Evaluation

The following evaluations were performed in order to confirm a persistent electric charge imparting property in a high speed process of the developing blade.

First, the developing blade was left in an environment of a temperature of 23° C. and a relative humidity of 50% for 48 hours for the purpose of being adapted to a measuring environment. Next, an electrophotographic laser printer (product name: Laserjet M608dn, produced by HP Inc.) was prepared as an electrophotographic apparatus. Then, a process cartridge mountable on the present electrophotographic apparatus was prepared, and the developing blades of Examples 39 to 44 and Comparative Examples 13 to 17 were individually incorporated as developing members of the process cartridge.

In order to evaluate the fog image in a high-speed process, the laser printer was modified so that the number of output sheets per unit time is 75 sheets/minute in A4 size paper, which are more than original output sheets. At that time, an output speed of a recording medium was 370 mm/sec and an image resolution was 1,200 dpi. In addition, it was left in an environment of a temperature of 23° C. and a relative humidity of 50% for 48 hours.

In the electrophotographic apparatus, a modification was performed so that a voltage could be applied to a voltage applying electrode to the developing blade by an external power supply, and a metal portion of the developing sleeve and a sheet metal of the developing blade were electrically connected to each other.

After the above process cartridge is left under an environment of a temperature of 30° C. and a relative humidity of 95% for four hours, a solid white image with a printing rate of 0% is output to recording paper under the same environment, and power of the color laser printer is turned off during printing. At this time, a charged quantity Q/M (μC/g) of the toner on the developing sleeve before passing through a nip between the photosensitive member and the developing sleeve is measured. Specific measurement of the charged quantity of the toner is similar to the evaluation of the developing roller. The operation described above is repeated three times for one developing sleeve to measure the charged quantity of the toner three times, and an arithmetic mean value from the measured charged quantities is calculated and used as a charged quantity of the toner at the time of using the developing blade of the present disclosure.

Further, at the time of stopping the printer while outputting the solid white image, a developer adhered to the photosensitive member before being transferred is peeled off with a tape, a reflectance $R_1$ of the tape is measured with a reflection densitometer (product name: TC-6DS/A, produced by Tokyo Denshoku Co., Ltd.), and a decrease amount "$R_0$-$R_1$" (%) in a reflectance of an unused tape with respect to a reflectance $R_0$ standard is calculated and used as a fog value. An evaluation was performed according to the following criteria based on these fog values.

Rank A: A fog value is less than 1.5%.

Rank B: A fog value is 1.5% or more and less than 3.0%.

Rank C: A fog value is 3.0% or more and less than 5.0%.

Rank D: A fog value is 5.0% or more.

[3-2] Toner Charged Quantity

A charged quantity was measured in order to evaluate an electric charge imparting property of the developing blade to the toner.

At the time of evaluating the fog image, the toner carried on a portion having a narrow range of a portion of the developing sleeve sandwiched between the developing blade and a photosensitive member abutment position was sucked and collected by a metal cylindrical tube and a cylindrical filter. At that time, an amount of electric charges accumulated in a capacitor through the metal cylindrical tube and a mass of the sucked toner were measured. It should be noted that the measurement of the amount of electric charges was performed using a measuring instrument (product name: 8252) produced by ADC Corporation. Then, an amount (μC/g) of electric charges per unit mass was calculated from these values. In a case of using a negatively chargeable toner, a sign of an amount of electric charges per unit mass is negative, and it can be said that the larger the absolute value, the higher the charge imparting property of the developing blade. The value obtained by the measurement was used as the charged quantity.

[3-3] Toner Charged Quantity Distribution

A charged quantity distribution was measured in order to evaluate the spread of the charged quantity of the toner.

The charged quantity distribution was measured using E-spart Analyzer Model EST-III (produced by Hosokawa Micron Corporation). Otherwise, the charged quantity distribution was measured in a manner similar to that of the measurement of the toner charged quantity. It should be noted that the number of measurement particles was about 3000. A standard deviation was calculated from the obtained charged quantity distribution, and the obtained value was used as an initial charged quantity distribution of the toner.

The evaluation results are shown in Tables 24 to 27.

TABLE 24

| | Electro-conductive support 10^-2-10^0 Hz Impedance | Presence or absence of sea-island structure | 10^-2-10^0 Hz Impedance Ω | 10^-6-10^7 Hz Inclination — | Matrix domain Resistance ratio — | Matrix domain Blend ratio % | Matrix Distance μm | Matrix Volume resistivity Ωcm | Domain Volume resistivity Ωcm |
|---|---|---|---|---|---|---|---|---|---|
| Example 39 | 5.95E-03 | Present | 2.64E+06 | -0.33 | 15.7 | 15.2 | 0.25 | 5.22E+16 | 1.01E+01 |
| Example 40 | 7.99E-03 | Present | 1.44E+08 | -0.32 | 12.8 | 26.5 | 0.24 | 1.47E+14 | 2.31E+01 |
| Example 41 | 1.86E-03 | Present | 2.03E+04 | -0.78 | 3.5 | 25.7 | 0.26 | 2.76E+07 | 8.83E+03 |
| Example 42 | 3.57E-03 | Present | 6.42E+08 | -0.37 | 12.5 | 27.0 | 0.55 | 1.64E+14 | 5.41E+01 |
| Example 43 | 9.96E-03 | Present | 6.66E+08 | -0.70 | 11.8 | 26.0 | 0.24 | 5.00E+15 | 8.38E+03 |
| Example 44 | 9.17E-03 | Present | 6.92E+05 | -0.67 | 7.2 | 25.1 | 5.9 | 7.38E+08 | 4.23E+01 |

TABLE 25

| | Domain | | | | | | |
|---|---|---|---|---|---|---|---|
| | Inter-domain distance Dm μm | Requirement (B2) cross-sectional area ratio (average value) % | Number (%) of domains satisfying requirement (B2) % | Perimeter A μm | Envelope perimeter B μm | A/B — | Number (%) of domains satisfying requirement (B3) % |
| Example 39 | 0.25 | 22 | 81 | 0.91 | 0.90 | 1.01 | 88 |
| Example 40 | 0.24 | 40 | 85 | 0.74 | 0.73 | 1.01 | 84 |
| Example 41 | 0.26 | 31 | 78 | 0.92 | 0.89 | 1.03 | 81 |
| Example 42 | 0.55 | 35 | 86 | 5.54 | 5.32 | 1.04 | 92 |
| Example 43 | 0.24 | 35 | 87 | 17.77 | 17.42 | 1.02 | 84 |
| Example 44 | 5.9 | 33 | 91 | 0.88 | 0.87 | 1.02 | 83 |

| | Domain Number of cubes satisfying requirement (B1) Number | Electro-conductive particle Area ratio μ % | Electro-conductive particle σ — | Electro-conductive particle μ/σ — | Evaluation result Toner charged quantity μC/g | Evaluation result Toner charged quantity distribution | Evaluation result Fog image — |
|---|---|---|---|---|---|---|---|
| Example 39 | 8 | 22 | 183 | 0.12 | -46 | 2.2 | A |
| Example 40 | 9 | 40 | 366 | 0.11 | -44 | 2.7 | A |
| Example 41 | 7 | 31 | 307 | 0.10 | -38 | 3.6 | C |
| Example 42 | 9 | 35 | 175 | 0.20 | -39 | 2.4 | A |
| Example 43 | 7 | 35 | 182 | 0.19 | -42 | 3.1 | B |
| Example 44 | 7 | 33 | 297 | 0.11 | -37 | 3.3 | B |

TABLE 26

| | Electro-conductive support 10^-2-10^0 Hz Impedance | Presence or absence of sea-island structure | 10^-2-10^0 Hz Impedance Ω | 10^-6-10^7 Hz Inclination — | Matrix domain Resistance ratio — | Matrix domain Blend ratio % | Matrix Distance μm | Matrix Volume resistivity Ωcm | Domain Volume resistivity Ωcm |
|---|---|---|---|---|---|---|---|---|---|
| Comparative Example 13 | 8.79E-03 | Absent | 2.10E+06 | -1 | — | — | — | — | — |
| Comparative Example 14 | 9.51E-03 | Absent | 3.10E+04 | -1 | — | — | — | — | — |
| Comparative Example 15 | 5.20E-03 | Present | 6.15E+06 | -1 | -0.3 | 24.6 | 0.21 | 1.87E+07 | 9.56E+06 |
| Comparative Example 16 | 1.56E-03 | Present | 2.16E+11 | -1 | 14.6 | 10.5 | 0.21 | 6.56E+15 | 7.51E+03 |
| Comparative Example 17 | 9.30E-03 | Present | 1.50E+02 | -0.7 | 14.0 | 48.2 | 0.21 | 7.61E+15 | 3.61E+01 |

TABLE 27

| | Inter-domain distance Dm μm | Domain: Requirement (B2) cross-sectional area ratio (average value) % | Domain: Number (%) of domains satisfying requirement (B2) % | Domain: Perimeter A μm | Domain: Envelope perimeter B μm | Domain: A/B — | Domain: Number (%) of domains satisfying requirement (B3) % |
|---|---|---|---|---|---|---|---|
| Comparative Example 13 | — | — | — | — | — | — | — |
| Comparative Example 14 | — | — | — | — | — | — | — |
| Comparative Example 15 | 0.21 | 25 | 76 | 4.90 | 4.80 | 1.02 | 70 |
| Comparative Example 16 | 0.21 | 16 | 44 | 4.76 | 4.74 | 1.00 | 56 |
| Comparative Example 17 | 0.21 | 15 | 38 | 4.98 | 4.88 | 1.02 | 51 |

| | Domain: Number of cubes satisfying requirement (B1) Number | Electro-conductive particle: Area ratio μ % | Electro-conductive particle: σ — | Electro-conductive particle: μ/σ — | Evaluation result: Toner charged quantity μC/g | Evaluation result: Toner charged quantity distribution | Evaluation result: Fog image — |
|---|---|---|---|---|---|---|---|
| Comparative Example 13 | — | — | — | — | −36 | 4.8 | D |
| Comparative Example 14 | — | — | — | — | −38 | 5.1 | D |
| Comparative Example 15 | 4 | 25 | 208 | 0.12 | −35 | 4.9 | D |
| Comparative Example 16 | 3 | 16 | 391 | 0.04 | −20 | 6.6 | D |
| Comparative Example 17 | 3 | 15 | 115 | 0.13 | −22 | 5.2 | D |

Since the developing blades according to Examples 39 to 44 have the configuration of the present disclosure in the electro-conductive layer, a charged quantity distribution was sharp and a high-quality image with a very small fog value was obtained.

On the other hand, in the developing blades of Comparative Examples 13 to 17, a toner charged quantity distribution was large and image quality was not good.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. An electrophotographic developing member comprising:

a support having an electro-conductive outer surface; and an electro-conductive layer on the electro-conductive outer surface of the support, the electro-conductive layer having a matrix comprising a first rubber and domains dispersed in the matrix, the domain each comprising a second rubber and an electronic conductive agent, wherein assuming that a metal film is provided on an outer surface of the developing member, and an impedance is measured by applying an alternating current voltage having an amplitude of 1 V between the electro-conductive outer surface of the support and the metal film while varying a frequency between $1.0\times10^{-2}$ Hz to $1.0\times10^{-7}$ Hz under an environment of a temperature of 23° C. and a relative humidity of 50%, in a double logarithmic plot with a frequency on an abscissa and an impedance on an ordinate, a slope at a frequency of $1.0\times10^{6}$ Hz to $1.0\times10^{7}$ Hz is −0.8 or more and −0.3 or less, and an impedance at a frequency of $1.0\times10^{-2}$ Hz to $1.0\times10^{0}$ Hz is $1.0\times10^{4}\Omega$ to $1.0\times10^{11}\Omega$.

2. The electrophotographic developing member according to claim 1, wherein the electro-conductive layer is provided directly on the outer surface of the support.

3. The electrophotographic developing member according to claim 1, further comprising an electro-conductive resin layer between the electro-conductive layer and the outer surface of the support, wherein assuming that a metal film is provided on an outer surface of the resin layer, and an impedance is measured by applying an AC voltage having an amplitude of 1 V between the electro-conductive outer surface of the support and the metal film while varying a frequency between $1.0\times10^{-2}$ Hz to $1.0\times10^{7}$ Hz under an environment of a temperature of 23° C. and a relative humidity of 50%, in a double logarithmic plot with a frequency on an abscissa and an impedance on an ordinate, an impedance at a frequency of $1.0\times10^{-2}$ Hz to $1.0\times10^{0}$ Hz is $1.0\times10^{-5}\Omega$ to $1.0\times10^{1}\Omega$.

4. The electrophotographic developing member according to claim 1, wherein the matrix has a volume resistivity that is higher than $1.0\times10^{12}$ Ω·cm and is $1.0\times10^{17}$ Ω·cm or less.

5. The electrophotographic developing member according to claim 1, wherein an arithmetic mean value Dm of inter-domain distances is 0.2 μm or more and 2.0 μm or less.

6. The electrophotographic developing member according to claim 1, wherein the support is a cylindrical support, and the electro-conductive layer is provided on an outer surface of the cylindrical support.

7. The electrophotographic developing member according to claim 6, wherein the electro-conductive layer has a thickness T of 100 μm or more, and wherein assuming that three cross sections of the electroconductive layer in a thickness direction thereof at a center in the longitudinal direction of the electroconductive layer, and L/4 from both ends of the electroconductive layer toward the center, are obtained, where L represents a length of the electroconductive layer in the longitudinal direction of the cylindrical support, and assuming that at each of the cross sections, an 15-μm square observation area is placed at arbitrary three positions in a thickness region from 0.1 T to 0.9 T in depth from the outer surface of the electroconductive layer, among domains observed in each of the nine observation areas, 80% by number or more of the domains satisfy the following requirements (1) and (2):

(1) A ratio of a cross-sectional area of the electronic conductive agent contained in the domain to a cross-sectional area of the domain is 20% or more; and (2) When defying a perimeter of the domain as A, and defining an envelope perimeter of the domain as B, A/B is 1.00 or more and 1.10 or less.

8. The developing member according to claim 1, wherein when a mean value of ratios of cross-sectional areas of the electronic conductive agents contained in each of the domains to cross-sectional areas of each of the domains appearing in a cross section of the electro-conductive layer in the thickness direction is defined as μ, and a standard deviation of the ratios is defined as σ, σ/μ is 0 or more and 0.4 or less, and μ is 20% or more and 40% or less, and at least eight of nine sample cubes sampled from any nine places of the electro-conductive layer, having one side of 9 and having a cubic shape satisfy the following requirement (3):

(3) When one sample cube is divided into 27 unit cubes whose one side is 3 μm and a volume Vd of the domains included in each of the unit cubes is calculated, the number of unit cubes in which Vd is 2.7 $\mu m^3$ to 10.8 $\mu m^3$ is at least 20.

9. An electrophotographic process cartridge comprising an electrophotographic developing member comprising: a support having an electro-conductive outer surface and an electro-conductive layer on the electro-conductive outer surface of the support, the electro-conductive layer having a matrix comprising a first rubber and domains dispersed in the matrix, the domain each comprising a second rubber and an electronic conductive agent, wherein assuming that a metal film is provided on an outer surface of the developing member, and an impedance is measured by applying an alternating current voltage having an amplitude of 1 V between the electro-conductive outer surface of the support and the metal film while varying a frequency between $1.0\times10^{-2}$ Hz to $1.0\times10^{7}$ Hz under an environment of a temperature of 23° C. and a relative humidity of 50%, in a double logarithmic plot with a frequency on an abscissa and an impedance on an ordinate, a slope at a frequency of $1.0\times10^{6}$ Hz to $1.0\times10^{7}$ Hz is −0.8 or more and −0.3 or less, and an impedance at a frequency of $1.0\times10^{-2}$ Hz to $1.0\times10^{0}$ Hz is $1.0\times10^{4}\Omega$ to $1.0\times10^{11}\Omega$.

10. An electrophotographic image forming apparatus comprising a process cartridge comprising an electrophotographic developing member: comprising a support having an electro-conductive outer surface and an electro-conductive layer on the electro-conductive outer surface of the support, the electro-conductive layer having a matrix comprising a first rubber and domains dispersed in the matrix, the domain each comprising a second rubber and an electronic conductive agent, wherein assuming that a metal film is provided on an outer surface of the developing member, and an impedance is measured by applying an alternating current voltage having an amplitude of 1 V between the electro-conductive outer surface of the support and the metal film while varying a frequency between $1.0\times10^{-2}$ Hz to $1.0\times10^{7}$ Hz under an environment of a temperature of 23° C. and a relative humidity of 50%, in a double logarithmic plot with a frequency on an abscissa and an impedance on an ordinate, a slope at a frequency of $1.0\times10^{6}$ Hz to $1.0\times10^{7}$ Hz is −0.8 or more and −0.3 or less, and an impedance at a frequency of $1.0\times10^{-2}$ Hz to $1.0\times10^{0}$ Hz is $1.0\times10^{4}\Omega$ to $1.0\times10^{11}\Omega$.

* * * * *